US006402435B1

(12) United States Patent
Lewis

(10) Patent No.: US 6,402,435 B1
(45) Date of Patent: Jun. 11, 2002

(54) PRE-STRESSED MODULAR RETAINING WALL SYSTEM AND METHOD

(76) Inventor: Cyrrus Gregory Lewis, CGL Systems 197 Floral Blvd., Floral Park, NY (US) 11001-2440

( * ) Notice: Subject to any disclaimer, the term of this patent is extended or adjusted under 35 U.S.C. 154(b) by 0 days.

(21) Appl. No.: 09/474,069

(22) Filed: Dec. 29, 1999

(51) Int. Cl.[7] ..... E02D 29/02

(52) U.S. Cl. ..... 405/284; 405/286; 405/262; 52/223.5; 52/223.7

(58) Field of Search ..... 405/262, 284, 405/285, 282, 287, 272, 273, 302.4; 52/169.9, 223.4, 223.5, 223.6, 223.7

(56) References Cited

U.S. PATENT DOCUMENTS

| | | | | |
|---|---|---|---|---|
| 1,909,539 A | | 5/1933 | Huntoon | |
| 2,149,957 A | | 3/1939 | Dawson | |
| 2,159,556 A | | 5/1939 | Habicht | |
| 3,464,211 A | | 9/1969 | Andresen | |
| 3,922,864 A | | 12/1975 | Hilfiker | |
| 4,278,364 A | | 7/1981 | Frehner | |
| 4,312,606 A | | 1/1982 | Sarikelle | |
| 4,384,810 A | | 5/1983 | Neumann | |
| 4,426,176 A | | 1/1984 | Terada | |
| 4,592,678 A | * | 6/1986 | McNinch, Jr. et al. | 405/284 |
| 4,664,562 A | | 5/1987 | Clark et al. | |
| 4,688,362 A | * | 8/1987 | Pedersen et al. | 52/223.7 |
| 4,726,567 A | * | 2/1988 | Greenberg | 52/169.9 |
| 4,815,897 A | | 3/1989 | Risi et al. | |
| 4,834,585 A | | 5/1989 | Hasenwinkle et al. | |
| 4,874,272 A | | 10/1989 | Egan | |
| 4,914,876 A | | 4/1990 | Forsberg | |
| 4,920,712 A | | 5/1990 | Dean, Jr. | |
| 5,087,150 A | | 2/1992 | McCreary | |
| 5,161,918 A | | 11/1992 | Hodel | |
| 5,163,261 A | | 11/1992 | O'Neill | |
| 5,197,245 A | * | 3/1993 | Davis | 52/223.7 |
| 5,205,675 A | | 4/1993 | Hamel | |
| 5,214,898 A | | 6/1993 | Beretta | |

(List continued on next page.)

FOREIGN PATENT DOCUMENTS

| | | |
|---|---|---|
| AT | 296367 | 1/1972 |
| DE | 31 21 681 | 2/1982 |
| EP | 0 872 607 | 10/1998 |

OTHER PUBLICATIONS

Patent Abstracts of Japan, vol. 010, No. 227, Aug. 7, 1986 & JP 61 060929A, Mar. 28, 1986 abstract.

"Earth Retaining Systems. Geortechnical Engineering Circular No. 2," pp. 1–161, Geosyntec Consultants, Atlanta, George, U.S. Dept. of Commerce, NTIS (PB97–173629; Feb. 1997).

DeLeuw, Cather & Co. illustrations/blueprints: "Division of Highways: Typical Wall Sections," "Division of Highways: Retaining Wall Details," "Division of Highways: Alignment Device & Misc. Wall Details," "Division of Highways: Double T Retaining Wall Details (Type I)," Division of Highways: Double T Retaining Wall Details (Type IV–S & I), Sheets I–117, I–118, I–119, I–121, I–122.

*Primary Examiner*—David Bagnell
*Assistant Examiner*—Frederick L. Lagman
(74) *Attorney, Agent, or Firm*—Andrea G. Reister; Covington & Burling

(57) ABSTRACT

The present invention relates to a system and method for constructing a pre-stressed modular construction for supporting or retaining an applied load. In particular, the present invention relates to a system and method for pre-stressed modular retaining walls. The system comprises a plurality of header stacks constructed from a variety of header units. The header stacks are coupled by structural members. Active reinforcement elements are used to induce a pre-stressing force into the header stacks to support or retain the applied load. A method for constructing the modular construction is provided.

138 Claims, 55 Drawing Sheets

U.S. PATENT DOCUMENTS

| | | | | | |
|---|---|---|---|---|---|
| RE34,314 | E | | 7/1993 | Forsberg | |
| 5,224,801 | A | | 7/1993 | Quaney | |
| 5,257,880 | A | | 11/1993 | Janopaul, Jr. | |
| 5,337,527 | A | | 8/1994 | Wagenaar | |
| 5,350,256 | A | | 9/1994 | Hammer | |
| 5,355,647 | A | * | 10/1994 | Johnson et al. | 52/223.7 |
| 5,421,135 | A | | 6/1995 | Stevens et al. | |
| 5,487,623 | A | | 1/1996 | Anderson et al. | |
| 5,490,363 | A | | 2/1996 | Woolford | |
| 5,494,379 | A | | 2/1996 | Anderson et al. | |
| 5,505,034 | A | | 4/1996 | Dueck | |
| 5,537,796 | A | | 7/1996 | Kliethermes, Jr. | |
| 5,547,316 | A | * | 8/1996 | Zege et al. | 405/287 |
| 5,551,809 | A | | 9/1996 | Forsberg | |
| 5,564,865 | A | * | 10/1996 | Jansson | 405/286 |
| 5,567,089 | A | * | 10/1996 | Akamine | 405/285 |
| 5,586,841 | A | | 12/1996 | Anderson et al. | |
| 5,678,373 | A | * | 10/1997 | Franklin et al. | 52/223.7 |
| 5,688,078 | A | | 11/1997 | Hammer | |
| 5,865,006 | A | | 2/1999 | Dawson | |

* cited by examiner

PRE-STRESSED MODULAR RETAINING WALL SYSTEM AND METHOD

BACKGROUND OF THE INVENTION

1. Field of the Invention

The present invention relates to a system and method for fabricating a pre-stressed modular construction for supporting or retaining an applied load. More particularly, the present invention relates to a system and method for pre-stressed modular retaining walls.

2. Related Art

A retaining wall is an engineered structure that has the particular task of ensuring that a given unstable, or potentially unstable, soil mass is prevented from moving under the influence of gravity. Frequently, the retaining wall is also called upon to withstand a superimposed load, a surcharge load, on and/or within the soil mass, such as a highway, together with its traffic loading, or the loading induced by the foundations of a building located in close proximity to the retaining structure. Further, the retaining wall may be required to support some other non-retaining load that is resisted by structural elements directly attached to, and/or incorporated within, the wall structure itself.

Since the early 1970's, numerous alternative wall systems have been introduced. Examples of these systems include mechanically stabilized earth (MSE) walls and reinforced soil slopes (RSS) employing metallic or polymeric internal reinforcement; anchored walls, such as the soldier pile and lagging walls, diaphragm walls, and soil mixed walls; prefabricated modular gravity wall systems including cribs, bins, and gabions; and in-situ reinforced wall systems such as soil-nailed walls and micropile walls. However, because of the ever increasing demands that are being placed on our city and urban environments and, most noticeably, on the country's transportation infrastructure, together With the need to preserve our natural environment while providing for the associated societal expectations, there is an increasing number of problematic sites where the currently available retaining wall options cannot provide an optimal solution. In particular, for those sites that require "foundation-up" construction, there is a dearth of rapid construct, high capacity retaining wall systems possessing significant functional flexibility and which demand only a small construction footprint. Retaining structures constructed to resist soil pressures are often categorized according to their basic mechanisms of retention. The retention mechanisms include internally stabilized, externally stabilized, and hybrid systems. Alternatively, retaining walls may be categorized according to their source of support, that is, their source of equilibrating reaction forces. The sources of support for these retaining walls may be bracketed into gravity, semigravity, and nongravity.

An internally stabilized system involves reinforced soils to retain a soil mass and any surcharge loads. This reinforcing may be provided by adding reinforcement directly to the soil mass, where this augmented soil mass is providing the retaining/self-retaining structure, as the system is being constructed from the "ground" up. Various types of reinforcement are available, and the soils between the layers of reinforcement are placed in a carefully controlled manner meeting design specifications—that is, the placed soil is "engineered fill." Frequently, pre-cast concrete elements are tied directly to these soil reinforcing components. This system forms the basic approach of Mechanically Stabilized Earth, MSE, retaining wall systems.

Alternatively, this internal stabilization via the reinforcing of the soil mass in question may proceed from the top down.

In this (directionally) opposite approach, reinforcing elements are added to the existing soil mass in order to provide the existing materials with a greater degree of internal stability. As an example of this approach, the face, that is exposed as the excavation proceeds from the top down, has soil nails installed through it into the ground mass, which nails extend beyond any potential failure plane. Often, a shotcrete cover over the exposed face is placed and subsequently connected to these nails, thereby providing a protection against erosion of the soil face.

Further to the above methods of reinforcing a soil mass, driven piles or cast-in-drilled-hole piles may be used to stabilize the mass of concern. However, this approach is generally considered when the stability issue is more global in nature. By "global" is meant the situation where a body of soil is experiencing a deep-seated instability, which instability ideally needs to be eliminated.

With externally stabilized systems, a physical structure is employed to confine the body of soil. The equilibrating reaction forces, required by an externally stabilized system, are provided either through the weight of a morpho-stable structure, or by the reactions mobilized via the inclusion and/or extension of various system elements into "reaction zones". The latter reactions may be generated by driving the piles of a sheet-pile wall system, for example, to sufficient depths into competent soil. Or, reactions may be generated via the use of ground anchors providing point-reactions on the externally stabilizing structure. Frequently, combinations of reaction-force-providing structural elements are employed, in a given situation, to deliver the total force equilibration required for an externally stabilized retaining wall.

With regard to sources of support, that is, with regard to the sources of the equilibrating reaction forces, retaining wall systems may be categorized into three groups. These are the groupings of (1) gravity walls, (2) semigravity walls, and (3) nongravity walls.

Gravity walls derive their capacity to resist imposed soil loads through the dead weight of the wall itself (that is the physical wall that is constructed) or through an integrated mass that can be either internally or externally stabilized. Gravity walls may be further classified into four types as follows. The first type is an internally stabilized soil mass system. Some of the examples given above are typical. The stability of a cut slope may be maintained in a top-to-bottom installation of soil nails, installed as the excavation of materials proceeds. Or, a retaining soil mass may be constructed of engineered fill, in a bottom-to-top sequence, thereby creating a soil mass possessing the required internal stability via the inclusion of reinforcing elements at regular vertical spacing. Where the soil mass is constructed from engineered fill, the face of such soil mass may be protected by using pre-cast concrete facings as with many MSE systems. Where soil nails are used, the front face is preferably protected using shotcrete or cast-in-place concrete. The second type of gravity wall is an externally stabilized soil mass system. Included in this category are simple modular pre-cast concrete walls. Such simple pre-cast concrete walls are stacked, but include no internal mechanism for enhancing structural capacity. Another example is prefabricated metal bin walls. The third type is also an externally stabilizing system. In this category are the generic walls including the masonry walls, the stone walls, "dumped" (usually shaped) rock walls, and the contained rock walls, often using uniform crushed rock and known as gabion walls. The fourth system is also an externally stabilizing system. Examples are the use of cast-in-place mass concrete wall, or the cementtreated soil wall. Where the face of the treated soil wall requires protection, a pre-cast concrete panel may be used, which panel would be anchored to the treated-soil wall.

Semigravity walls derive their restraining capability through the combination of dead weight and structural resistance. Generally, these semigravity walls are externally stabilizing structures. They may be constructed on spread footings or on deep foundations. Historically, the dominant type of semigravity retaining wall is the conventional cast-in-place concrete cantilever structure. Alternatively, various kinds of pre-cast concrete walls are available in the market, which walls are constructed on cast-in-place footings. Cantilever semi-gravity retaining walls may be very reliant on the dead weight of the soil mass that rests on the section of the foundation footing that extends back beyond the wall's stem, while also developing the necessary structural resistance. An example of the necessary structural resistance would be the wall's moment and shear capacity at the base of the stem.

Nongravity walls derive their restraining capability through lateral resistance. This lateral resistance may be mobilized in a number of ways. For example, the continuation of vertical structural elements down to competent soils, or the use of ground anchor retainers directly delivering point resistance to the retaining structure. Examples of externally stabilizing nongravity systems are embedded cantilevering wall elements, sheet piles, drilled shafts, or slurry walls. A second group of nongravity walls includes the first listing of embedded walls but have additional restraint via utilizing multiple ground anchor retainers.

Where, for example, there is a need to arrest the creep movement of a slope, nongravity systems may be employed in the form of dowel piles or caissons, to internally stabilize the soil mass. It should be noted that required equilibrating forces may be developed via the use of reaction members which develop point-reaction-forces. (Consider the reactions to a truss, which truss transfers moment to its support). That is, the structural elements delivering resistance to the retaining wall structure overall may have so little moment (and shear) resisting capacity, if any, that the equilibrating set of forces are established via point-acting reaction forces. For example, an arrangement of elements for such a system, may consist of a set of vertical (or near vertical) piles, a set of (near) vertical ground anchors and, finally, a set of (near) horizontal ground anchors. In this case, the piles would take up compression loads, the (near) vertical ground anchors would provide a (predominantly) downward reaction, which would act in concert with the piles' upward reaction to provide moment resistance to the base foundation. The (near) horizontal ground anchors, placed appropriately at the foundation beam/pile cap level, would resist the net "shear" forces from the retaining wall structure that would cause the foundation element to translate.

An example of a retaining wall is shown, for example, in U.S. Pat. No. 2,149,957 ("the Dawson patent"). The wall of the Dawson patent utilizes stretchers and headers to construct a retaining wall. Dawson further discloses "positive tensile anchorage." Such "positive tensile anchorage" refers to the construction of the individual elements and has no impact on the primary behavior of the system disclosed in the Dawson patent. Moreover, the wall of the Dawson patent does not pre-stress header assemblies through post-tensioning. Further, the Dawson patent does not disclose vertically disposed passive reinforcement through the header assemblies.

Retaining wall systems, such as those shown in the Dawson patent, often do not provide an optimal solution for retaining or supporting an applied load. The design of conventional retaining wall systems may result in constructibility problems, resulting in longer construction periods, higher cost, and more extensive use of the surrounding land. Thus there is a need in the art for a retaining wall system that provides an improved solution for retaining or supporting an applied load and overcomes the limitations of constructibility problems with existing systems. There is a further need in the art for a retaining wall system that is modular and adaptable to a wide variety of construction needs.

SUMMARY OF THE INVENTION

The present invention solves the problems with, and overcomes the disadvantages of conventional retaining wall systems. Accordingly, the present invention provides a system and method for constructing a pre-stressed modular construction for supporting or retaining an applied load. The retaining wall systems of the present invention are specifically designed to provide the owner, architect, engineer, and constructor with retaining wall solutions that most adequately provide for more difficult sites and/or increased performance expectations.

The present invention relates to a system and method for constructing a pre-stressed modular construction for supporting or retaining an applied load. In particular, the present invention relates to a system and method for constructing pre-stressed modular retaining walls. In one aspect of the present invention, a system for constructing a pre-stressed modular construction for retaining or supporting an applied load is provided. The system comprises a header stack, wherein the header stack is comprised of a plurality of header units; and an active reinforcement element configured to cooperate with the header stack so that post-tensioning the active reinforcement element imparts a corresponding pre-stressing force into the header stack. In one embodiment of the invention, the header units that make up the header stack comprise a center element having a top face, and a bottom face; a first end element disposed at one end of said center element; and a second end element disposed at another end of said center element.

The system may comprise active reinforcement elements disposed external to the header stack. In such a configuration, there may be passive reinforcement elements disposed internal to the header stack. Additionally, active reinforcement elements may be disposed internal to the header stack.

In another aspect of the system, the header units that make up the header stack comprise a top face and a bottom face; a base element having a first end and a second end; a head element having a first end and a second end; and a pair of side elements extending between each of the first end and the second end of the base element and the head element. The system further comprises a structural member for coupling two or more header stacks and a complementary structural element disposed between two header units and extending between two or more header stacks.

In another aspect of the invention, a pre-stressed modular construction for retaining or supporting an applied load is provided. The construction comprises a plurality of header stacks, wherein each of the header stacks comprises a plurality of header units; and a plurality of active reinforcement elements configured to cooperate with at least one of the header stacks so that post-tensioning the active reinforcement element imparts a corresponding pre-stressing force into the header stack. There are a plurality of structural members, wherein each of the structural members is coupled to at least one of the header stacks. In an exemplary embodiment of the construction, the header units that make up the header stack comprise a center element having a top face, and a bottom face; a first end element disposed at one end of the center element; and a second end element disposed at another end of the center element.

In another aspect of the pre-stressed modular construction, the header units that make up the header stack comprise a top face and a bottom face; a base element having a first end and a second end; a head element having a first end and a second end; and a pair of side elements extending between each of the first end and the second end of the base element and the head element. The construction further comprises a structural member for coupling two or more header stacks and a complementary structural element disposed between two header units and extending between two or more header stacks.

In a further aspect of the invention, a pre-stressed modular construction for retaining or supporting an applied load is provided. The pre-stressed modular construction preferably comprises at least two header stacks, each of the header stacks being comprised of a plurality of stacked header units. There is also preferably at least one pre-stressing tendon for each of the header stacks, with each pre-stressing tendon being configured to cooperate with its header stack so that post-tensioning the pre-stressing tendon prior to application of the applied load imparts a corresponding pre-stressing force into its header stack at at least one lock-off point. There is also a structural member coupled to the at least two header stacks. The pre-stressed modular construction further preferably comprises a tieback transfer beam disposed between two of the header units and extends between the at least two header stacks. There is also a ground anchor coupled to the tieback transfer beam. The structural member can be a concrete stretcher, a pre-cast concrete panel, a cast-in-place concrete panel, a cast-in-place concrete arch, or shotcrete.

In another aspect of the invention, a method of fabricating a pre-stressed modular construction for retaining or supporting an applied load is provided. The method comprises providing a foundation for the construction; constructing a plurality of header stacks on the foundation, with each header stack being comprised of a plurality of header units; coupling an active reinforcement element to each header stack; and post-tensioning the active reinforcement element such that it imparts a corresponding pre-stressing force into the header stack. The constructing step comprises stacking a plurality of header units. The coupling step comprises pre-positioning the active reinforcement element in the foundation; feeding the header units over the active reinforcement element, the active reinforcement element passing through passthrough ducts in the header units; and securing the active reinforcement element to the header stack. In a configuration where external active reinforcement elements are used, the active reinforcement elements may be locked off in a variety of ways. The active reinforcement elements may be locked off at external coupling devices coupled to the header stack, or locked off at a complementary structural element.

In a further aspect of the invention, a method of fabricating a pre-stressed modular construction for retaining or supporting an applied load is provided comprising the steps of suspending a plurality of header units; casting a foundation beneath the header units; constructing a plurality of header stacks on the cast foundation, wherein each header stack is adjacent one of the plurality of suspended header units; coupling an active reinforcement element to the header stack; and post-tensioning the active reinforcement element such that it imparts a corresponding pre-stressing force into the header stack.

In a further aspect of the present invention, a method of fabricating a pre-stressed modular construction for retaining or supporting an applied load is provided. The method comprises the steps of providing a foundation for the construction; constructing a plurality of header stacks on the foundation, wherein each header stack comprises a plurality of header units; coupling an active reinforcement element to each header stack; post-tensioning the active reinforcement element such that it imparts a corresponding pre-stressing force into at least one of the header stacks; providing additional header units to at least one of the header stacks; and repeating the step of post-tensioning after application of another portion of the applied load. In a still further aspect of the present invention, a method of fabricating a pre-stressed modular construction for retaining or supporting an applied load is provided. The method comprises the steps of providing a foundation for the construction; constructing a plurality of header stacks on the foundation, wherein each header stack comprises a plurality of header units; coupling an active reinforcement element to each header stack; imparting a portion of the applied load to the modular construction; post-tensioning the active reinforcement element such that it imparts a corresponding pre-stressing force into at least one of the header stacks; providing additional header units to at least one of the header stacks; and repeating the step of post-tensioning after application of another portion of the applied load.

Features and Advantages

An advantage of the present system is that structural pre-stressing may be sequentially modified, most typically increased, as the soil loading on the retaining wall changes.

Another advantage of the present system is that retaining wall (vertical) sections may be given sufficient and/or final pre-stress so as to allow for the construction of other structural members. If necessary, this could all take place before the soil loads are placed on the wall.

A further advantage of the present system is that the retaining wall structure may be stressed so as to always possess "residual", or "net", compressive stress on the "tension" side of any given header stack cross-section. This latter characteristic would be called on in environmentally hostile situations. For example, environmentally hostile situations may exist where naturally aggressive minerals are present in the ground water in contact with, or in close proximity to, the retaining wall, or where the retaining wall is a sea wall.

An advantage of the system of the present invention is ready availability. Short period cyclic casting of standardized structural modules assures that structural components are produced in sufficient quantities to satisfy fast track construction schedules.

A further advantage of the system of the present invention is superior quality control. Plant-cast pre-cast concrete components are manufactured under optimum conditions of forming, fabrication and placement of the reinforcement, inclusion of pre-stressing passthrough ducts and other embedded items and features. The optimally controlled placement and compaction of low slump concrete having optimized mix design and control, along with favorable curing conditions, typically not achievable on site, further significantly increase the in-service performance of these elements.

Yet another advantage of the system of the present invention, for retaining wall construction possessing a given structural capacity, is reduced construction depth. High performance concrete is easily achievable. For any given loading conditions, via the correct selection of (sub)group of components, the retaining structure depth may be minimized, a significant advantage where space is at a premium.

Another advantage of the system of the present invention is its high load-resisting capacity. For a given set of spatial restrictions and/or for a given volume of materials used, pre-cast pre-stressed concrete offers greater structural strength and rigidity. These attributes become very significant in many applications.

A further advantage of the system of the present invention is its durability. Pre-cast concrete, in particular high-performance pre-cast concrete, is exceptionally resistant to weathering, abrasion, impact and corrosion. The resulting structures have great resistance to the deleterious effects found in hostile environments.

Yet another advantage of the system of the present invention is its long economic life. The reliability of currently available pre-stressing systems and the durability characteristics of the pre-cast elements allow for the economic construction of very-long-life retaining and/or support structures. Pre-stressing reduces or, if required, completely eliminates tension cracks, and thereby guarantees the integrity of the concrete and the protection of the embedded steel elements.

Another advantage of the system of the present invention is derived from the use of architectural concrete. The process of pre-casting concrete components, for example, the pre-cast panels that may be used with certain embodiments of the present invention, lends itself to the sculpturing of these exposed elements, and the consequent enhanced appearance of the final structure.

Still another advantage of the system of the present invention is the flexibility of construction sequence. The application of pre-stress, in particular the staged and/or sequenced application of pre-stress, to the assemblies of pre-cast concrete modules in these systems allows for sequenced construction without re-setup penalties.

Another advantage of the system of the present invention is the control of shrinkage and creep, and the consequent effects of same, which control can essentially be "dialed up." In this regard, the ready quality control of concrete products, that are manufactured via plant-cast pre-casting, affords greater accuracy in the determination of anticipated shrinkage and creep. With knowledge of the characteristics of pre-stressing components and the concrete characteristics of the various modules, along with the control of the pre-stressing stress magnitudes and distributions, the shrinkage and creep may be accurately predetermined.

Another advantage of the system of the present invention is the reduction or complete elimination of site formwork. Certain embodiments of the invention, as built above foundation level, are constructed entirely independent of cast-in-place concrete.

A further advantage of the present invention is its speed of construction. The fact that all embodiments can employ pre-cast header modules, used to form the header stacks, and some can be completely comprised of pre-cast elements, contributes significantly to the guaranteed speed of erection. One of the principal aims of these systems is to provide retaining wall and/or support structural systems that, not only provide high capacity, but may be erected with great rapidity.

Additional features and advantages of the invention will be set forth in the description that follows, and in part will be apparent from the description, or may be learned in practice of the invention.

BRIEF DESCRIPTION OF THE DRAWINGS

The accompanying drawings, which are incorporated in and constitute a part of this specification, illustrate embodiments of the invention and, together with the description, serve to explain the features, advantages, and principles of the invention.

Figure 1:
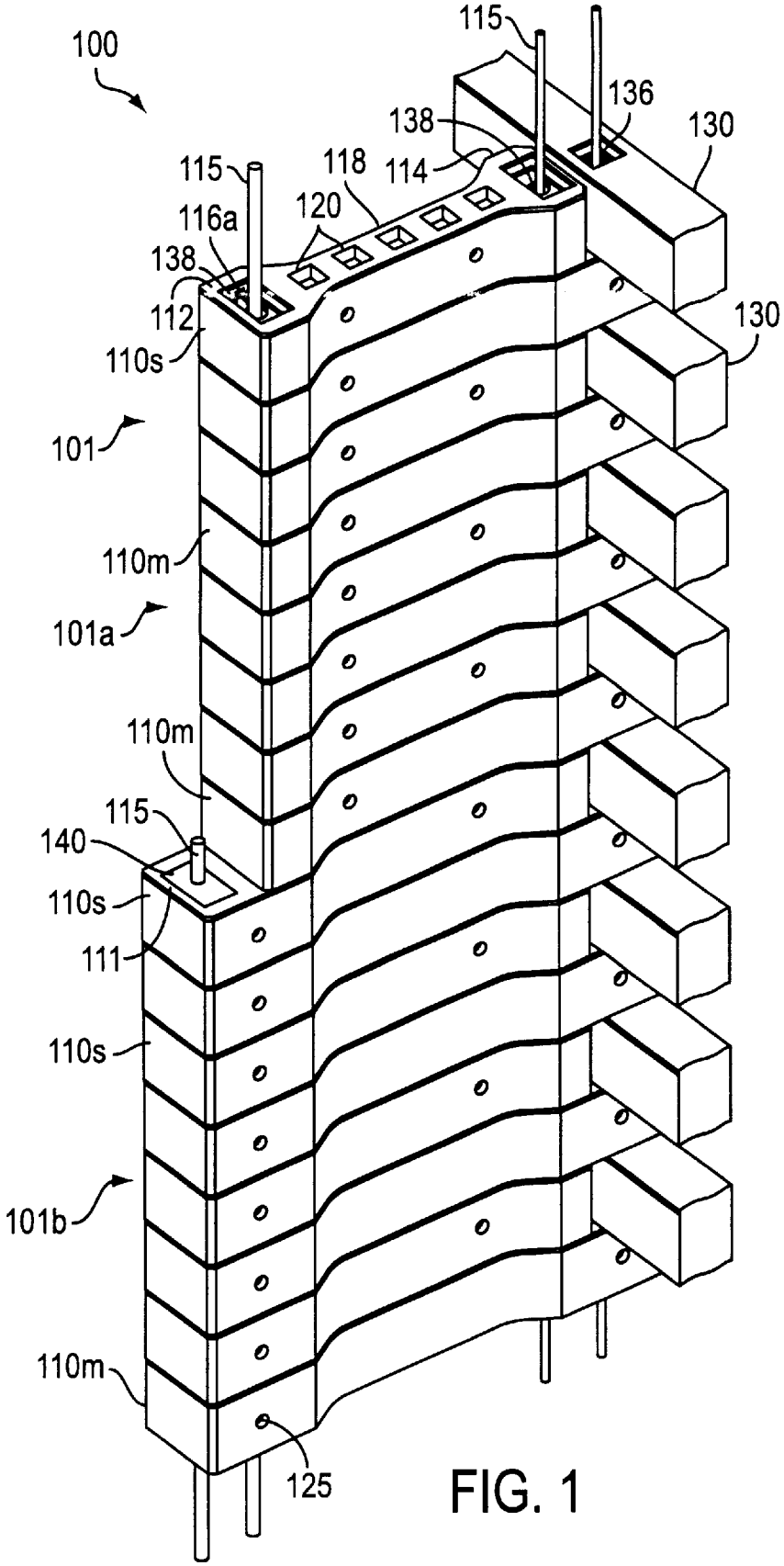
FIG. 1 is a perspective view of an exemplary system according to the present invention.

The illustrations shown herein, of necessity, take presentation liberties. Among these are the sectioning of the retaining wall structures. In order to show close-up detail only small sections of the overall structure are shown. Moreover, only some of the figures indicate the sectioned nature of the components via the use of exposed reinforcing steel. Additionally, for example, the shear reinforcing steel may be omitted, where any rebar is indicated at all. Generally, the soil/rock mass being retained by any given retaining wall is not indicated in these figures.

DETAILED DESCRIPTION OF THE PREFERRED EMBODIMENTS

Reference will now be made in detail to the present preferred embodiments of the invention, examples of which are illustrated in the accompanying drawings. The exemplary embodiments of this invention are shown in some detail, although it will be apparent to those skilled in the relevant art that some features may not be shown for the sake of clarity.

The systems of the present invention possess fundamental characteristics that are common to all of the constituent groups (i.e. subsystems). The systems are preferably comprised, at least partially, of pre-cast concrete components, called headers 110 or header units 110. These components, when stacked one on top of the other, form header stacks 101. These header stacks 101 are then augmented in a variety of ways. The augmenting members generally form secondary structural members 130. These components are secondary in the sense that they are available to resist soil loading, directly transferring these loads to the primary structural members, the header stacks 101, which transfer the accumulated loads to structural elements which elements mobilize the equilibrating reaction forces which will be explained in detail below. These secondary structural members 130, or structural members, may be comprised of pre-cast concrete "stretchers", pre-cast concrete panels, cast-in-place (CIP) concrete panels, cast-in-place (CIP) concrete arches, or may be constructed from various configurations of shotcrete.

Another characteristic of the present invention that is consistent throughout these systems, is the manner in which the header stacks 101 are imparted their structural capacity to withstand imposed or applied load. The pre-cast concrete header units 110 that are stacked in a vertical plane, are, at predetermined stages of the construction process, pre-stressed. This pre-stressing is typically imparted to the header stacks 101 via the post-tensioning of tendons 115, which include, but are not limited to, cables, rods, or threadbars.

Figure 34A:
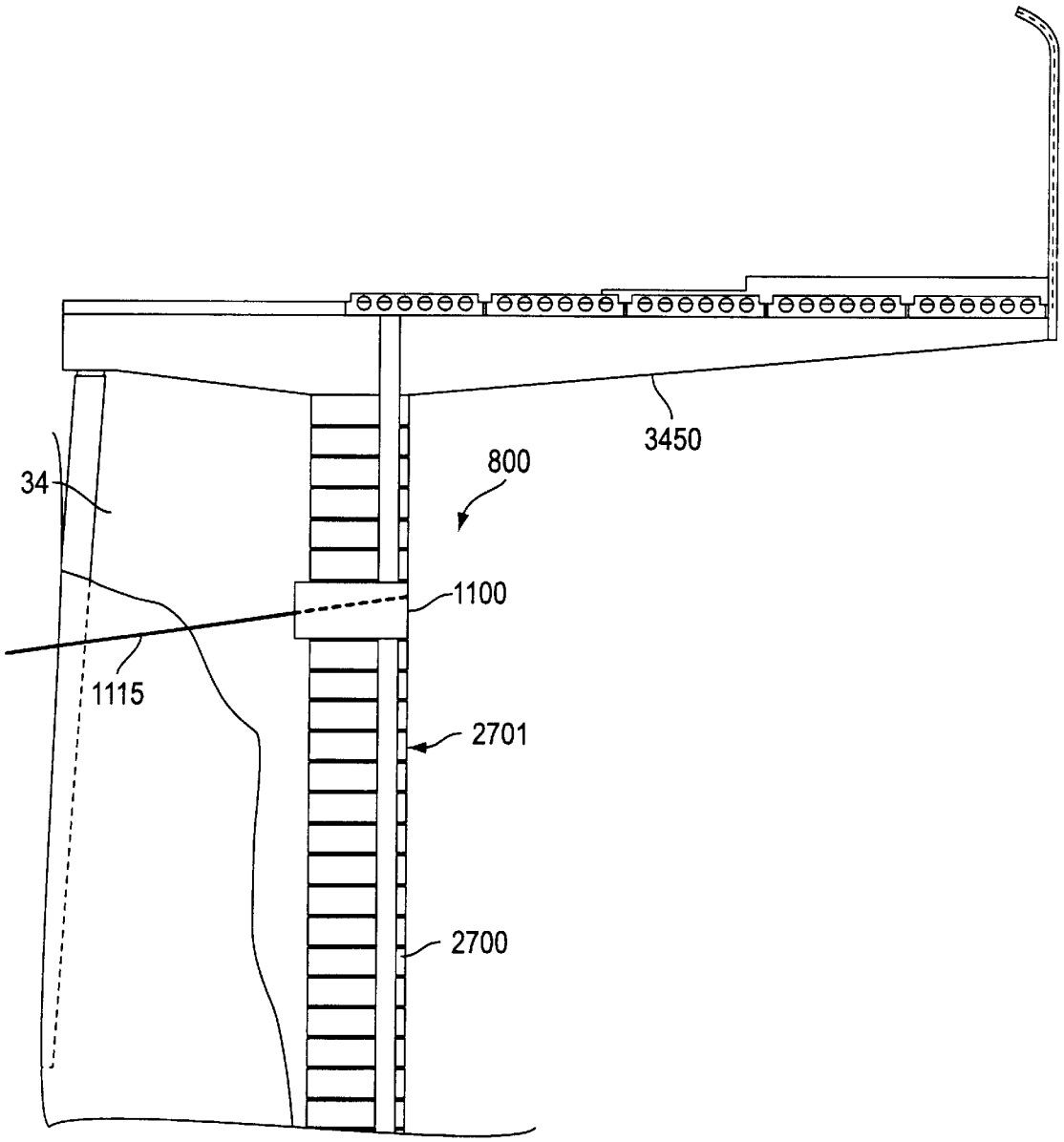
FIG. 34*a* is a side elevation of an exemplary application of the system of the present invention.
Figure 34B:
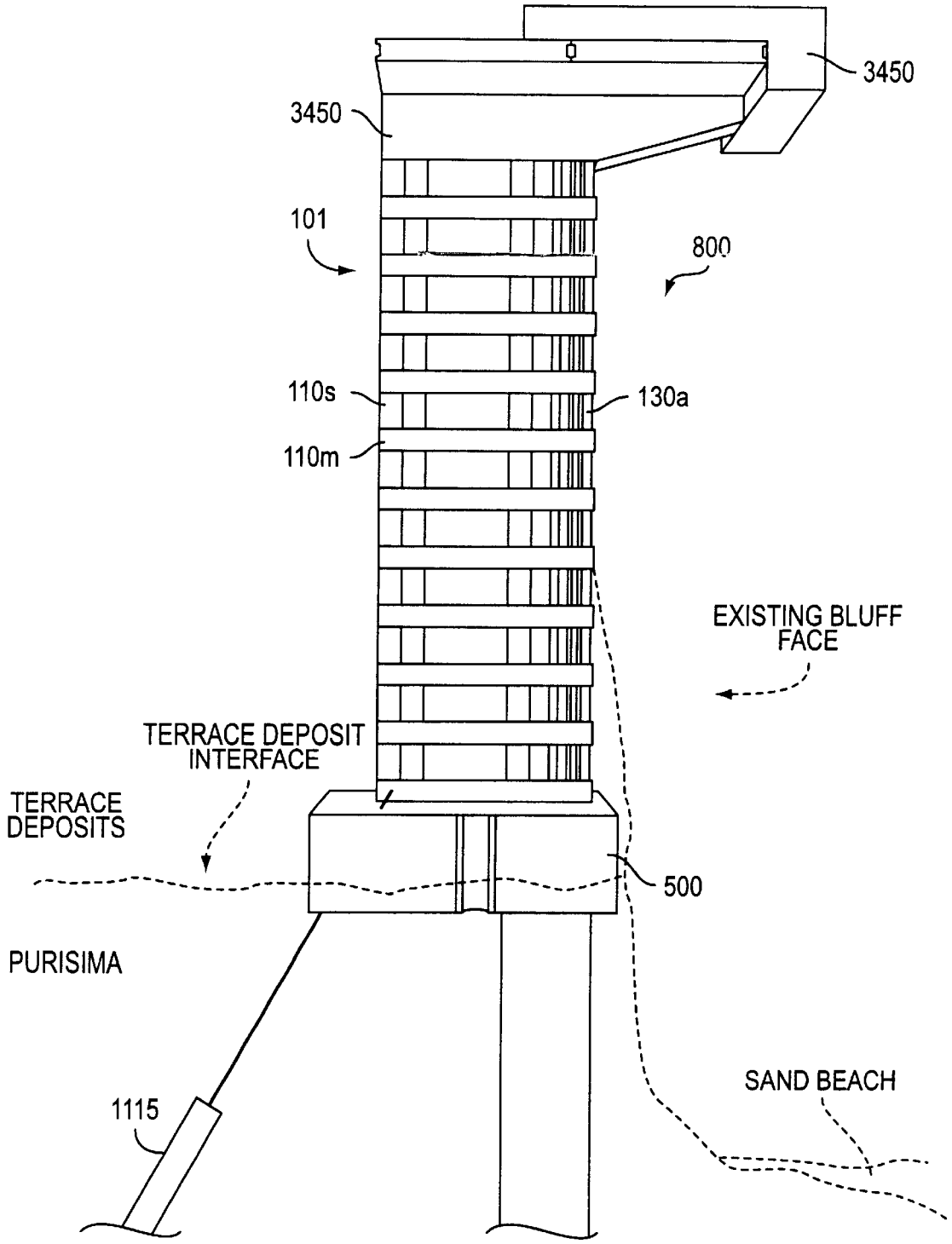
FIG. 34*b* is a cross section of an exemplary application of the system of the present invention depicted in FIG. 34*f*.
Figure 34C:
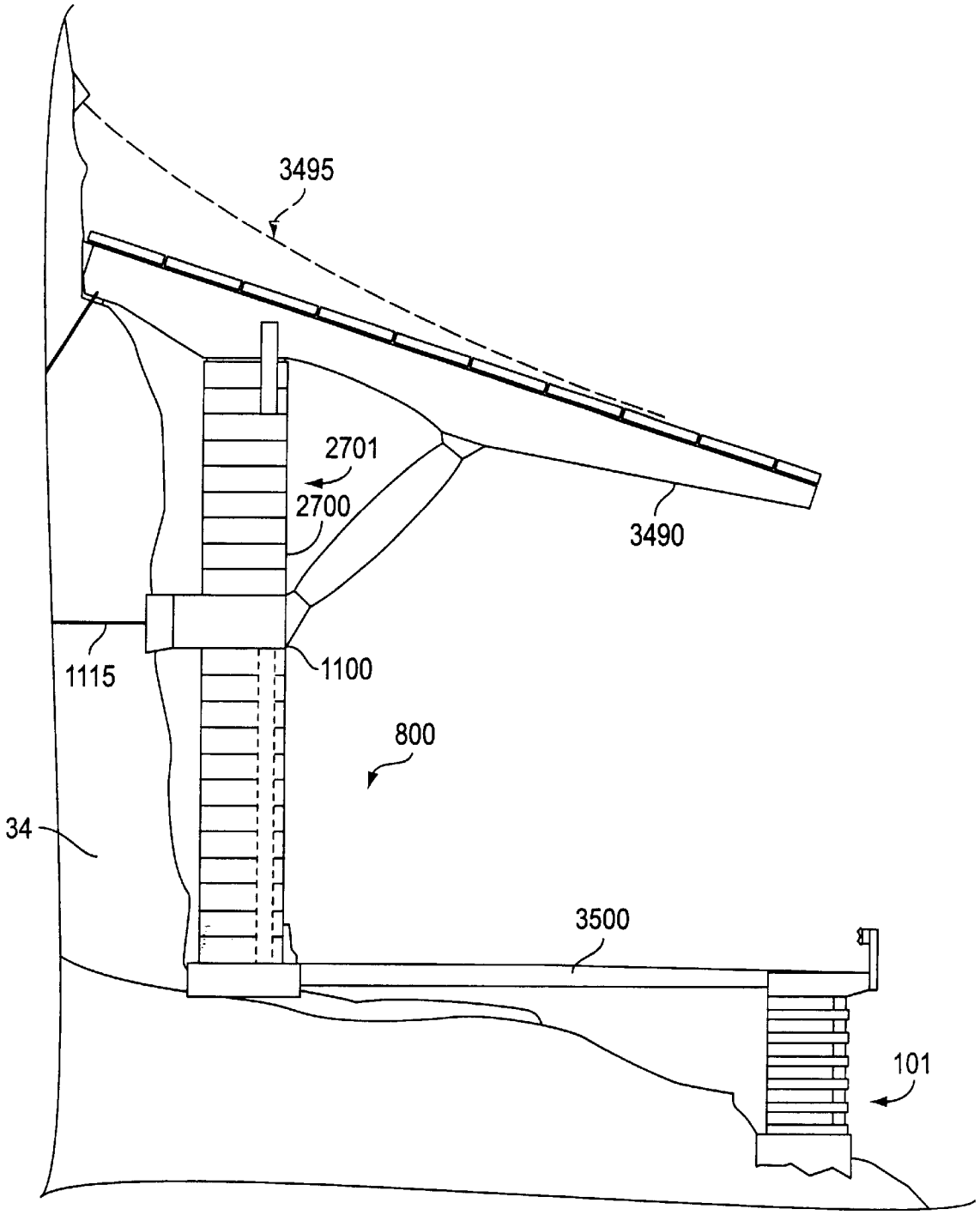
FIG. 34*c* is a side elevation of an exemplary application of the system of the present invention.
Figure 34D:
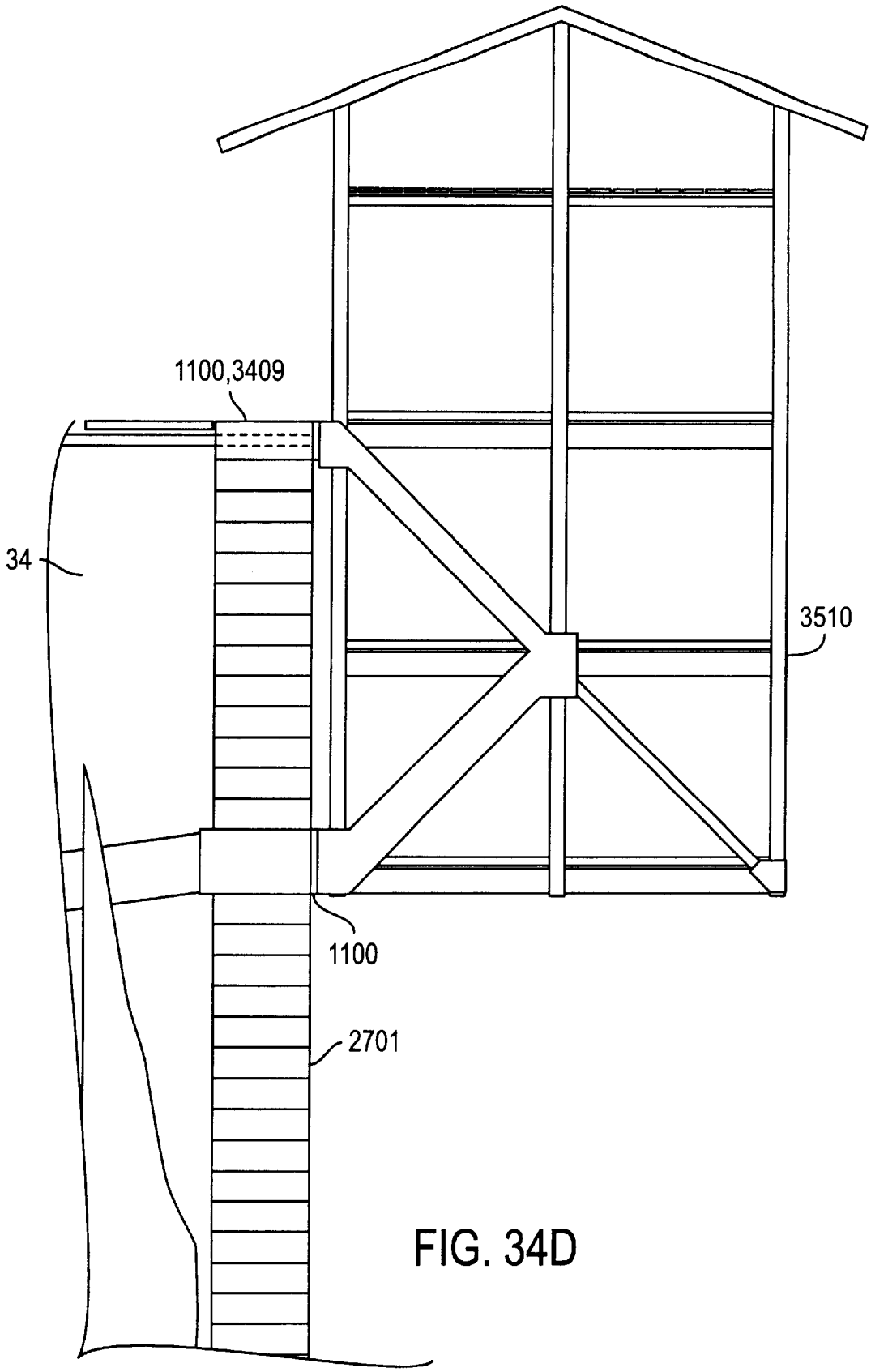
FIG. 34*d* is a side elevation of an exemplary application of the system of the present invention.
Figure 34E:
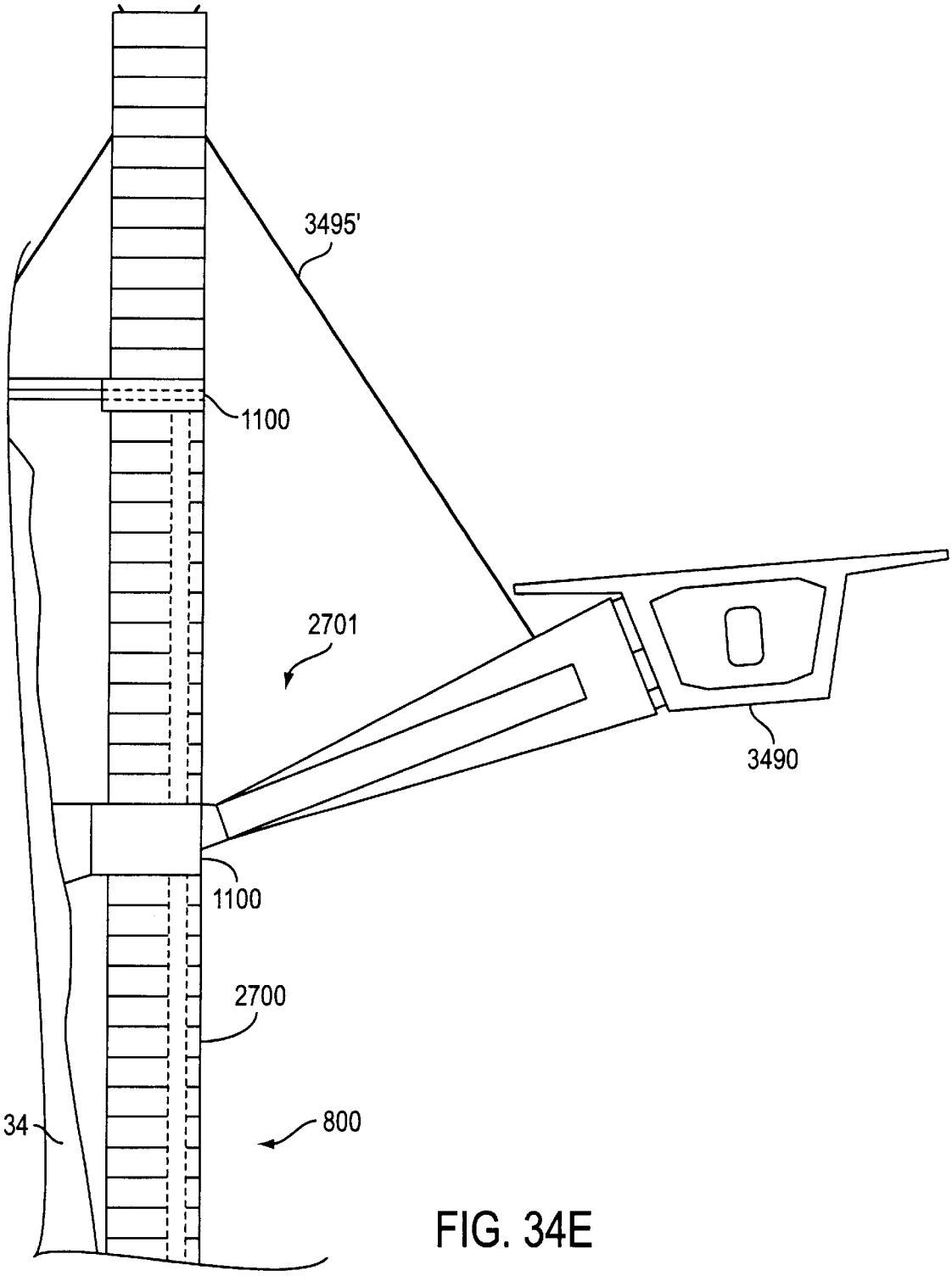
FIG. 34*e* is a side elevation of an exemplary application of the system of the present invention.

Another element of the system is a complementary structural element 1100 (best seen, for example, in FIGS. 1 and 13), which may be referred to herein as a tieback transfer beam (or TTB). This complementary structural element 1100 may have more than one role. In one principal role, the complementary structural element 1100 will "gather", primarily the lateral components of, the accumulated loads being resisted by the header stacks 101, and transfer them to the equilibrating reaction forces that are provided by other structural elements, such as tiebacks. The complementary structural element 1100 may also be used to couple a retaining wall horizontally. This would have particular applicability with non-composite systems, that is, systems that do not have transverse reinforcement elements formed in, or passing through, the header unit 110. For example, the systems employing secondary structural members of arching shotcrete between header stacks 101, or where the secondary structural members are pre-cast panels. Further, the complementary structural elements 1100 may be used in other ways. If, for example, there existed a need to apply additional restraint to a limited area of the retaining wall, a complementary structural element 1100 could be included in that area, and so used to provide the necessary reaction(s). Also, these complementary structural elements 1100 may be used together with foundation beams, as continuous elements. This would apply, for example, where the base of the wall was being stepped-up. For example, this would apply where the retaining wall being constructed had a U-shaped frontal elevation. The complementary structural element 1100 may also be used to couple various intersecting retaining wall sections. The complementary structural element 1100 may also be used to support other structural members which members are framing into the wall/support structure and which members are employed to resist non-soil-retention loads (for example, as is illustrated in FIGS. 34*c*, 34*d*, and 34*e*).

As part of any structure fabricated in accordance with the present invention, header stacks 101 are always present. These header stacks 101 are preferably formed from pre-cast concrete elements, called headers 110. The headers 110 are preferably vertically stacked, or preferably stacked in a vertical plane. Altematively, the headers 110 may be rotated such that they are aligned in a horizontal plane. The secondary structural members 130 and the complementary structural elements 1100 may be formed from different materials. Further, the secondary structural members 130 may be positioned either at the front of the structure or at the rear of the structure or at both the front and the rear of the structure. The rear of the structure refers to the face of the wall that contacts the soils 34(seen in FIGS. 34*a*, 34*c*, 34*d*, 34*e*, 34*g*, 34p, 34*q*, and 34*r*) being retained by it. The front of the structure refers to the face of the wall that does not contact the soil or other retained load. Note also that the secondary structural members 130 and complementary structural elements 1100 that may be chosen for these walls may interact with the header stacks 101 in various ways. In this respect, there is significant flexibility available to the designer, via the most appropriate selection of a systems group to be installed at a given location.

As used herein, the term "pre-stressing" refers to the process of imparting beneficial stress profiles, to the structure, to the structural member, or structural component, most typically prior to the structure, structural member or component, being subjected to the anticipated, externally applied loads. The process may involve sequenced sets of discrete pre-stressing stages.

As used herein, the term "reinforcement" refers to either "passive reinforcement" or to "active reinforcement". Any particular zone or cross-section within the various structural members that comprise these systems, or any components that comprise such members, may be unreinforced, or possess passive reinforcement, or active reinforcement, or both passive and active reinforcement, depending on the location of the zone or cross-section within the structural system and the structural performance expectations of same.

As used herein, the term "passive reinforcement" refers to reinforcement that is in a neutral state of stress prior to the associated component or member being subjected to applied forces. Where included in reinforced concrete members, a passive reinforcement element is typically referred to as non-pre-stressed reinforcement. The applied forces, that are referred to here, may be induced by body forces, by externally imposed loads acting directly or indirectly on a component or member, or be the result of axial forces that are imposed on a pre-stressed concrete member by pre-stressing forces (typically) prior to the application of external loads. One way to view passive reinforcement is to recognize that it is any reinforcement, included within the member or component, that has not been tensioned specifically to generate a favorable stress regime within the concrete of the structural member or component typically prior to that member or component being subjected to the body forces and external loads that it is intended to sustain.

Figure 34F:
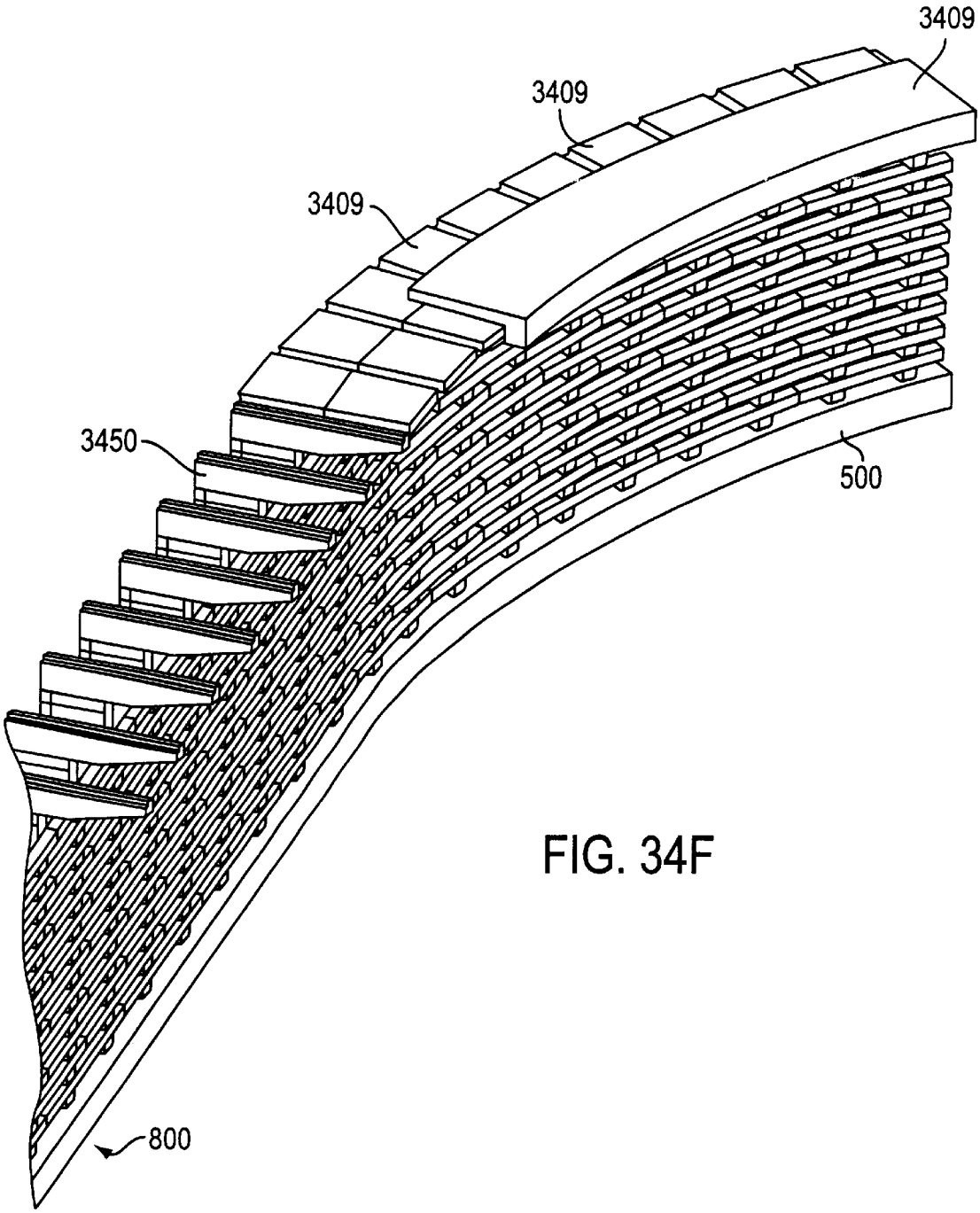
FIG. 34*f* is a perspective view of an exemplary application of the system of the present invention.

As used herein, the term "active reinforcement" refers to reinforcement that has been subjected to positive tensile force(s), thereby inducing therein a state of positive (tensile) stress, typically prior to the associated member or component being subjected to body forces and the anticipated externally applied loads. As used herein, the term "active reinforcement element" refers to any reinforcement element (positioned within the structural component, member, or system and) intended for the structural role of providing and maintaining a pre-stressing force in the structural component or member or in a structural assembly comprised of the same. In accordance with the present invention, this may be done by the jacking of predetermined tensile force(s) into active reinforcement element 115 typically prior to the structural member so stressed being subject to externally applied loads. Active reinforcement element 115 may include, but is not limited to, a wire, a strand, a cable, a rod, or other suitable element specifically designed for the structural role of providing and maintaining a pre-stressing force in the structural component or member or in the assembly composed of same. The active reinforcement element 115 is placed in a state of positive, tensile stress through a process of post-tensioning. Active reinforcement elements may be placed in a state of positive, tensile stress through a process of pre-tensioning. Such pre-tensioned active reinforcement elements may be used in such structural components or members as the stretchers 130, and the appurtenant structural elements such as element 3450 as shown in FIGS. 34*a*, 34*b* and 34*f*, for example.

As used herein, the term "pre-tensioning" refers to the process whereby predetermined tension forces are imparted into the pre-stressing active reinforcement element(s), before the concrete of the component or member is placed in the forming molds about the active reinforcement element (s) and, if included, passive reinforcement elements. After the concrete has gained the necessary strength to withstand the stresses that will be induced at transfer, the pre-stressing forces that were imparted into the active reinforcement elements are released from the pre-tensioning device, and thereby these forces are transferred to, and resisted by, the concrete of the component or member being pre-stressed, and the passive reinforcement elements, if included. The high-strength tendons that may form active reinforcement elements normally take the form of wire, or strand. These tendons possess high performance stress-strain characteristics. In the process of pre-tensioned pre-stressing, where steps are not taken to prevent bond, the active reinforcement elements are typically bonded to the surrounding concrete.

As used herein, "post-tensioning" is the process whereby tension forces are imparted into the active reinforcement elements 115 after the pre-cast concrete components or members have been manufactured and, generally, have been placed in their final position within the structural assembly. The post-tensioning process is also frequently used to pre-stress active reinforcement elements 115 that are used in conjunction with cast-in-place concrete. In either case, where internal pre-stressing tendons are being used, the process requires the provision of suitable ducting to correctly locate the tendons to be stressed. In the case of cast-in-place (CIP) concrete components or members, the internal active reinforcement elements 115 may be placed in the ducts before the concrete is situated or may be fed through the ducts after the concrete has cured sufficiently. In the case where internal active reinforcement elements 115 are being used in conjunction with structural elements or members that are comprised of pre-cast concrete components, for example, pre-cast concrete headers 110, the "duct" is formed by the successively abutting passthrough ducts 116 that comprise a feature of each header unit 110. In the case of external pre-stressing tendons the active reinforcement elements 115 generally do not require such ducting. The exceptions are where such external active reinforcement elements 115 pass through complementary structural elements 1100, such as tieback transfer beam 1100, or capping beams, or where these external active reinforcement elements 115 are anchored within a foundation element 1450, 500 and/or are being locked of at a tieback transfer beam, a capping beam, or other complementary structural element 1100. In marked contrast to the process of pretensioning, and the transfer of pre-stressing force associated with the process of pre-tensioning, the forces that are placed in the active reinforcement elements 115 during the process of post-tensioning are preferably transferred to the structural component, or member, or complementary element, or foundation element, or structural assembly composed of same at reaction and/or lock-off points only. The pre-stressing forces placed in the active reinforcement elements 115 must be sustained by the structural component or member or complementary element, or foundation element, or structural assembly composed of same at two transfer points. The internal active reinforcement elements 115 may be fully bonded to the associated ducts or left unbonded. The bonding of the active reinforcement elements 115 to the ducts, which ducts are already bonded to the surrounding concrete, which was cast in place, where cast-in-place concrete is being used is normally achieved by grouting. Such cast-in-place (CIP) concrete may be found in the foundation elements, the TTBs, and the capping beams. Further, such CIP concrete may also be found in the secondary structural elements that are disposed between the header stacks. Where passthrough ducts 116 are formed in the concrete of the pre-cast components or members, for example, the header units 110, where abutting features 116 of successive header units 110 form the ducts associated with an active reinforcement element 115, via grouting of the active reinforcement elements 115 to the ducts so formed, bonding is achieved directly to the concrete of these pre-cast units.

Referring now to FIGS. 1 through 5, there is illustrated an exemplary embodiment of the system of the present invention. In the embodiment depicted in FIGS. 1–5, system 100 for constructing a pre-stressed modular construction for retaining or supporting an applied load is depicted. It should be understood that the phrase "retaining or supporting an applied load" encompasses one or more of the following: (1) retaining an applied load; (2) supporting an applied load; (3) retaining and supporting the same or different applied load;

and (4) retaining or supporting the same or different applied load. The system 100 comprises header stack 101 comprised of a plurality of header units 110. Header units 110 are preferably formed from pre-cast concrete, but other suitable materials could be used. It should be understood that the present invention is not limited to the use of pre-cast concrete for header units 110. There is an active reinforcement element 115 configured to cooperate with the header stack 101 so that post-tensioning the active reinforcement element 115 imparts a corresponding pre-stressing force into the header stack 101. The pre-stressing force applied to the active reinforcement element 115 is transferred to the header stack 101 at predetermined lock-off points 111. Typically, one end of the active reinforcement element 115 is preferably cast in the foundation 500 (best seen in FIG. 5) beneath the header stack 101. The other end of the active reinforcement element 115, or at least some point distant from the end cast in the foundation 500, is stressed to induce the pre-stressing force. The distant end of the active reinforcement element 115, or at least some point distant from the end cast in the foundation 500, must be locked off to maintain the transfer of force from the active reinforcement element 115 to the header stack 101.

A passive reinforcement element, disposed longitudinally through the header stack 101, may be included within the duct(s) of the header stack 101, which duct(s) is(are) formed by the passthrough ducts 116 of the header units 110. Such passive reinforcement element would, typically, commence within the foundation element 500, and would be bonded to the header stacks via a process of grouting. Such passive reinforcement element, where included, would work with the active reinforcement element 115 in order to assist the header stack 101 to meet a particular structural performance requirement.

Figure 7A:
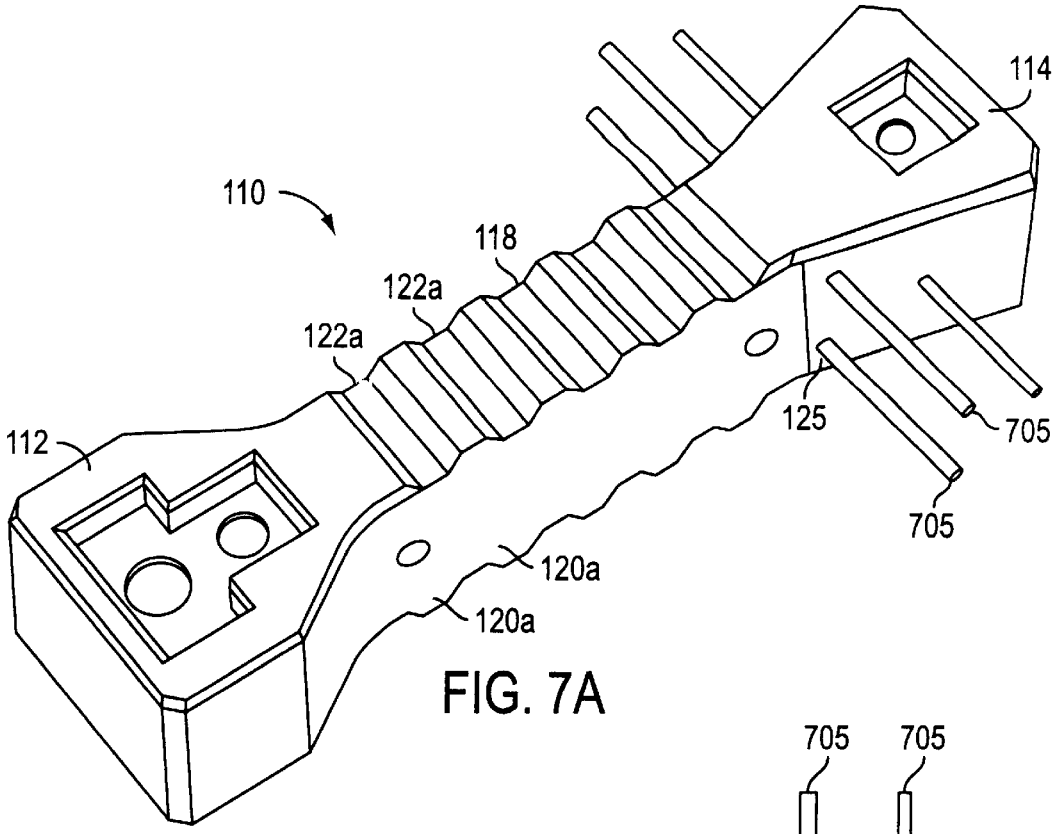
FIG. 7*a* is a perspective view of an alternative exemplary embodiment of a header according to the present invention.
Figure 7B:
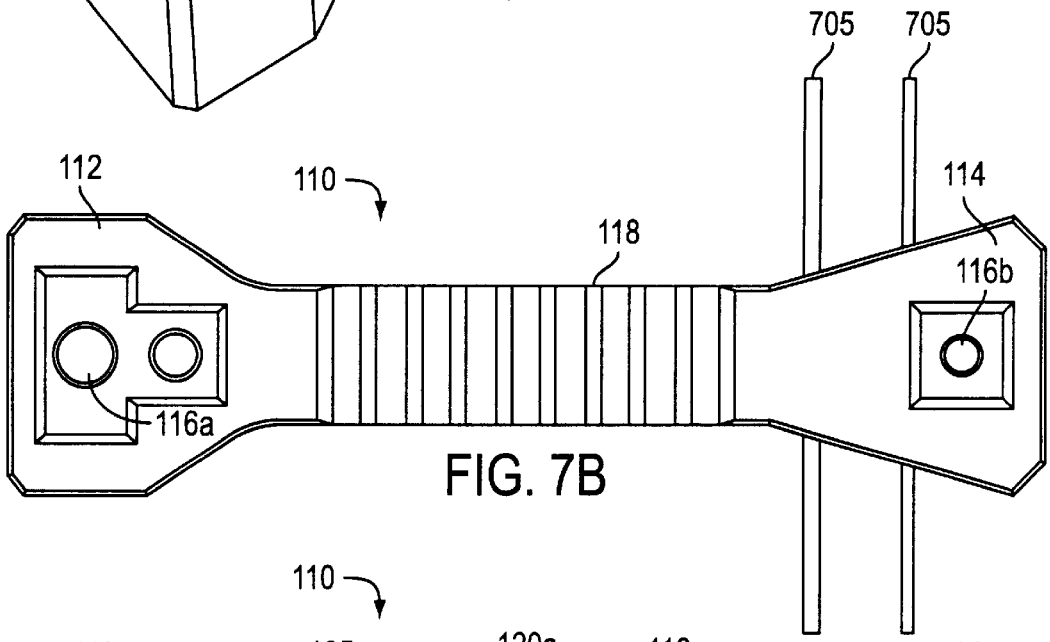
FIG. 7*b* is a top plan view of the exemplary header in FIG. 7*a*.
Figure 7C:
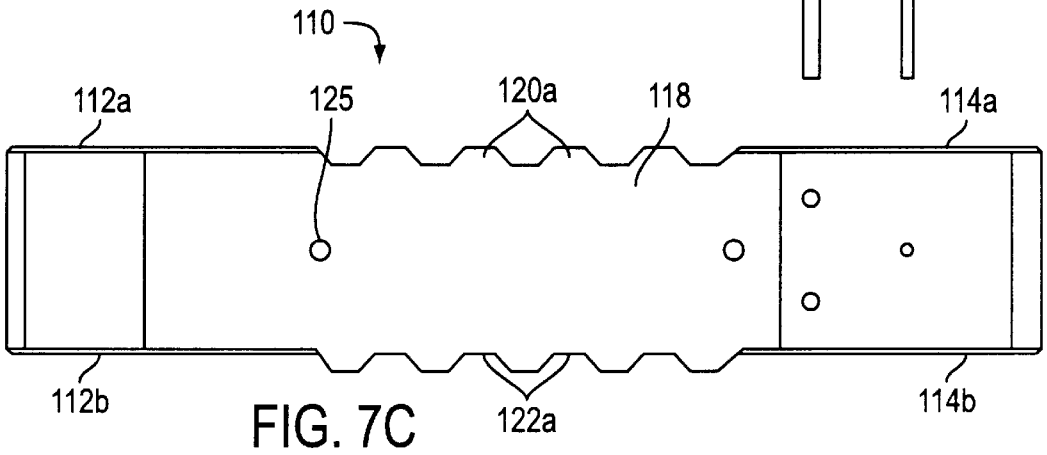
FIG. 7*c* is a side elevation of the exemplary header in FIGS. 7*a* and 7*b*.

The system may also include passive reinforcement elements 705 (see, for example, FIGS. 7*a* and 7*b*) that extend through passthrough ducts 125 in at least one of the header units 110. Passive reinforcement elements may either extend vertically or transversely with respect to header unit 110. The passive reinforcement element 705 may be configured such that it does not carry load distributed in the header stack 101. However, vertical or longitudinal passive reinforcement elements may be configured to account for additional compressive capacity at the critical sections of the header stack 101 and/or to improve performance of the critical sections under overload conditions.

The passive reinforcement elements 705 may also be useful to provide shear-dowel action between pre-cast components and cast-in-place concrete components, or other secondary structural members, in order to withstand shear-type loads that develop at the interface between such components (e.g., soil loads that would first be resisted by cast-in-place secondary structural members 130*c*). The passive reinforcement element 705 preferably extends transversely through a passthrough duct 125 in the header unit.

The passive reinforcement element 705 may also be configured to transfer transverse forces between the header stack 101 and the secondary structural elements adjacent one or both sides of the header stack 101. In such circumstance, the passive reinforcement element 705 may be bonded and/or mechanically connected to the header unit 110, with such connection being established over a predetermined portion of the reinforcement element 705. That is, suitable bond break is established over sufficient distance of the outer portion or portions of such passive reinforcement element 705 which portion or portions of this element 705 are adjacent the "outer" zones of the header unit 110 so intersected in order to prevent deleterious effects to the concrete of the header unit 110 within these "outer" zones common to both of the intersecting elements 110 and 705.

The passive reinforcement elements 705 may be placed within pre-cast header unit 110 during casting, as may be the case if the transverse (perpendicular to direction of active reinforcement elements and perpendicular to the front-to-back axis of the header unit) passive reinforcement element was expected to carry compressive forces into and/or through the header unit 110. Alternatively, the passive reinforcement elements 705 may be fed through the transverse ducts 125 after the associated header unit(s) 110 have been placed in their final positions. The ducts 125 that would be included in the header unit 110 in the latter case allow for several behavioral characteristics. First, from the standpoint of structural performance enhancement of the structural member, or panel,.130*b* (see FIG. 12), between the header stacks 101, where transverse ducts 125 are located in the header units 110 to align with the rear reinforcement of the panel 130*b*, the passive reinforcement elements 705 enable the development of moments at the ends of the panels 130*b*. Second, where these passive reinforcement elements 705 are required to sustain tension forces, the presence of the ducts 125 prevents the tensile strains generated within the passive reinforcement elements 705 from attempting to transfer load, via bonding, to the header unit 110 through which it is passing. Third, the structural interdependence, via force continuity through the header stacks 101, that the presence of the transverse passive reinforcement elements 705 provide, ensures a greater lateral stability of the system.

Figure 8:
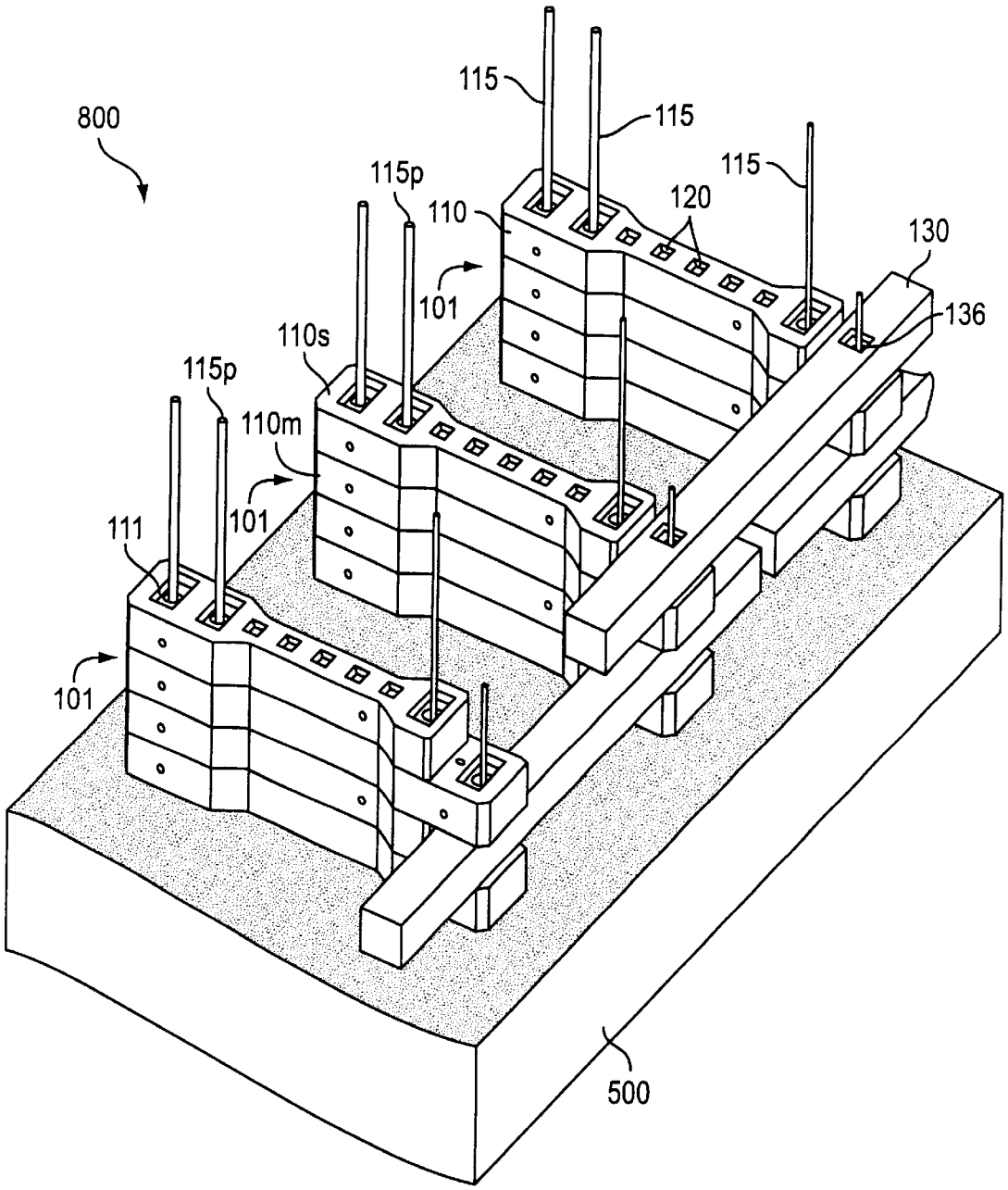
FIG. 8 is a perspective view of one embodiment of a modular construction according to the present invention.
Figure 9:
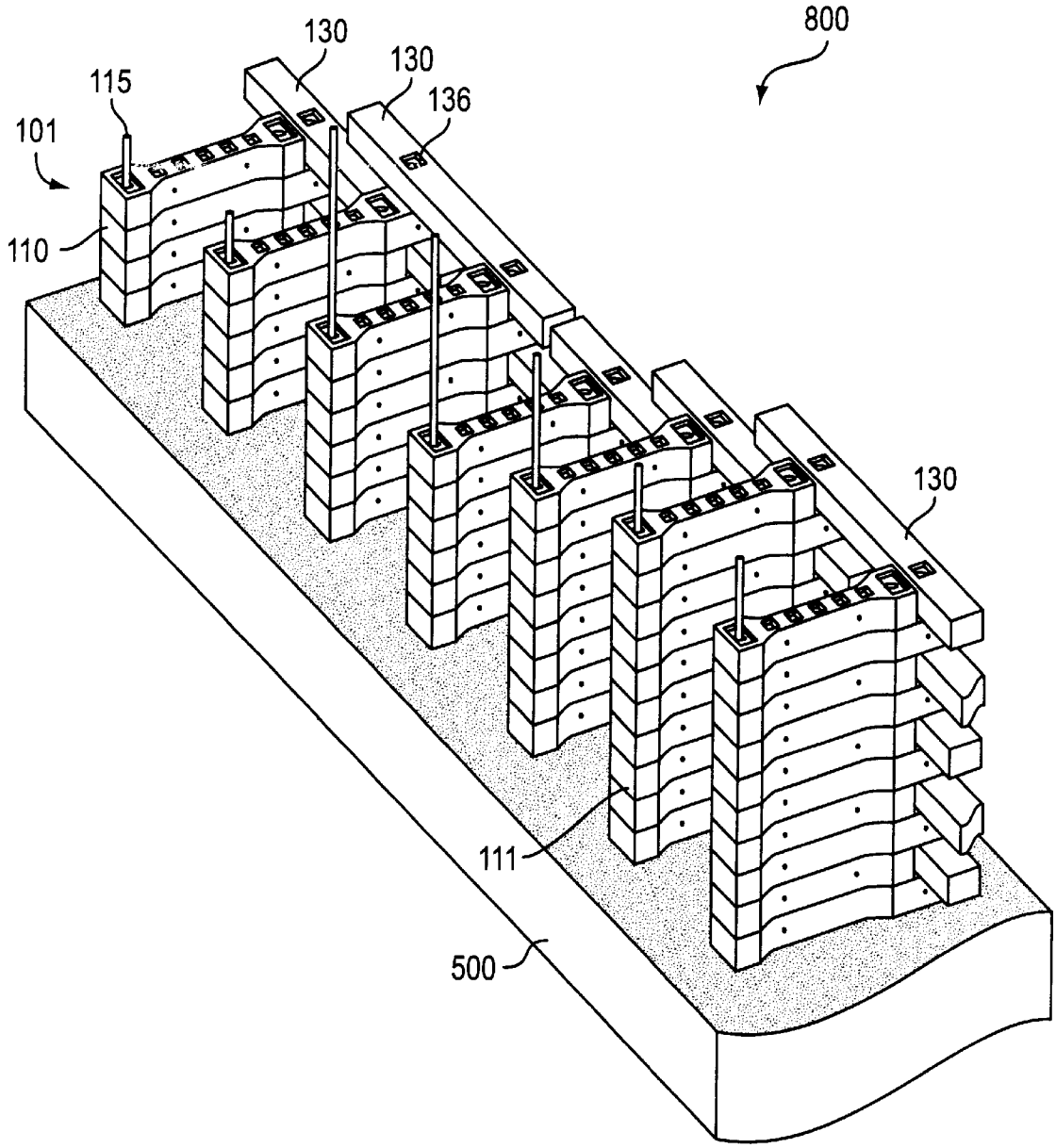
FIG. 9 is a perspective view of an alternative embodiment of a modular construction according to the present invention.
Figure 10:
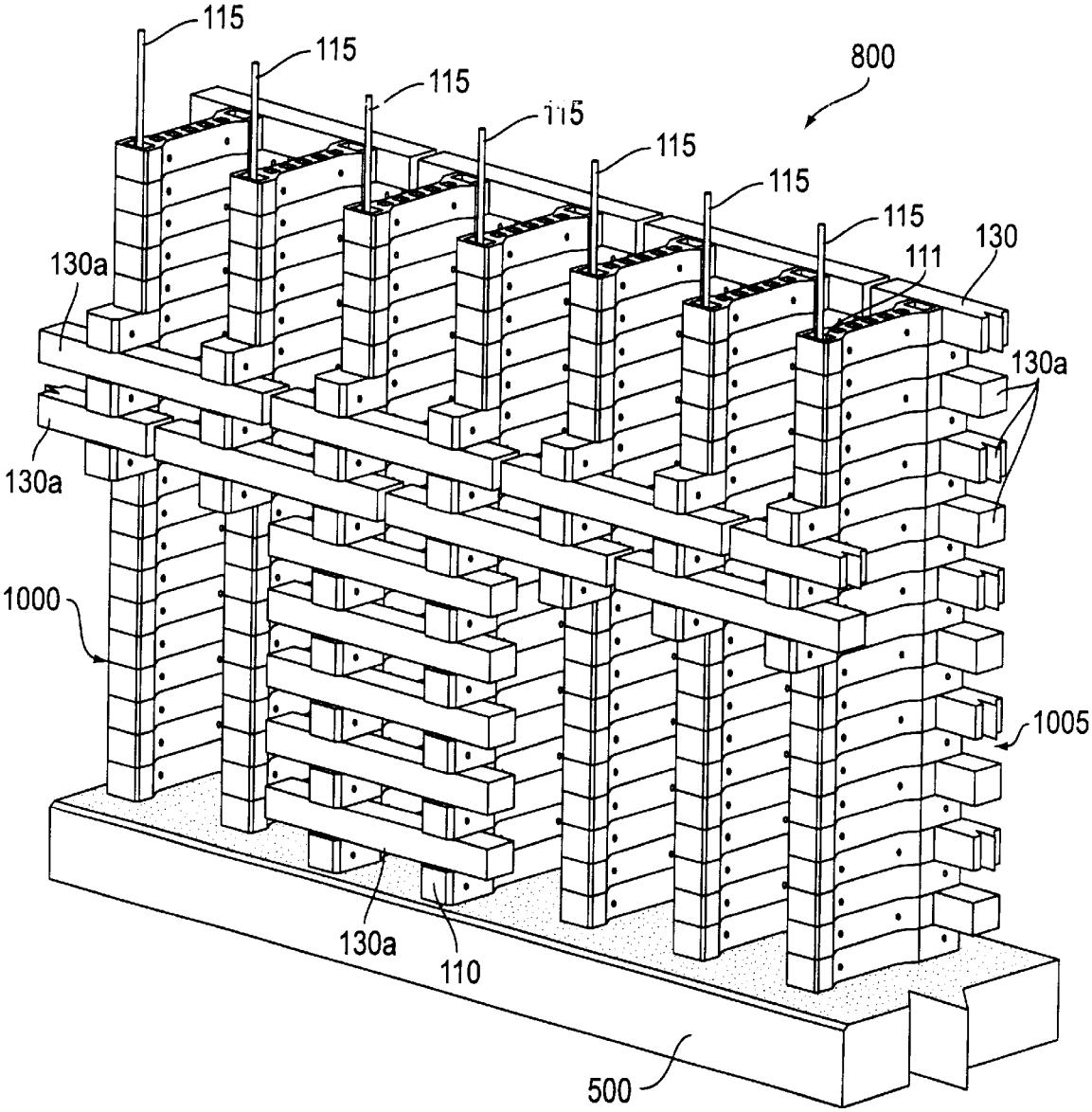
FIG. 10 is a perspective view of an alternative embodiment of a modular construction according to the present invention.

The concrete components that comprise the header stacks 101 may be either relatively large in size or quite small, and possess relatively high load resistance capacity. The system designer is provided with considerable design flexibility in that header stacks 101 may be chosen from one or more of the range of header units available and which header stacks so formed may be spaced at different spacings to suit different load resisting requirements on the retaining wall via the use of different structural member lengths. Also design flexibility is available via the use of different arrangements of the components within this group. Various arrangements are shown in FIGS. 8–10, and will be described in more detail below. Design flexibility is further enhanced via the use of complementary structural elements 1100 such as the tieback transfer beams, as discussed below.

The desired or preferred pre-stressing force magnitude(s), pre-stressing force location(s) and variation(s) associated with each header stack, as required by the designer, may be accommodated by using different types of pre-stressing tendon, different total areas of pre-stressing tendon, as the active reinforcement elements 115, and by varying the amount of pre-stressing force imparted into these active reinforcement elements 115 together with varying the location(s) of the resultant force(s).

In one embodiment of the invention, the header units 110 that make up the header stack 101 are shaped in a substantially "dog-bone" configuration as shown, for example, in FIGS. 3 and 6*a*–6*e*. Such header units 110 comprise a center element 118 having a top face 118*a*, and a bottom face 118*b*; a first end element 112 disposed at one end of the center element 118; and a second end element 114 disposed at another end of the center element 118. The first end element 112 and second end element 114 are preferably integrally formed with the center element 118. The first end element 112 and the second end element 114 each have a top face 112*a*, 114*a* and bottom face 112*b*, 114*b* respectively that are coplanar with the top face 118*a* and bottom face 118*b* of the center element 118. Exemplary embodiments of these headers 110 are best seen in FIGS. 6*a*–6*e*, and 7*a*–7*c*, and 21*a*–21*d*.

Figure 6A:
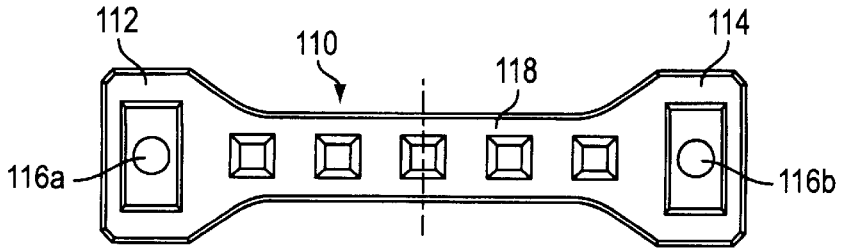
FIG. 6*a* is a plan view of an exemplary embodiment of a header according to the present invention.
Figure 6B:
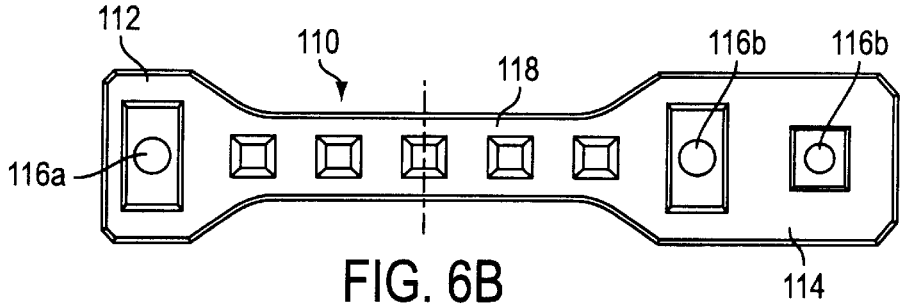
FIG. 6*b* is a plan view of an alternative exemplary embodiment of a header according to the present invention.
Figure 6C:
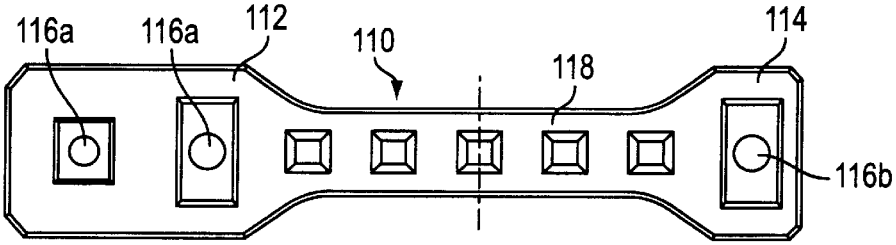
FIG. 6*c* is a plan view of an alternative exemplary embodiment of a header according to the present invention.
Figure 6D:
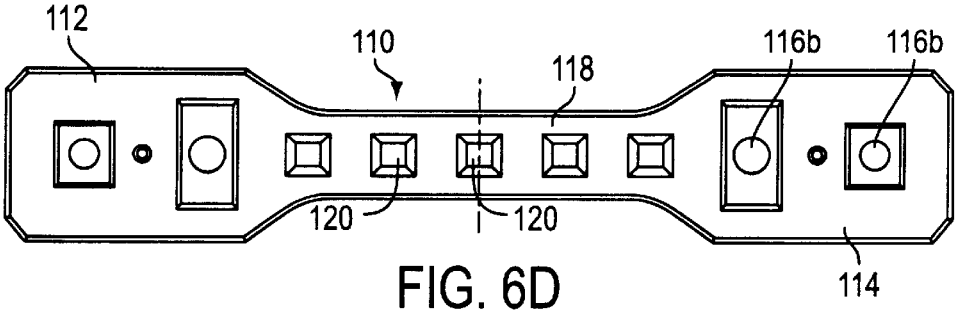
FIG. 6*d* is a plan view of an alternative exemplary embodiment of a header according to the present invention.
Figure 6E:
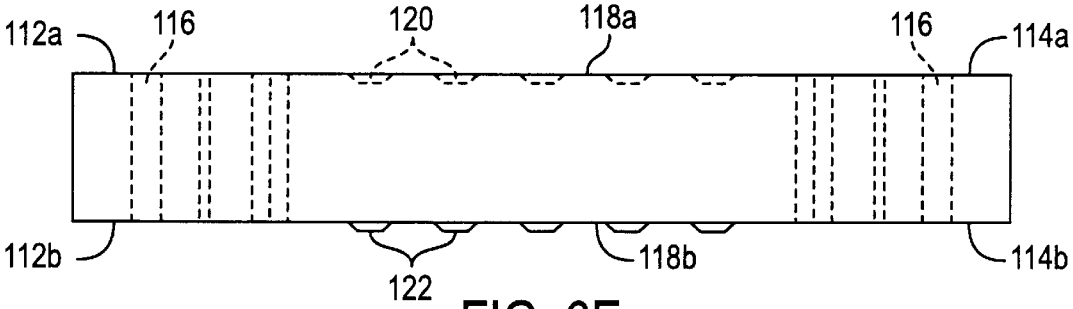
FIG. 6*e* is a side view of an exemplary embodiment of a header according to the present invention.

The header units 110 can be either symmetrical or asymmetrical about the center element 118. In other words, the header units 110 may be symmetrical or asymmetrical about a line perpendicular to an axis of the header unit 110. FIGS. 6*a* and 6*d* illustrate two embodiments of a symmetrical header unit 110 that is symmetrical about one dashed line perpendicular to the longitudinal axis of the header units of FIGS. 6*a*–6*e*. FIGS. 6*b* and 6*c* show two embodiments of an asymmetrical header unit 110 that are asymmetrical about the dashed line.

It is possible for the header units 100 to be asymmetrical about a plane extending along the length of the header unit 100. For example, the header unit 100 could have one flat side. Such a header unit 100 could be used at the end of a retaining wall as a "finishing" header unit. Additionally, two such header units could be positioned with their flat sides abutting where a complete break in the wall is desired.

The header units 110 can be further classified as either main header units 110*m* or sub-header units 110*s*. The main header units 110*m* are double-headed (i.e., have both a first end element 112 and a second end element 114), or single-headed (i.e., have only a first end element 112). The sub-header units 110*s* also are either double-headed or single-headed. In any given header stack 101, either one of the main header units 110*m* or sub-header units 110*s* may be symmetrical or asymmetrical. The principal distinction between the main header units 110*m* and the sub-header units 110*s* is that the main header units 110*m* typically extend past the sub-header units 110*s* in a header stack 101. However, it is also possible for the sub-header units 110*s* to be identical to the main header units 110*m*. For example, FIG. 1 depicts a header stack 101 having two sections, an upper section 101*a* and a lower section 101*b*. The upper most sub-header unit 110*s* in the lower section 101*b* is geometrically identical to the lower most main header unit 110*m* in the upper section 101*a*. The system 110 can be comprised entirely of main header units 110*m* or may be both main header units 110*m* and sub-header units 110*s*.

It is preferred that the faces of at least one of the first 112 and second 114 end elements have a curved portion 2101. Such a curvature (best seen in FIGS. 21*a*–23) allows for an optimized bearing line of the structural member 130 onto one of the header units 110. In that manner, any slight rotational deviation of the header stack 101 about its longitudinal axis, from the most desired position, will not compromise the integrity of the header units 110. Furthermore, the structural member 130, or stretcher will not be subjected to loading distributions significantly different from those intended in the design considerations.

In order to maintain an interlocking relationship between the header units 110, there are shear keys provided on the header units 110. The shear keys comprise a plurality of indentations 120 on one of the top 118*a* and bottom 118*b* faces of the center element 118 and a plurality of protrusions 122 on the other of the top 118*a* and bottom 118*b* faces of the center element 118 corresponding to the plurality of indentations 120. The protrusions 122 on each sub-header unit 110*s* and main header unit 110*m* are configured to engage the corresponding indentations 120 in an adjacent header unit 110. The indentations 120 and protrusions 122 may also be provided on the first end element 112 and/or second end element 114. The indentations 120 and protrusions 122 may also be provided on part of the first end element 112 and/or part of the second end element 114. Where such indentations 120 and protrusions 122 are provided on the first end element 112 and/or second end element 114, or on parts thereof, these indentations 120 and protrusions 122 are preferably continuous and geometrically consistent with such associated features that are provided on the center element 118. Preferably, as shown, for example, in FIGS. 7*a*–7*c* and 21*a*–21*d*, the shear keys comprise first corrugations 120*a* on one of the top 118*a* and bottom 118*b* faces of the center element 118, and second corrugations 122*a* on the other of the top 118*a* and bottom 118*b* faces of the center element 118 corresponding to the first corrugations 120*a*. The second corrugations 122*a* on each sub-header unit 110*s* and main header unit 110*m* are configured to nest with the corresponding first corrugations 120*a* in an adjacent header unit 110. The first and second corrugations 120*a*, 122*a* may also be provided on the first end element 112, or part thereof, and/or second end element 114, or part thereof. Where such first and second corrugations 120*a*, 122*a* are provided on the first end element 112, or portion thereof, and/or second end element 114, or portion thereof, these corrugations 120*a*, 122*a* are preferably continuous and geometrically consistent with such associated features that are provided on the center element 118.

There are a plurality of passthrough ducts 116 provided in the header units 110 that are configured to receive the active reinforcement elements 115 and/or passive reinforcement elements 115*p*, where such passive reinforcement elements 115*p* are present in the header stack and have longitudinal orientation with the header stack 101. The passthrough ducts 116 can be any size or shape, but are preferably cylindrical in configuration, having axes parallel to the longitudinal axis of the header unit 110. The first end element 112 defines a first passthrough duct 116*a* and the second end element 114 defines a second passthrough duct 116*b*. The center element 118 may or may not be provided with one or more passthrough ducts 116 to receive active reinforcement elements 115 or passive reinforcement elements 115*p*. There are also a plurality of passthrough ducts 125 that extend transversely through the header units 110 to receive passive reinforcement elements 705. Each of the passthrough ducts 125 are preferably lined with a conduit that prevents the passive reinforcement element 705 from bonding with each individual header unit 110, and allows for the ready installation of the element 705 through the header unit 110 after the header unit 110 has been placed into its final position within the header stack 101. Other structural associations between the transverse passive reinforcement element 705 and the header unit 110 are discussed above.

The header units 110 can be constructed to suit any particular need. They can be designed to accommodate changes in the features such as geometry detail, size, number and location of passthrough ducts 116, 125; type, size, shape, and location of the shear keys on the top and bottom surfaces; etc.

Figure 2:
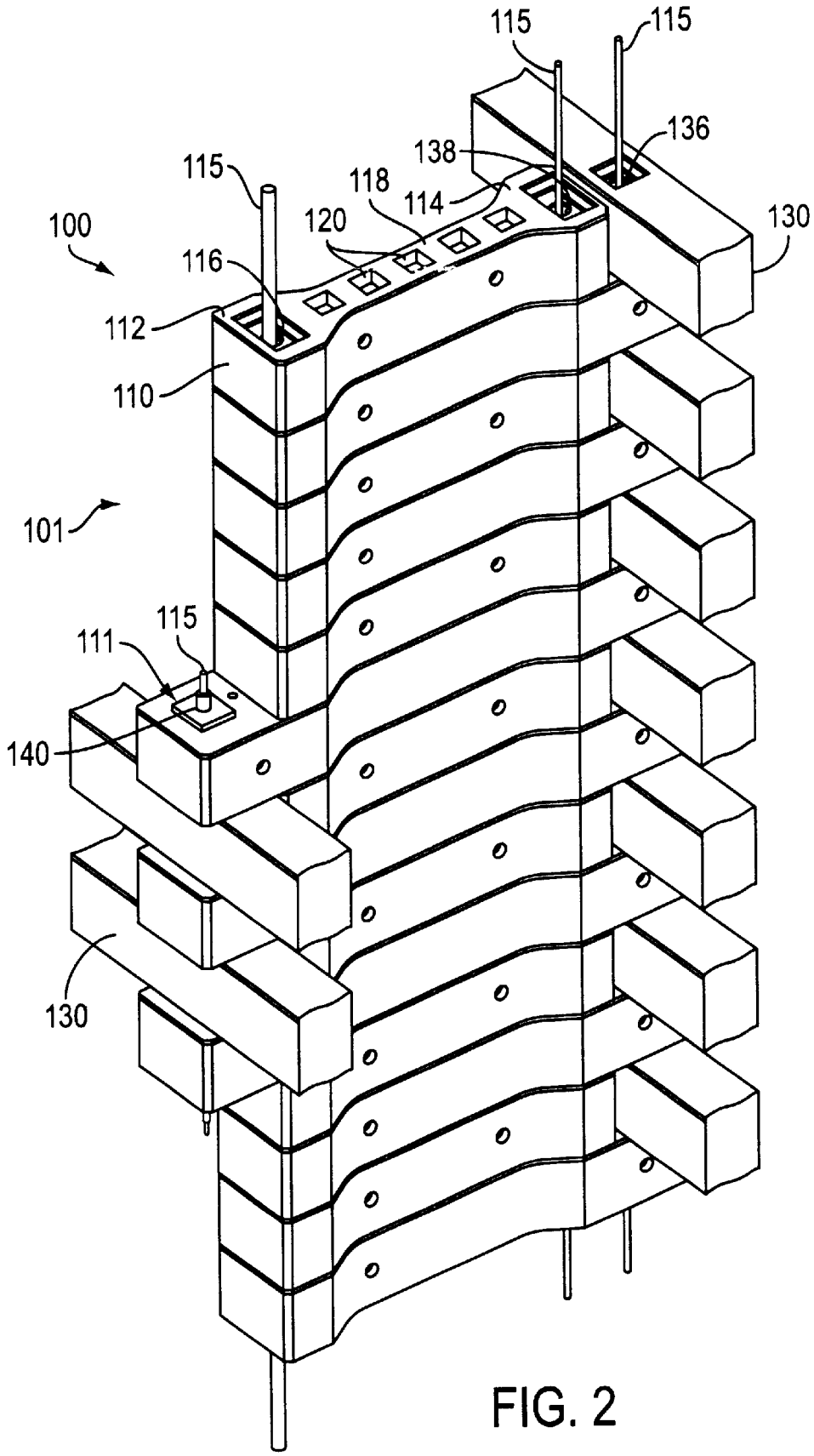
FIG. 2 is a perspective view of an alternative exemplary embodiment of the system according to the present invention.
Figure 3:
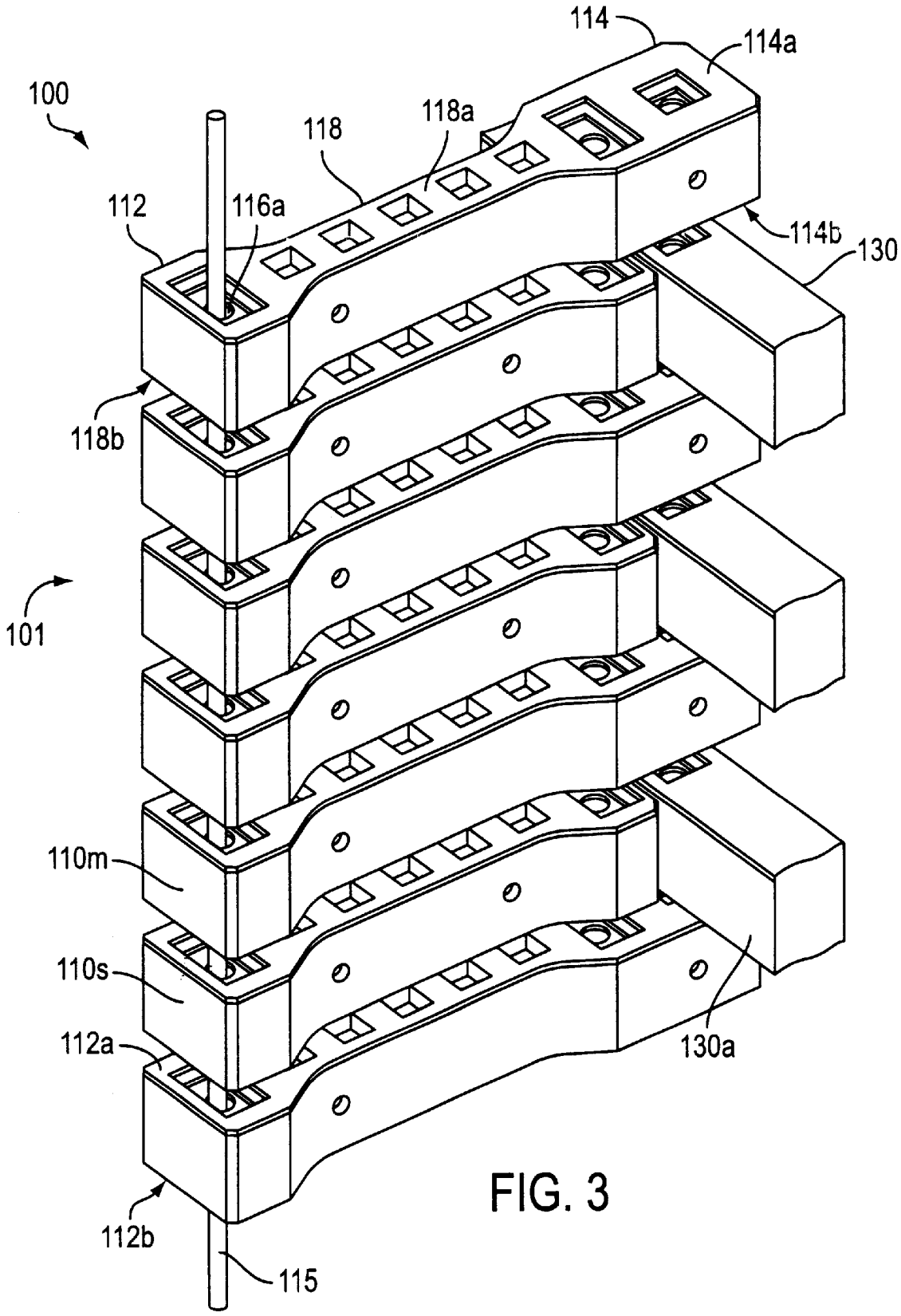
FIG. 3 is an exploded perspective view of an alternative embodiment of the system according to the present invention.
Figure 4:
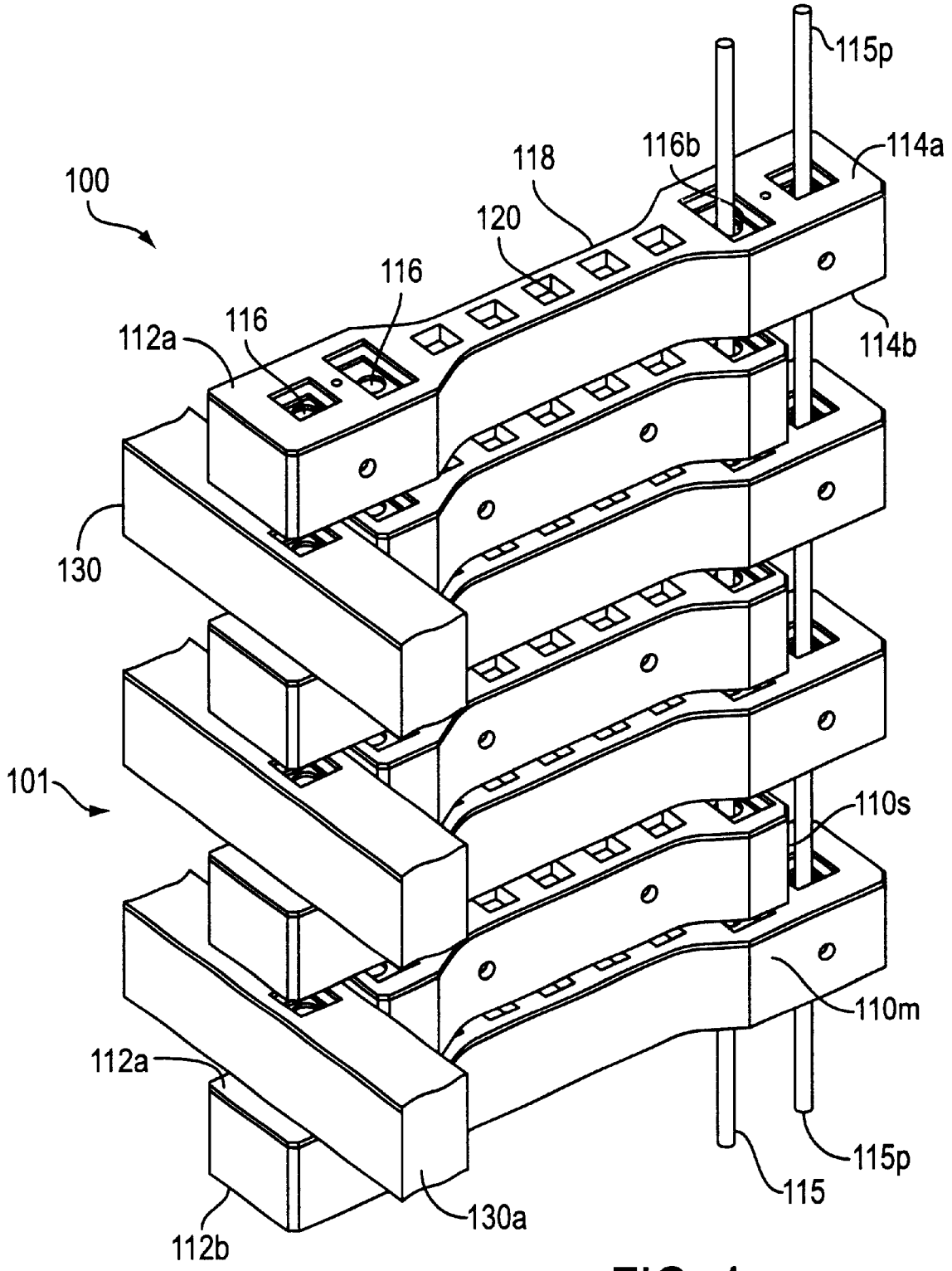
FIG. 4 is an exploded perspective view of and alternative embodiment of the system according to the present invention.
Figure 5:
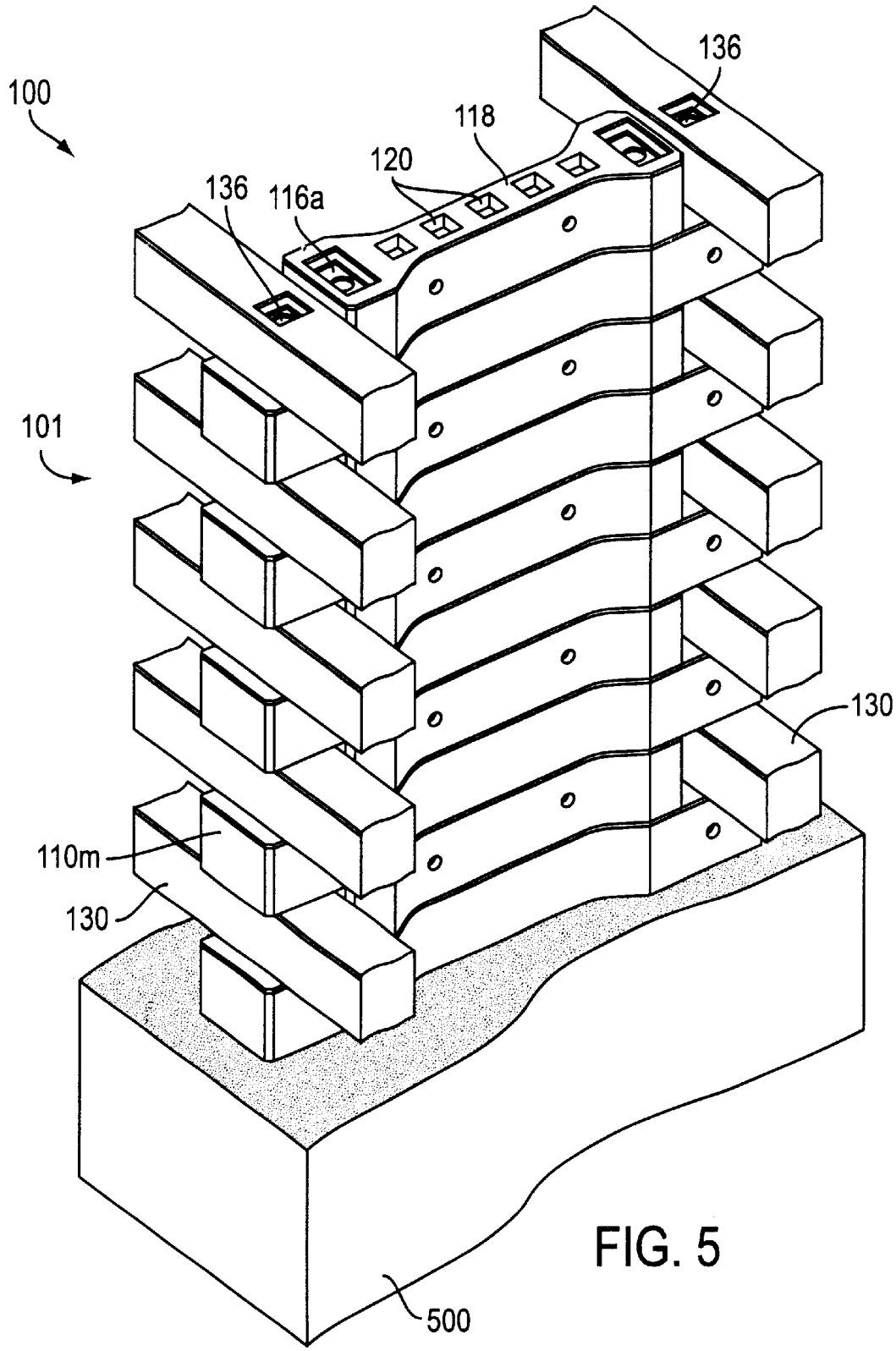
FIG. 5 is a perspective view of an alternative exemplary embodiment of the system according to the present invention.

In one embodiment of the present invention, the active reinforcement elements 115 are internally threaded in the header units 110 through the passthrough ducts 116. The active reinforcement elements 115 are able to be locked off at lock-off points 111 in lock-off recessions 138 in the header units 110. Various lock-off elements 140 are provided to secure the active reinforcement element 115 after a pre-stressing force has been applied. The lock-off point is the point at which the post-tensioning force is imparted to the header stack 101. There are internal lock-off elements 140 to secure the active reinforcement elements 115 within the lock-off recessions. While the lock-off elements 140 are depicted in FIGS. 1 and 2 as being planar with the top surface of the header units 110 (i.e., within a lock-off recession 138 in the top surface of the header unit 110), it would also be possible to provide a lock-off recession in the bottom of the header unit 110 and the lock-off element(s) 140 would then extend into the header unit 110 above. For any lock-off point that is located within the header stack and between such complementary structural elements such as the foundation element, a tieback transfer beam 1100, or capping beam, there is another geometric arrangement wherein the lock-off recess necessary for the lock-off point, in order to accommodate lock-off elements 140, may be accommodated by a lock-off recession in the top surface of the header unit 110 associated with and "below" the lock-off point and a complementary and associated lock-off recession in the bottom surface of the header unit 110 associated with and "above" this same lock-off point.

Figure 16:
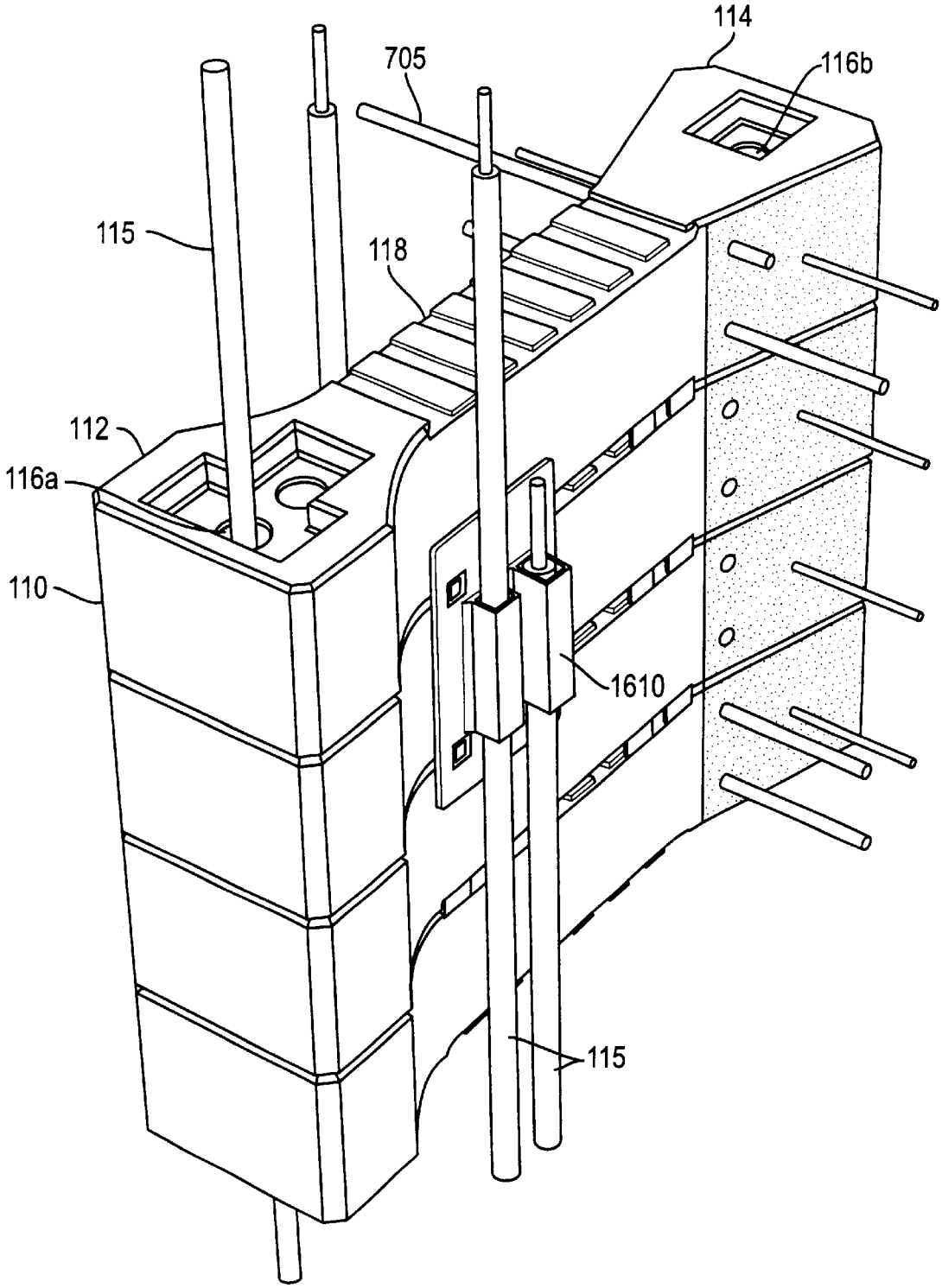
FIG. 16 is a perspective view of an alternative exemplary embodiment of the system according to the present invention including exemplary active and passive reinforcement elements.
Figure 17:
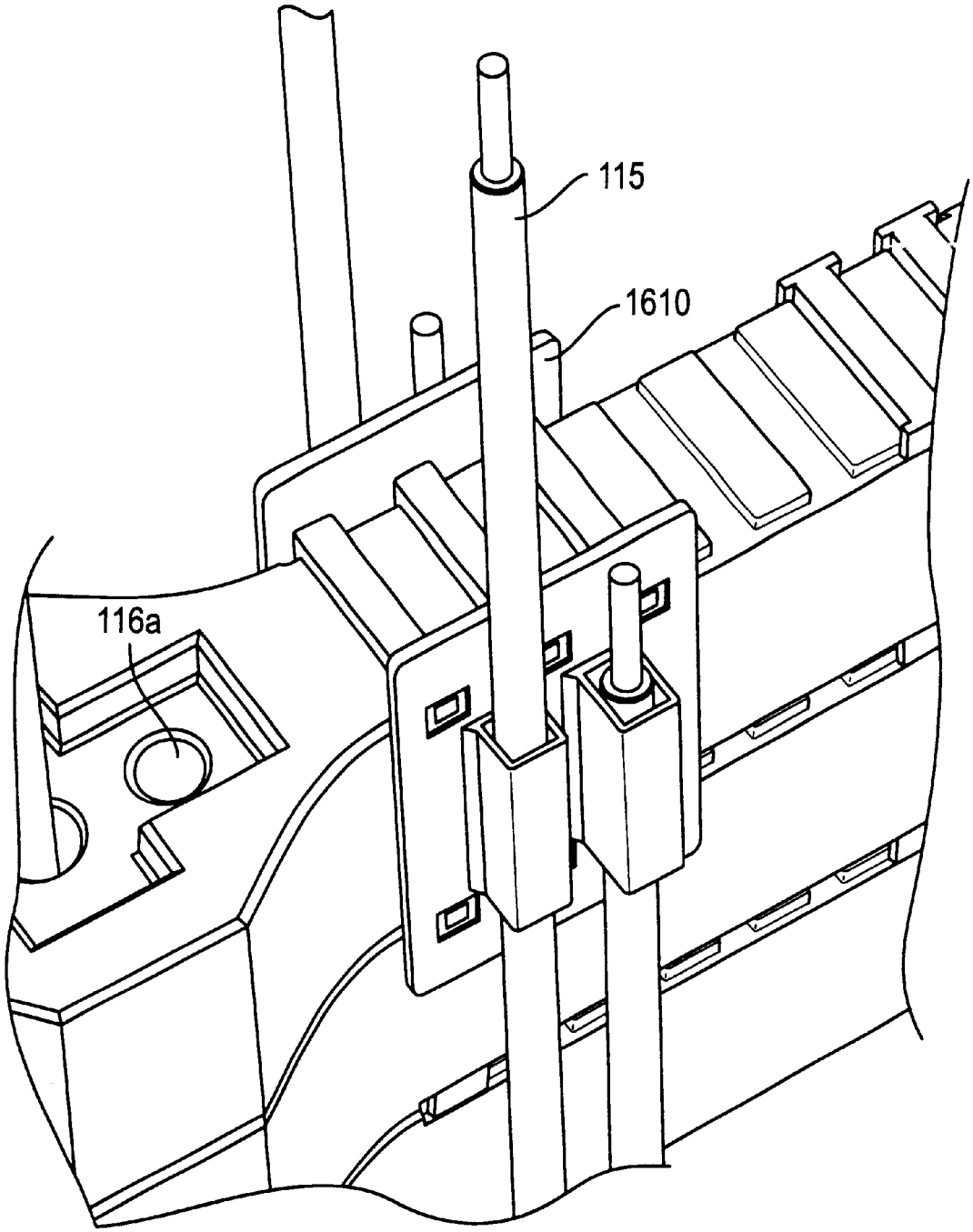
FIG. 17 is a detailed perspective view of a lock-off element according to the present invention.
Figure 18:
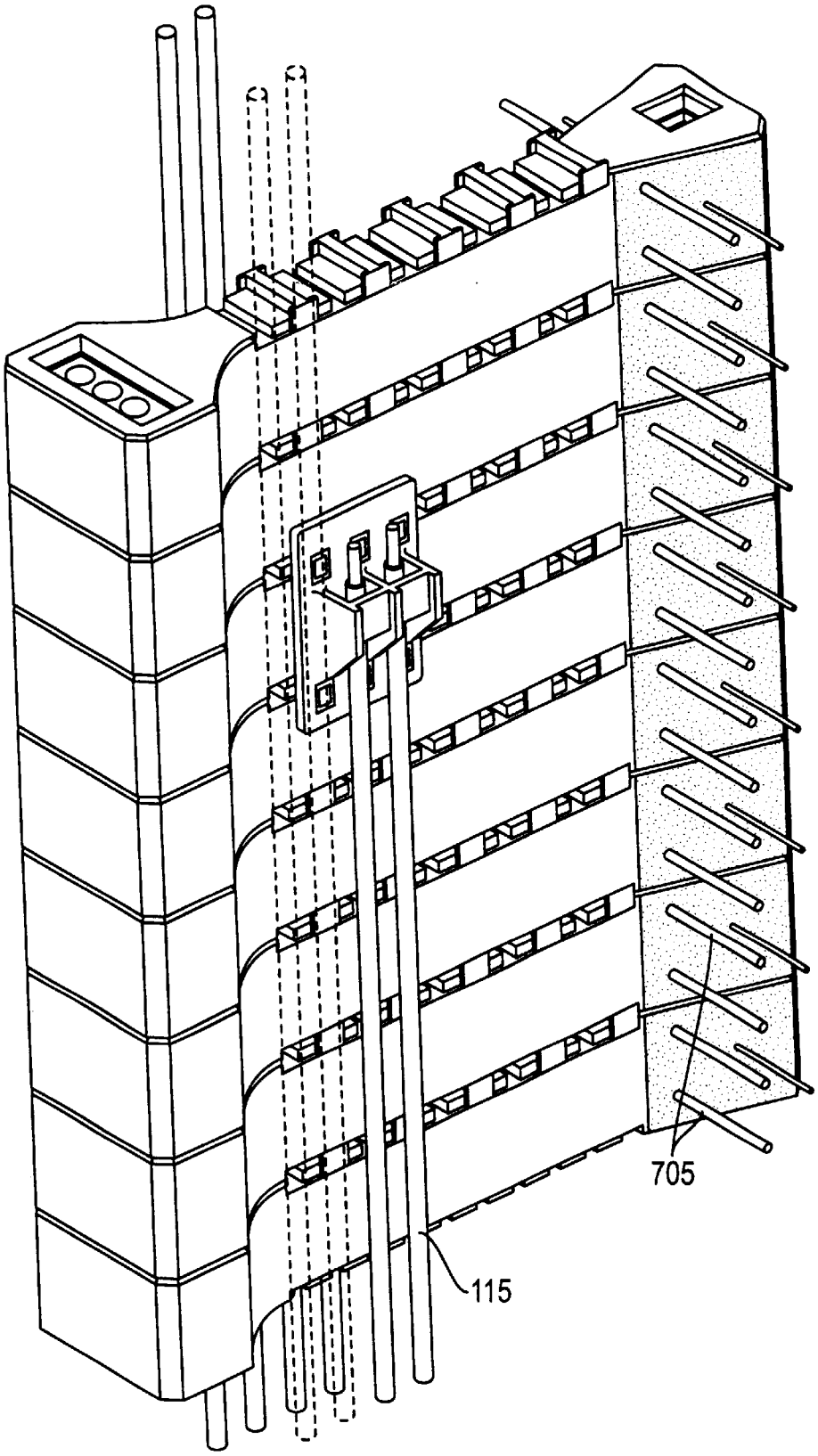
FIG. 18 is a perspective view of an alternative exemplary embodiment of the system according to the present invention including explanatory active and passive reinforcement elements.
Figure 19:
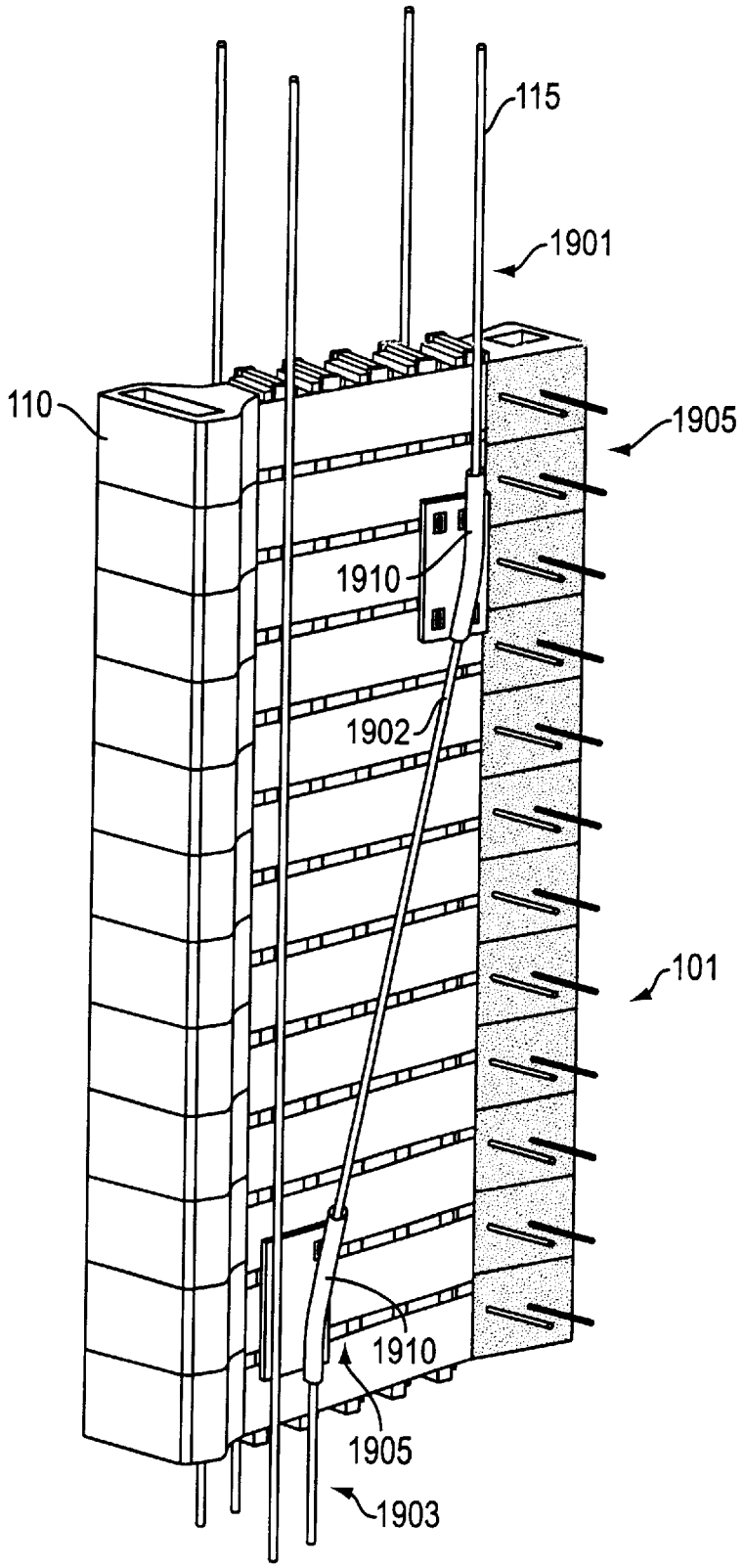
FIG. 19 is a perspective view of an alternative exemplary embodiment of the system according to the present invention including exemplary active and passive reinforcement elements and harping elements.
Figure 20:
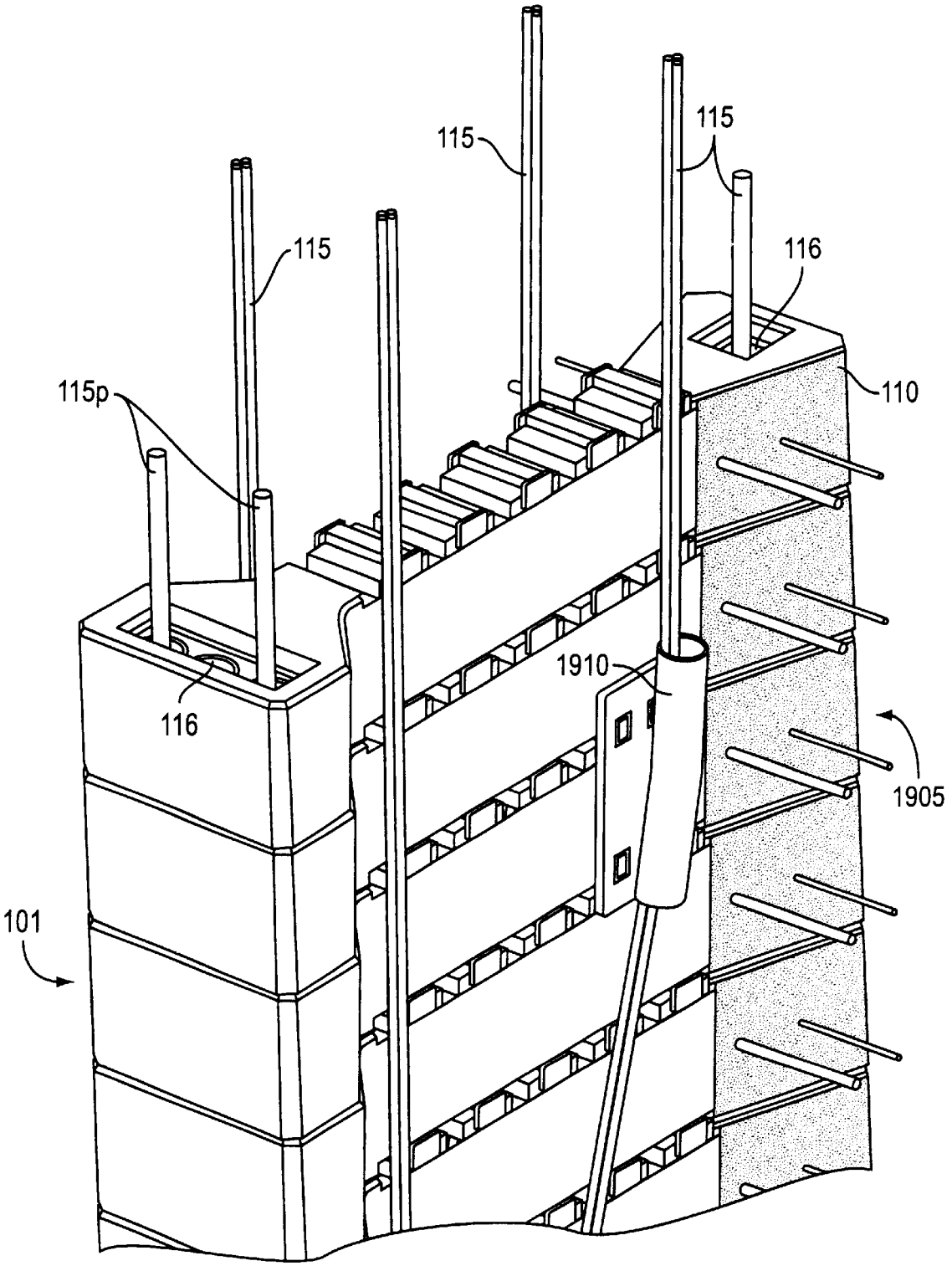
FIG. 20 is a detailed view of an exemplary harping element of FIG. 19.
Figure 21A:
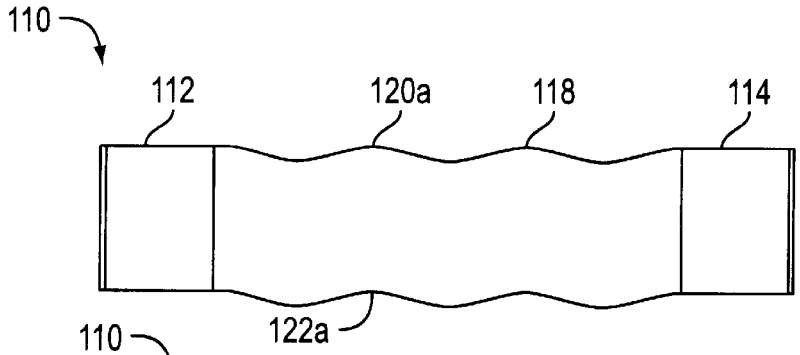
FIG. 21*a* is a side elevation of an exemplary embodiment of a header according to the present invention.
Figure 21B:
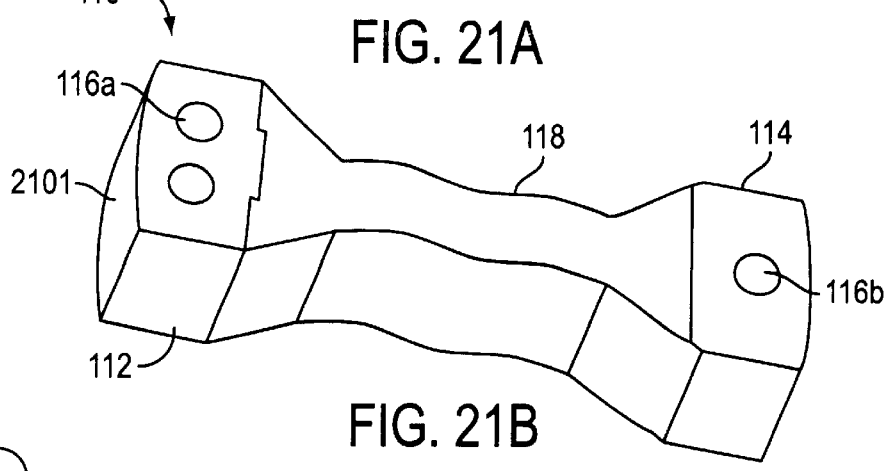
FIG. 21*b* is a perspective view of the header in FIG. 21*a*.
Figure 21C:
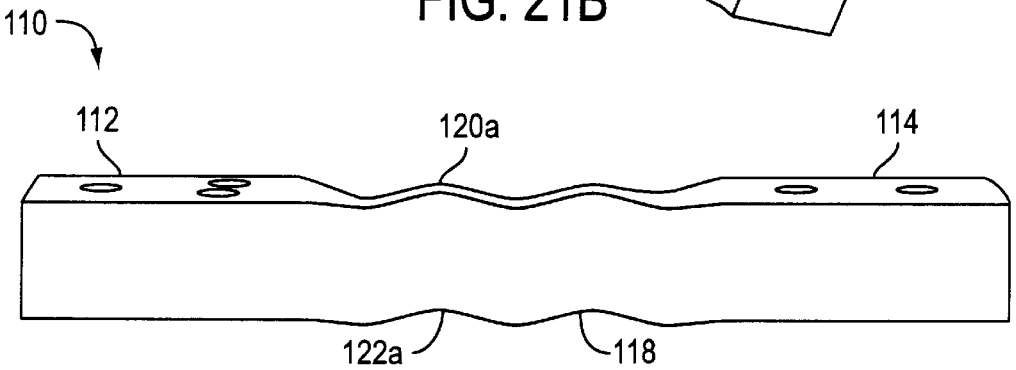
FIG. 21*c* is a side elevation of an alternative exemplary embodiment of a header according to the present invention.
Figure 21D:
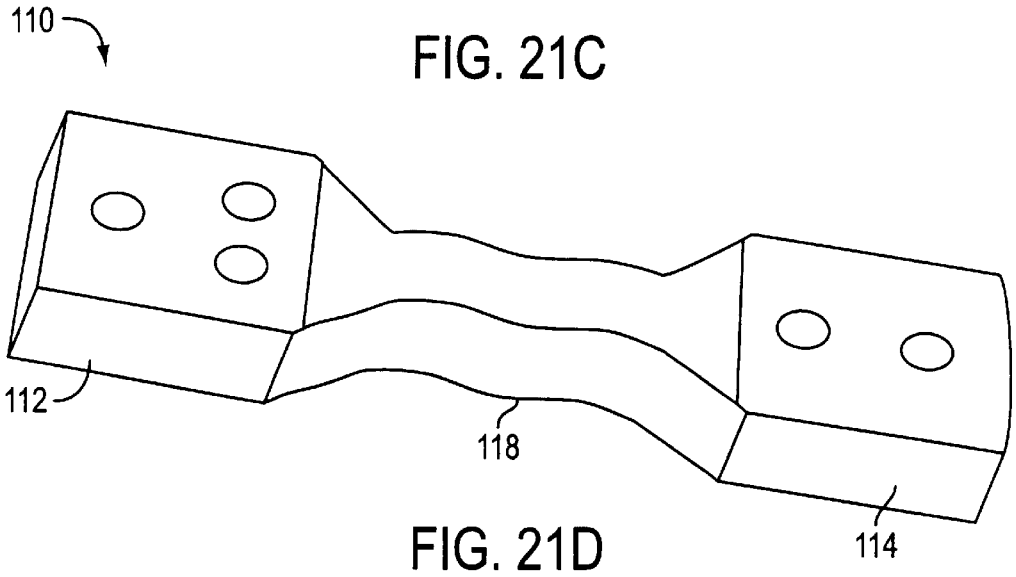
FIG. 21*d* is a perspective view of the header in FIG. 21*c*.

In an alternative embodiment of the invention, the active reinforcement elements 115 may be disposed external to the header stack 101. In such a configuration, there are lock-off elements 1610 (best seen in FIGS. 16–18) configured to secure the active reinforcement element 115. As seen in FIGS. 19 and 20, the active reinforcement elements 115 may be directed through a harping element 1910 at a harping point 1905. The harping element 1910 is configured to redirect the active reinforcement element 115 such that the active reinforcement element 115 forms a series of substantially straight segments 1901, 1902, 1903. The active reinforcement element 115, when directed through a harping element 1910 is still preferably locked off using a lock-off element 1610 (best seen in FIGS. 16 and 17). The active reinforcement element 115, when directed through a harping element 1910 may additionally and/or alternatively be locked off at such structural elements as a tieback transfer beam 1100, capping beam, or other complementary structural element. In the configuration depicted in FIG. 19, the lock-off element 1610 would be positioned at a point distant from the harping element located at harping point 1905, or the active reinforcement element 115 may be locked off at such other structural element as a capping beam or tieback transfer beam element where such are part of the structural configuration. The harping element is preferably not a lock-off element. The harping element 1910 simply serves to redirect the compressive forces induced by active reinforcement element 115 and is not configured as a lock-off point. The harping element 1910 simply redirects the direction of the force being imparted by the active reinforcement element 115 to the header stack 101.

The header stacks 101 may include a plurality of active reinforcement elements 115. The active reinforcement elements 115 may be both internal (i.e., directed through the passthrough ducts 116 in the header units, and, thus, the ducts that are formed via the successive abutting of these passthrough ducts 116 of such header units) and external (i.e., directed through lock-off elements 1610 and harping elements 1910 external to the header stacks 101). Such external active reinforcement elements 115 may also be situated between the header stacks 101 and configured to cooperate with the header stacks 101 via their interaction with such structural elements as a foundation element, tieback transfer beam, capping beam, or other complementary structural element. Also, in conjunction with such external active reinforcement elements 115 transfer and/or lock-off points may be located on and/or in such complementary structural elements. The header stacks 101 may alternatively have only internal active reinforcement elements 115 or only external active reinforcement elements 115. Further, these structural systems may, in conjunction with such internal and/or external active reinforcement elements 115, also include passive reinforcement elements **115*p*, which elements 115*p* would pass through passthrough ducts 116 and be bonded to the duct formed in the header stack 101**.

Most header stacks 101 possess a plane of symmetry, which is the vertical plane containing the longitudinal axis of the header stack 101. Where such plane of symmetry of the header stack 101 exists, it is preferable that the pre-stressing tendons such as active reinforcement 115 be placed in a symmetrical fashion about this plane of symmetry and that the active reinforcement elements 115 be stressed such that the resultant force lies essentially within this same plane of symmetry. Such stressing regime is peculiar to each header stack 101, and may be the same as, or different from, that stressing regime that is associated with the header stack adjacent.

Coupled between each header stack 101 are structural members 130 that may resist soil loading directly. The loads sustained by such secondary structural members 130 are transferred to the header stacks 101. The header stacks 101 transfer the accumulated loads to the foundations 500, and to any other elements that are designed to restrain these header stacks 101 such as complementary structural elements 1100 (explained in more detail below). The structural members 130 may take many forms. The preferred structural member 130 for use with the present embodiment is a stretcher **130*a* and is depicted in FIGS. 1–5, 8–11, and 22–26*b*. Stretcher 130*a* is preferably made from pre-cast concrete. There is a secondary passthrough duct 136 in the structural member 130 that is configured to receive the active reinforcement element 115. There may be a plurality of secondary passthrough ducts 136 in the stretchers 130*a*, but at least one of the secondary passthrough ducts in the stretcher 130*a* must be in registry with at least one of the passthrough ducts 116 in the main header units 110*m*. The secondary passthrough duct 136 in the structural member 130 may be configured to receive a passive reinforcement element 115*p***.

The structural member 130, such as a stretcher **130*a*, can be coupled between two main header units 110*m* such that it abuts the sub-header unit 110*s* between the two main header units 110*m*. The stretcher 130*a* can be positioned between one of the first end element 112 and second end element 114 of the main header units 110*m*. Alternatively, stretchers 130*a* can be positioned between each of the first end elements 112 and second end elements 114 of the main header units 110*m*. In other words, there can be structural members 130, or stretchers 130*a*, on both sides of the header stack 101 or on only one side of the header stack 101. However, the stretcher 130*a* arrangement need not be identical on both sides of the header stacks 101. For example, in FIG. 10, there are stretchers 130*a* coupled to only a portion of one side 1000 of the header stacks 101 and there are stretchers 130*a* coupled to the entire span of the header stacks 101 on the opposite side 1005. Note that in FIG. 4 the stretchers 130*a* in the "rear" of the system (which stretchers have been omitted from the drawing), where the soil mass being retained (not shown) would be positioned with respect to the wall, are not directly contributing to the resistance of the principal loads as are being resisted by the header stack 101, when those principal loads are applied. In such a configuration, the zone of the stretchers 130*a* that intersects with the main header units 110*m* may contribute to the resistance of the compression force that is transferred to the header stack 101 by the pre-stressing of the active reinforcement elements 115** where such pre-stressing occurs prior to the application of the principal external loads.

Figure 12:
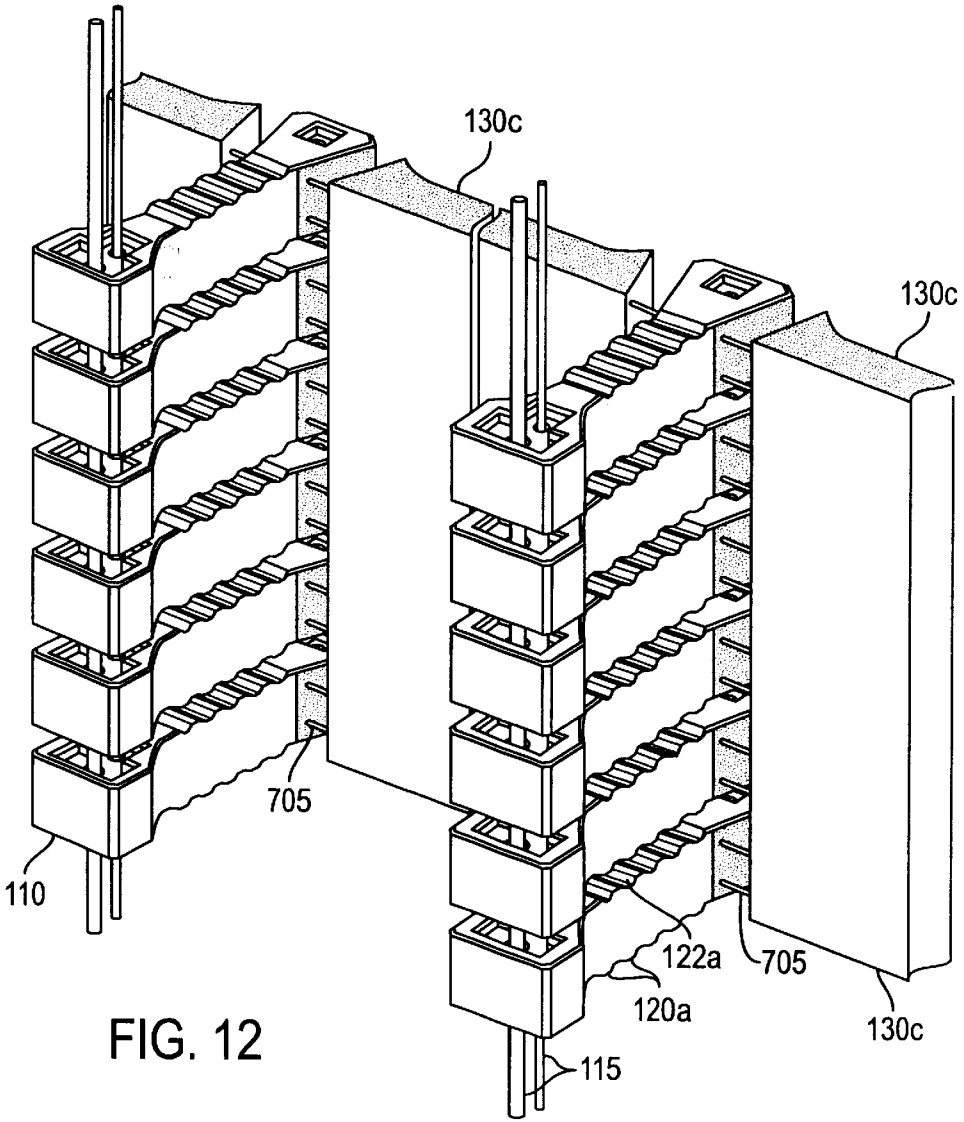
FIG. 12 is a perspective view of an alternative embodiment of a modular construction according to the present invention including cast-in-place concrete panels.
Figure 13:
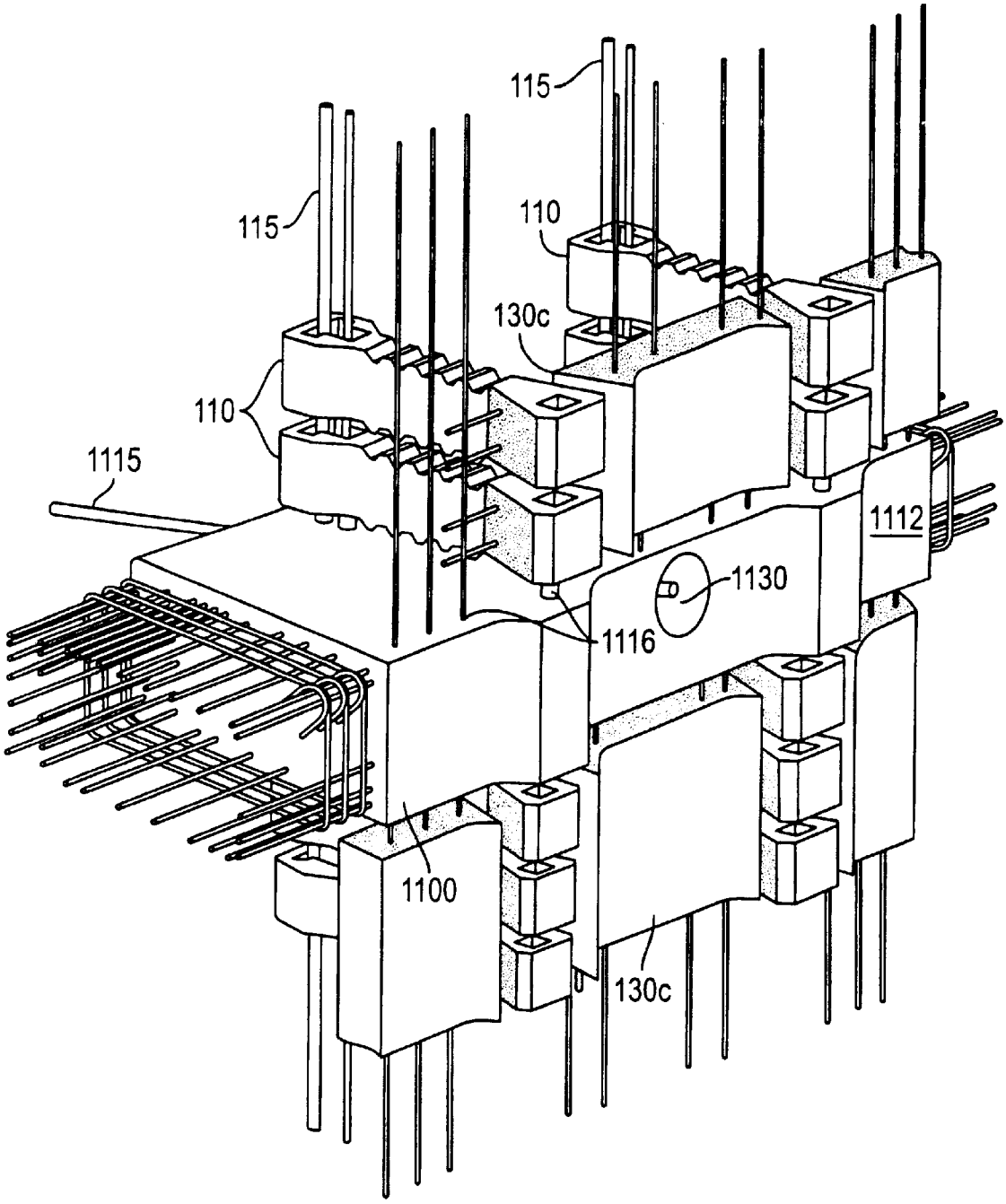
FIG. 13 is a perspective view of an alternative embodiment of a modular construction according to the present invention.

The structural member 130 may also consist of Cast-In-Place (CIP) concrete panels 130*c* (see FIGS. 12 and 13). The CIP concrete panels 130*c* have two distinct roles. The first role remains the direct retention of the soils and the transfer of these soil loads to the header stacks 101. The second role is to provide additional compression area in the resistance of the primary bending moments that develop over the height of the wall. Alternatively, with different loading and structural configurations, these CIP panels may accommodate active and/or passive reinforcement elements, 115 and/or 115*p*, where such elements are configured to work with and to assist the header stacks in resisting the accumulated loads assumed by same.

Note that the effectiveness of this composite action is highly dependent on the position of the CIP concrete panels 130*c* relative to the header stack 101 cross-section. Also, the effectiveness is equally dependent on the nature and location of the equilibrating reaction forces that restrain the wall structure.

The use of cast-in-place concrete panels 130*c* for the secondary structural members 130 provides great flexibility for a design engineer. In particular, it is a very simple matter to vary the spacing between header stacks 101. Moreover, the direction of a retaining wall (described in more detail below with respect to FIGS. 8–13) may be changed with ease, and as many times as the site and functional conditions demand. The retaining walls or other type of modular construction constructed from header units 110 coupled with CIP panels 130*c* may include plan curvatures, and reverse curvatures. Via the use of Task Specific Construction equipment (TSC equipment), the panels may be constructed using slip-forming techniques. This translates into very rapid construction of high retaining walls.

Figure 11:
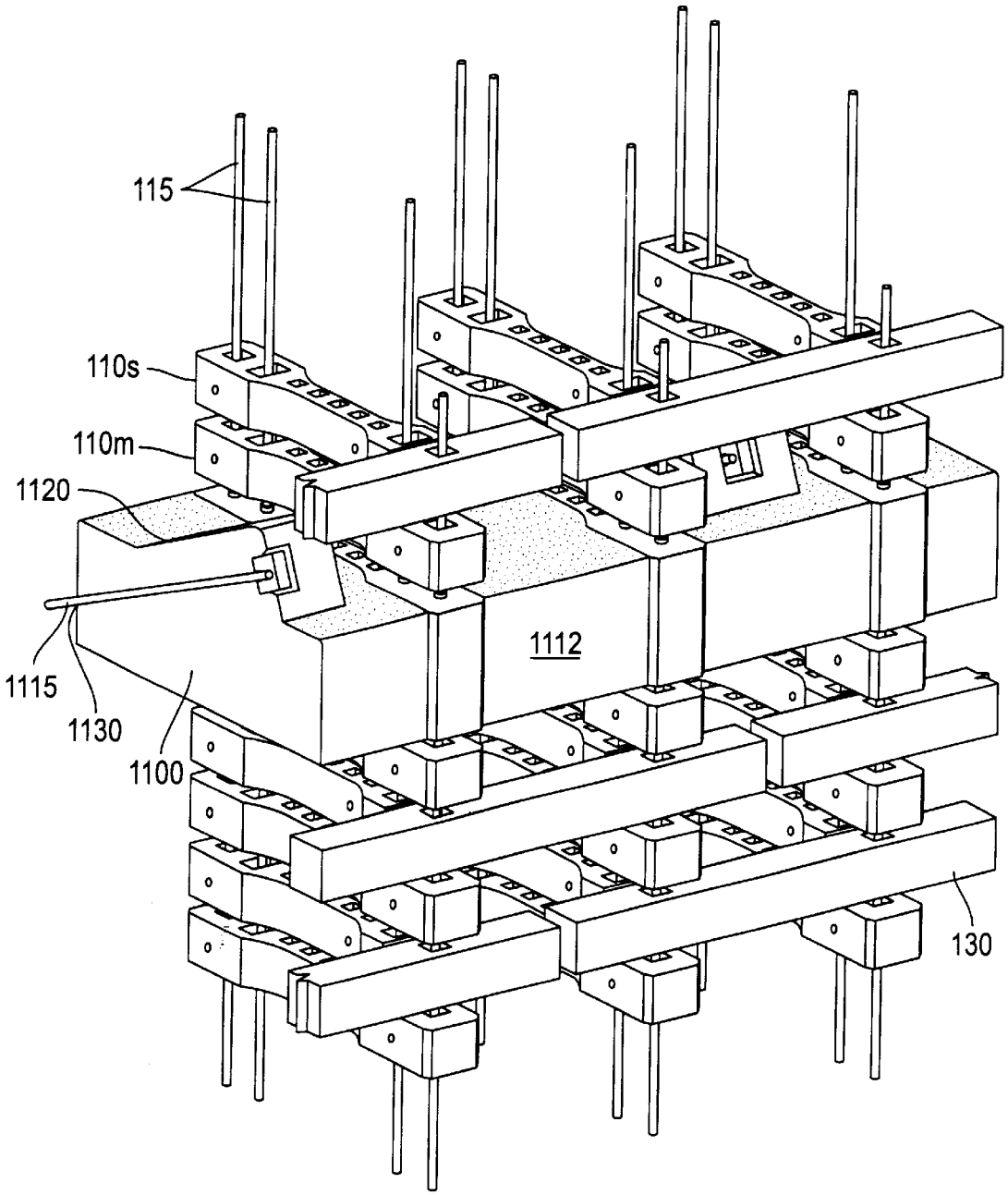
FIG. 11 is a perspective view of an alternative embodiment of a modular construction according to the present invention including a complementary structural element.

As with all the other embodiments presented herein, use of CIP panels 130*c* allows for the ready inclusion of one or more complementary structural elements 1100, such as a tieback transfer beam (see, for example, FIG. 11). These complementary structural elements 1100 provide much additional versatility for systems 100. They may be included at different locations up the height of the wall and, because of the reaction forces that are provided from the ground anchors 1115, allow for economic retaining wall construction to great height.

Figure 15A:
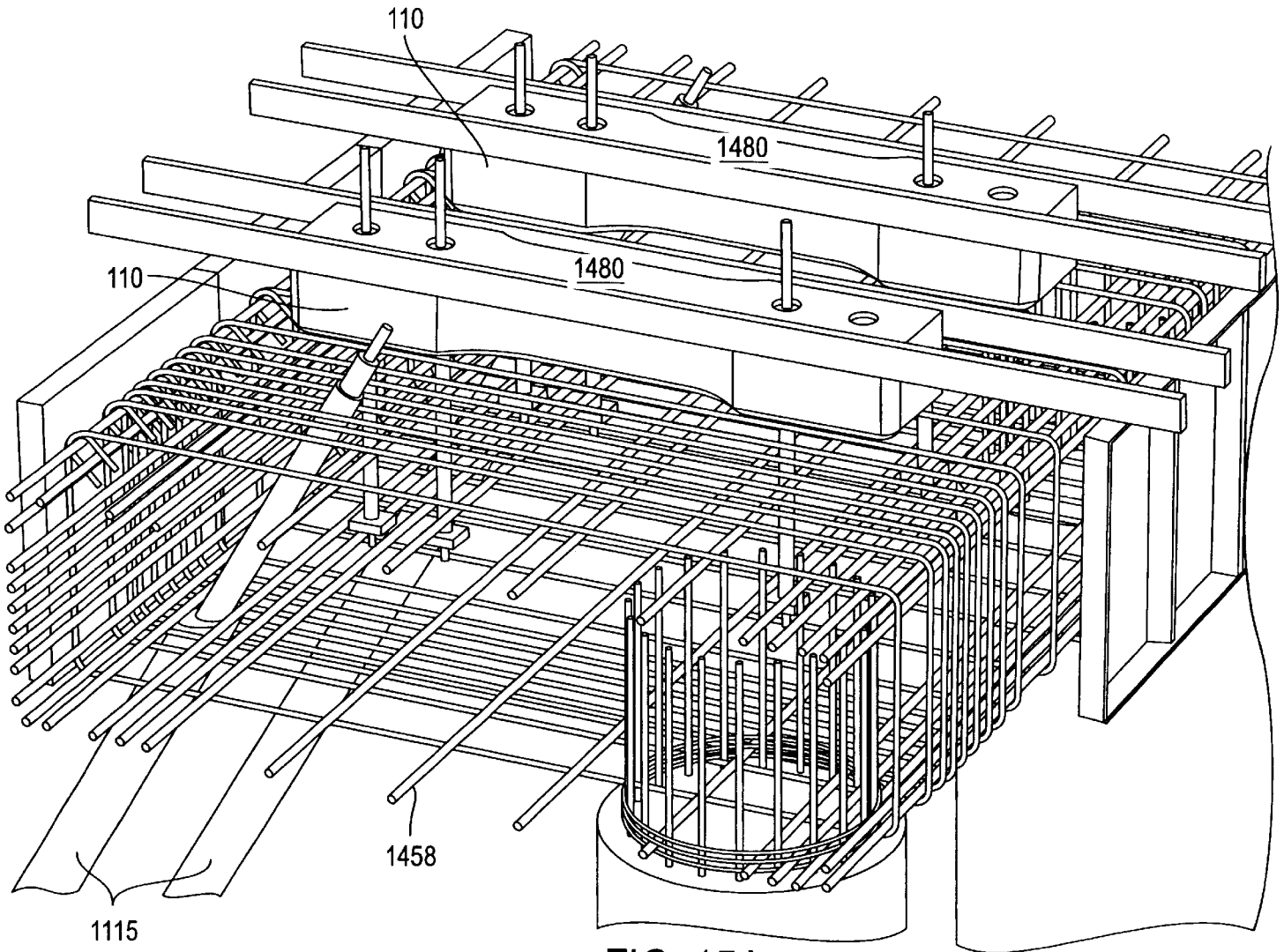
FIG. 15*a* is a perspective view of an exemplary header in a partial modular construction according to the present invention.
Figure 15B:
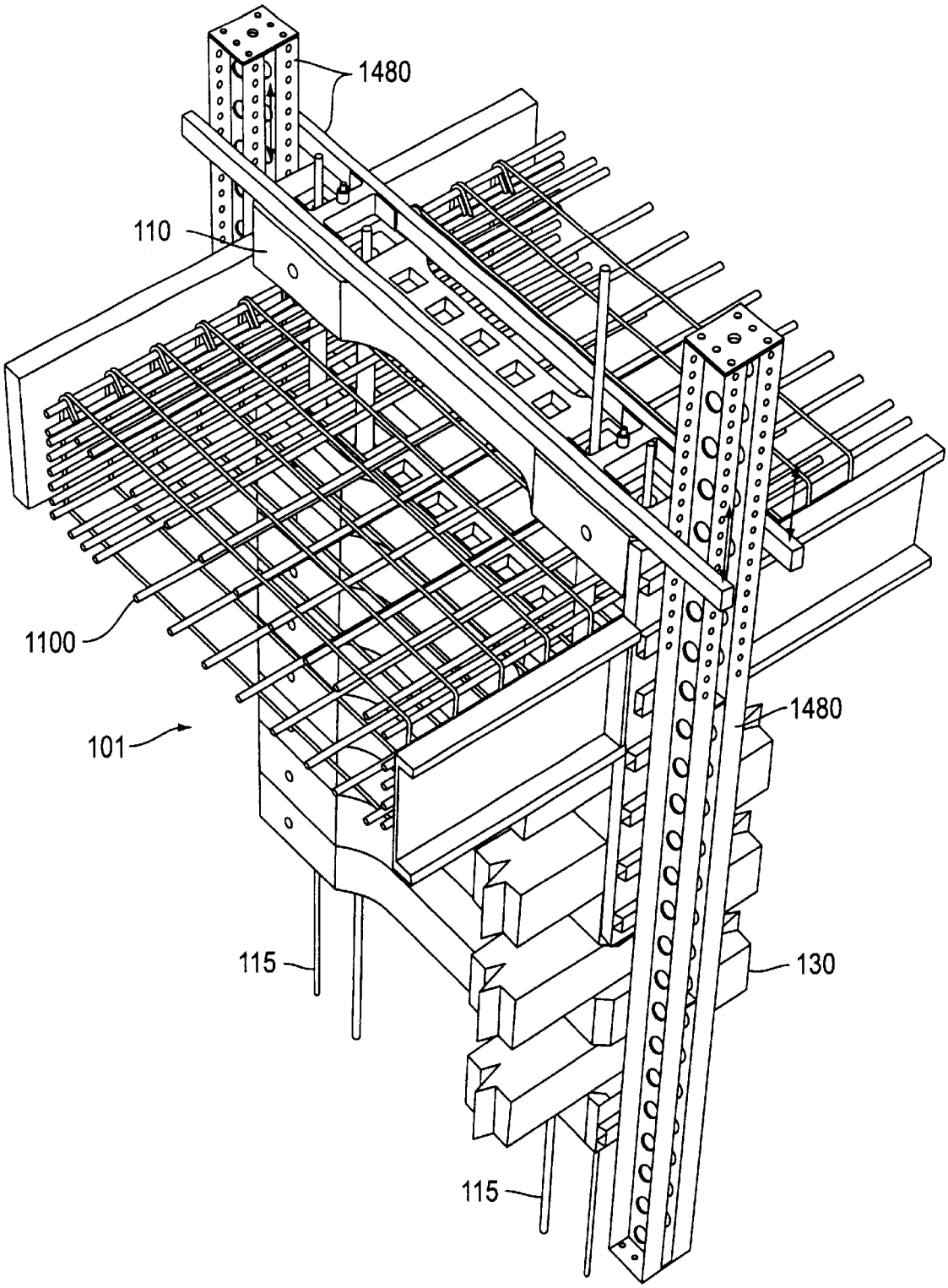
FIG. 15*b* is a perspective view of an exemplary header in a partial modular construction according to the present invention.

The construction of complementary structural elements 1100, and the seating of the first header unit 110 on top of the complementary structural element 1100, is facilitated via the use of Task Specific Construction equipment 1480 (TSC equipment), such as that depicted in FIGS. 15*a* and 15*b*. This will be described in more detail below with respect to a retaining wall fabricated in accordance with the present invention.

Referring to FIGS. 11 and 13, a system with a complementary structural element 1100 is shown. Where loading to be resisted by the retaining wall structure is large and where adequate ground anchor 1115 capacity may be developed within legally available ground space or right-of-ways, the use of these complementary structural elements 1100 provides solution opportunities that will tame very demanding retention and/or stabilizing problems. In general, the complementary structural element 1100 reduces the loads that are "seen" by the foundation element(s). As previously described, the load-path that exists in a retaining wall structure is as follows.

The soils being retained exert pressure on the retaining wall's structural members 130. These elements may be stretchers 130*a*, or they may be pre-cast panels 130*b*, cast-in-place (CIP) concrete panels 130*c*, or some other type of structural component. Such structural members 130 transfer these loads to the header stacks 101. The header stacks 101 resist the accumulated soil loads, and other loads where such are being resisted by the wall system, and transfer these loads to the structural members that provide the equilibrating reaction forces. Such reaction elements and/or members may be the foundation elements 500, 1450, tieback transfer beams 1100, capping beams, and/or other complementary structural elements, which themselves may be further assisted by other structural elements, such as associated ground anchors 1115, that collaborate in the development of the required reaction forces. There will be soil pressures exerted directly on the header stacks 101. However, these pressures depend on the exposed surfaces of the header unit 110 and its geometric characteristics as well as the spacing between the header stacks 101 and the characteristics of the soils being retained.

The foundation 500, that the header stack 101 is constructed on, and complementary structural elements 1100 if present, provide the necessary reaction forces for and directly to the header stack 101 of the retaining wall. In certain structural configurations, for example in pure cantilever arrangements, these reaction forces may be provided directly, and wholly, by the foundation beam/footing element itself. Alternatively, in certain configurations of these systems, additional equilibrating reaction forces may be provided via other elements such as ground anchors 1115 and/or piles, for example, to the foundation beam (pile cap, if piles are being used in conjunction with the foundation element 500, 1450). Other structural elements, such as ground anchors 1115, may also provide equilibrating reaction forces to complementary structural elements 1100 where present, and to the capping beams where present and where such resisting forces are required at these levels.

As seen in FIGS. 11 and 13, the complementary structural element 1100 is a tieback transfer beam preferably disposed between two header units 110 and extending between two or more of the header stacks 101. A ground anchor 1115 may be coupled to the complementary structural element 1100 to provide additional resistance to an applied load. Other structural element(s) may also, or alternatively, be coupled to the complementary structural element 1100 to provide additional resistance to an applied load. The complementary structural element 1100 can extend across the entire length of a construction or can be located between only some header stacks 101 that comprise the construction. The complementary structural element 1100 is provided with passthrough ducts 1116 that are configured to receive an active reinforcement element 115 or passive reinforcement element 115*p*. As with the passthrough ducts 136 in the stretchers 130*a*, the passthrough ducts 1116 in the complementary structural element 1100 must be in registry with the passthrough ducts 116 in the header units 110.

The complementary structural elements 1100 are also provided with a passthrough channel 1130 extending through the complementary structural element 1100. A ground anchor 1115 is coupled to the complementary structural element 1100 and is configured to extend through the passthrough channel 1130. Depending upon the direction of force required from the ground anchor 1115, the passthrough channel 1130 can be provided in a variety of positions. For example, as seen in FIG. 11, there is a raised portion 1120 extending from the complementary structural element 1100 that is in communication with the passthrough channel 1130 for receiving the ground anchor 1115. Although the figure illustrates the raised portion 1120 on the top of the complementary structural element 1100, it would be desirable in certain situations to have the raised portion 1120 on the bottom of the complementary structural element 1100. Further, it would be desirable in certain situations to have a raised portion 1120 on the top of the complementary structural element 1100 as well as have (together with) a raised potion 1120 on the bottom of the complementary structural element 1100 in close vertical proximity with the raised portion 1120 on the top of the complementary structural element 1100. In FIG. 13, the ground anchor 1115 extends from a front face 1112 of the complementary structural element 1100 through the passthrough channel 1130.

Referring now to FIGS. 27*a*–33, another embodiment of the components of a system 100 is depicted. The header units 2700 that make up the header stack 2701 in this embodiment comprise a top face 2790 and a bottom face 2780; a base element 2710 having a first end 2702 and a second end 2704; a head element 2712 having a first end 2706 and a second end 2708; and a pair of side elements 2714 extending between the first end 2702 and the second end 2704 of the base element 2710 and the first end 2706 and second end 2708 of the head element 2712. Either the base element 2710 or head element 2712 preferably extends past the side elements 2714 such that a flange 2705 is formed adjacent one or both side elements. The side elements 2714 may also couple with the base element 2710 such that an indentation 2707 is formed adjacent the base element 2710 (see FIG. 27*a*). Alternatively, the side elements 2714 may couple with the head element 2712 to form an indentation 2707 adjacent the head element 2712 (see FIG. 27*h*). The flange 2705 or indentation 2707 is configured to couple with a structural member 130. The header units 2700 of this embodiment have an open cell 2709 defined by the base element 2710, head element 2712 and side elements 2714. Such a configuration significantly decreases the weight of the header unit 2700 without sacrificing strength and performance of the system. Such configuration significantly allows for the optimization of strength, stiffness, and related properties of the components, and structure constructed with such components, versus the use of materials to obtain such structural performance.

Figure 27A:
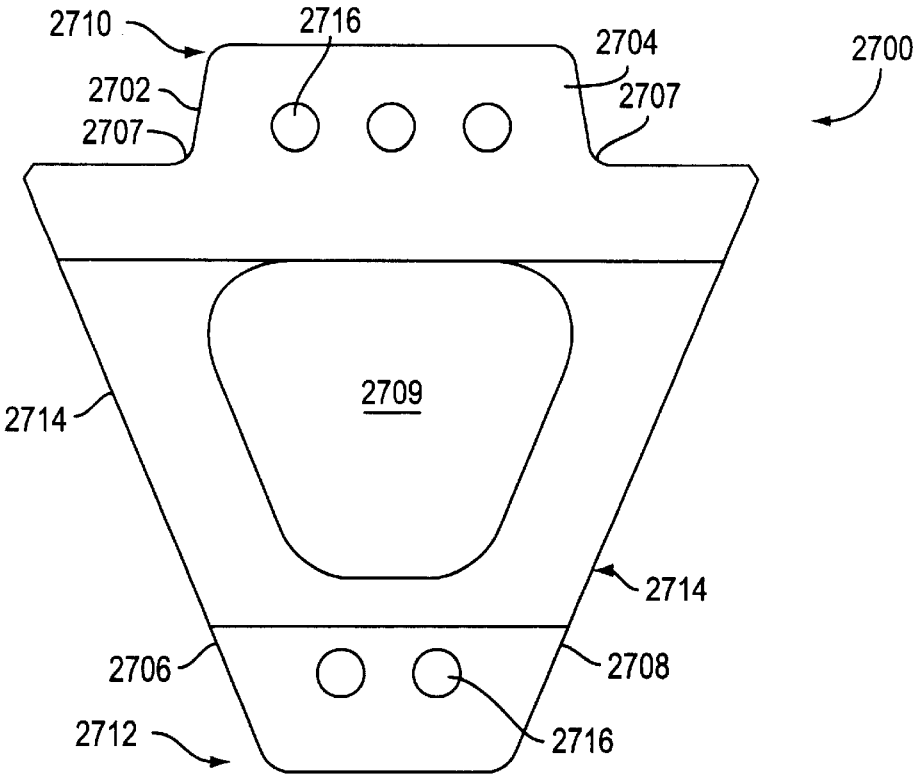
FIG. 27*a* is a top plan view of an exemplary header unit according to the present invention.
Figure 27B:
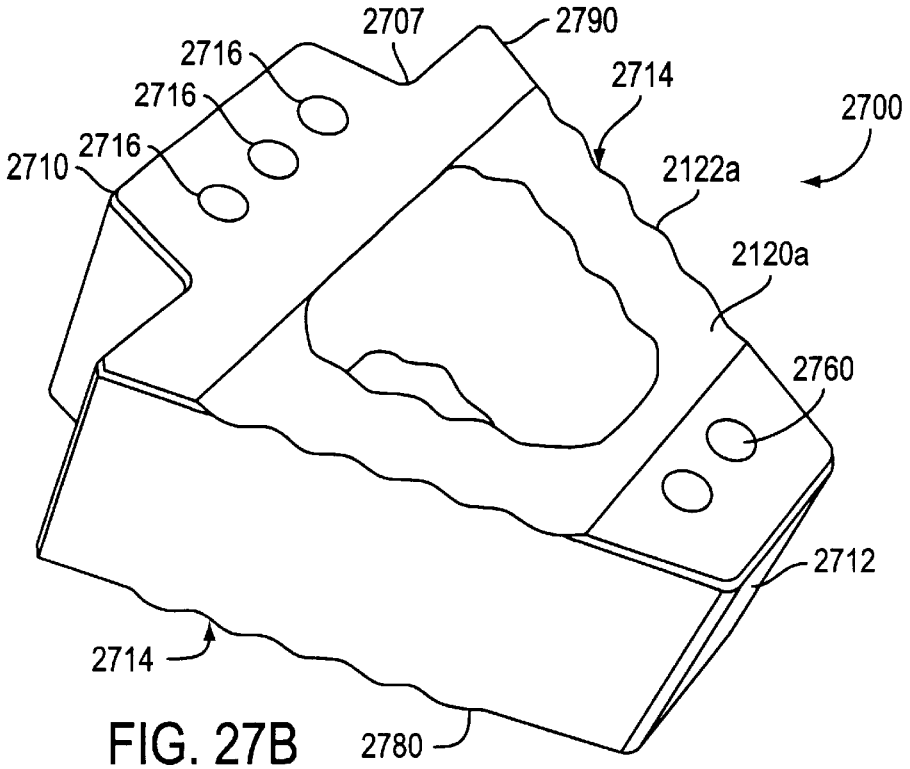
FIG. 27*b* is a perspective view of the header unit of FIG. 27*a*.
Figure 27C:
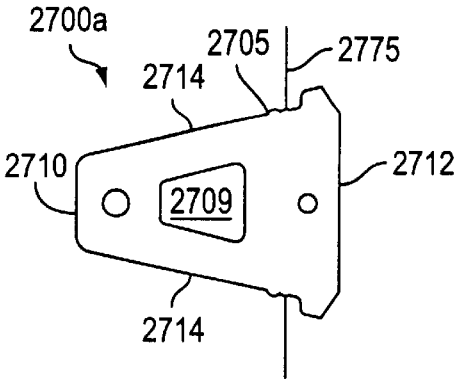
FIG. 27*c* is a top plan view of an exemplary header unit according to the present invention.

The arrangement depicted in FIGS. 27*a* and 27*b* is characterized by the convergence of the header webs or side elements 2714 from the back or base element 2710 of each unit 2700 to the front or head element 2712. The angle of convergence of these units may vary.

A retaining and/or support structure formed with these header units 2700 may employ (1) pre-cast concrete panels 130*b*, (2) cast-in-place concrete panels 130*c*, (3) a secondary structural element formed from the use of shotcrete 130*d* (see, for example, FIG. 28 and FIG. 29), or (4) some other suitable material and/or suitable structural configuration for such secondary structural elements 130.

The header stacks 2701 formed with these header units 2700 are tied, via the main soil retaining elements (the secondary structural member 130), where desired. The effectiveness of the tie will depend on the particular details of the design. Obviously, the retaining walls and/or support structures so formed are also tied horizontally by the foundation elements 500, 1450, the complementary structural elements (where included) 1100, and the capping beam(s) 3409 (where included).

Figure 28:
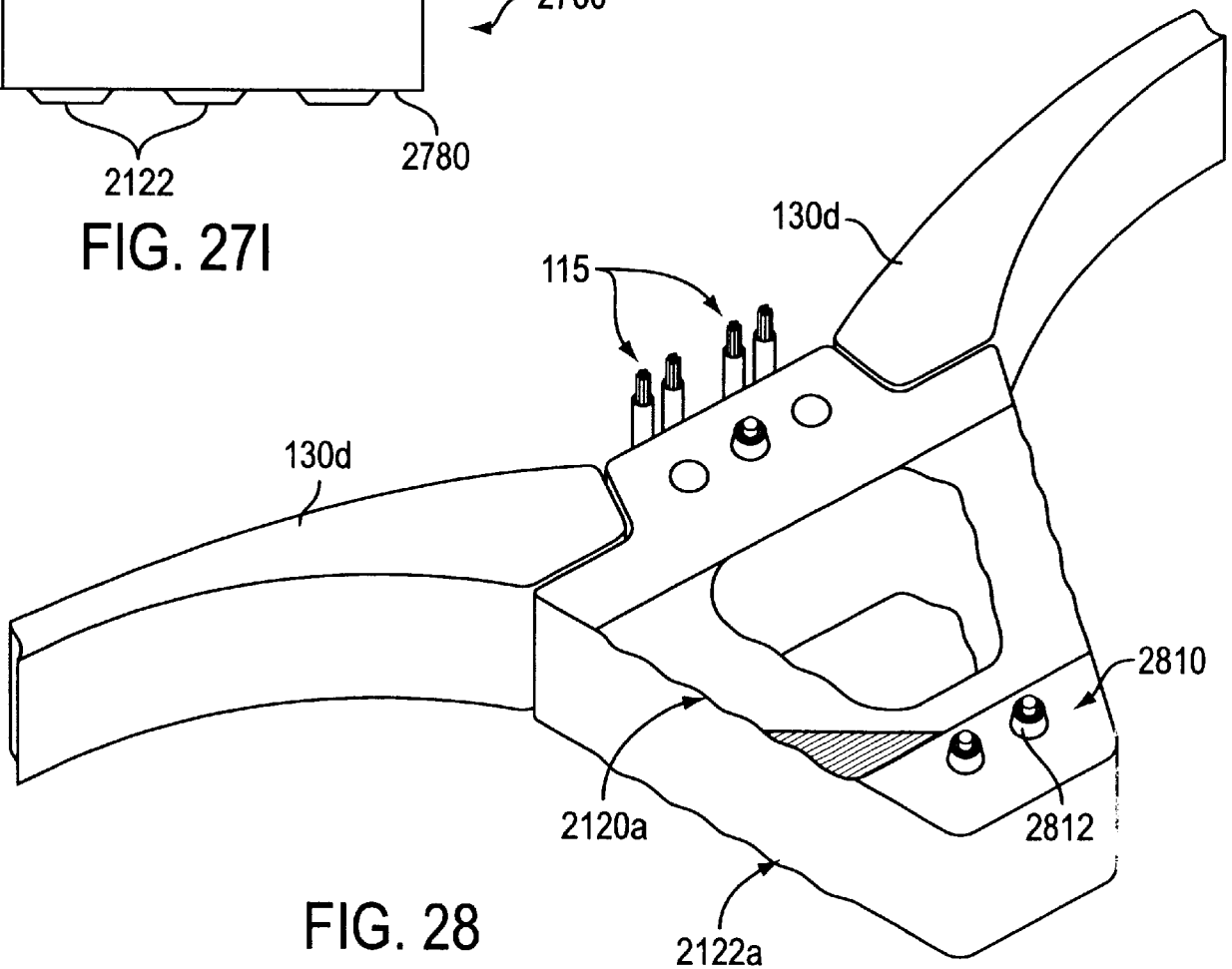
FIG. 28 is a perspective partial view of a modular construction according to the present invention and employing the header of FIGS. 27*a* and 27*b*.
Figure 29:
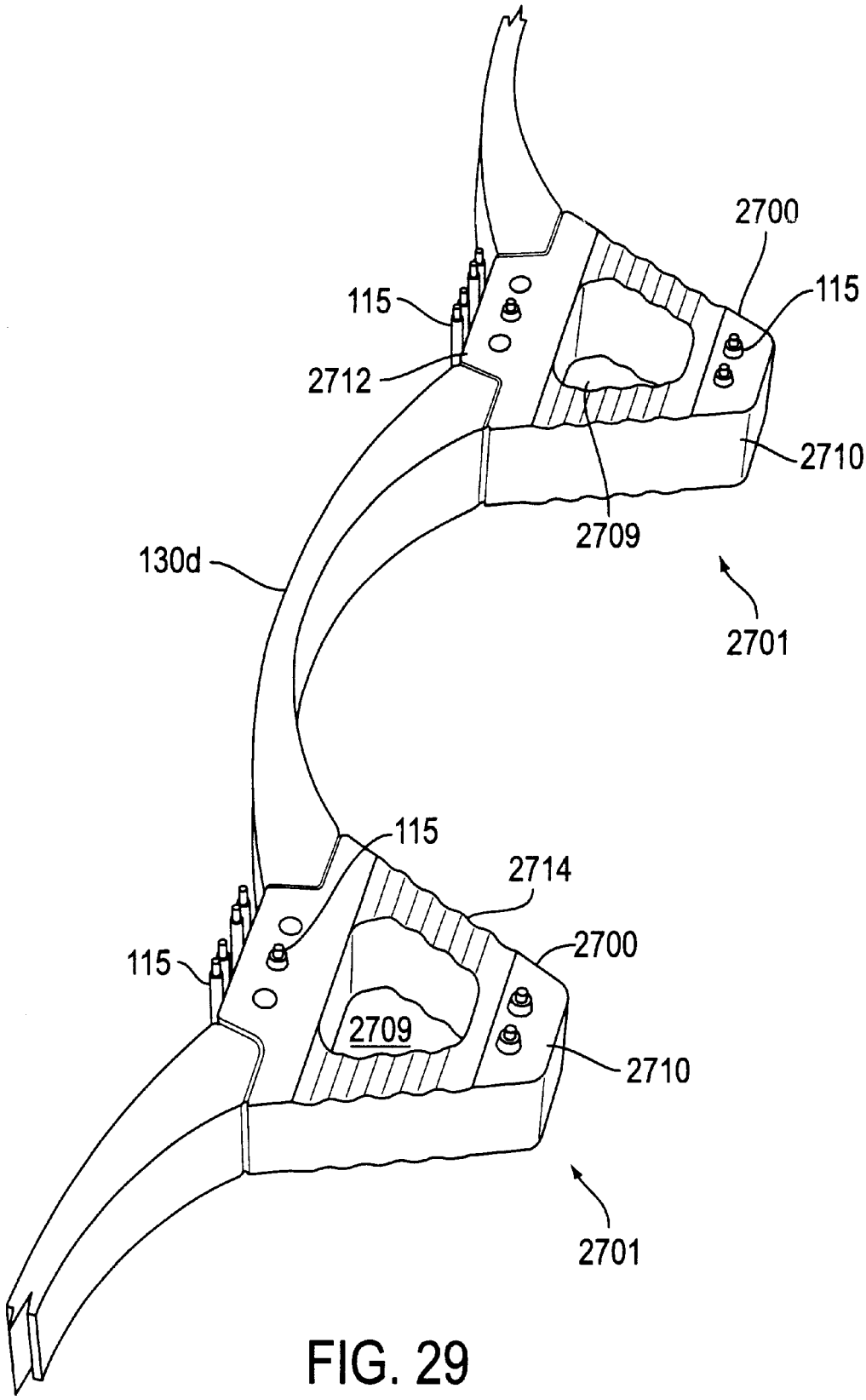
FIG. 29 is a perspective partial view of an alternative embodiment of a modular construction according to the present invention and employing the header of FIGS. 27*a* and 27*b* and depicting exemplary active reinforcement elements.

It is important to note that, while these header units 2700 may be designed and configured to perform their structural roles compositely with, for example, cast-in-place concrete panels 130*c*, there are several other ways that these versatile systems may be employed. Consider, for example, the use of reinforced or unreinforced shotcrete arches 130*d* between the header stacks 2701 as shown in FIGS. 28 and 29. Or, consider the use of pre-cast concrete panels 130*b*, which panels may also be pre-stressed by a pre-tensioning procedure, which are connected to the header stacks 2701 via reinforced cast-in-place concrete "welding" or "joining" columns or elements. These connecting columns or elements, with their incorporated continuity reinforcement elements and connections, would cause all the elements brought together in this arrangement to act as an integrated structural system.

The header units 2700 may also have a single set of continuity reinforcing bars 2775 per base element 2710 and/or head element 2712 (see FIGS. 27*c*–27*f*) located to match the forward rebar of the cast-in-place panels 130*c* where such cast-in-place panes are incorporated between or abutting adjacent header stacks 2701. This "forward" rebar has two roles. One is to provide for positive connection of the header stacks 2701 to the CIP panels 130*b* or 130*c* between them, abutting them, and on either side of them. This continuity of steel would be provided via mechanical connectors. The second role is to provide a rapid and accurate means by which the forward reinforcing mat of the CIP panel 130*c* may be fabricated and/or installed.

Figure 32:
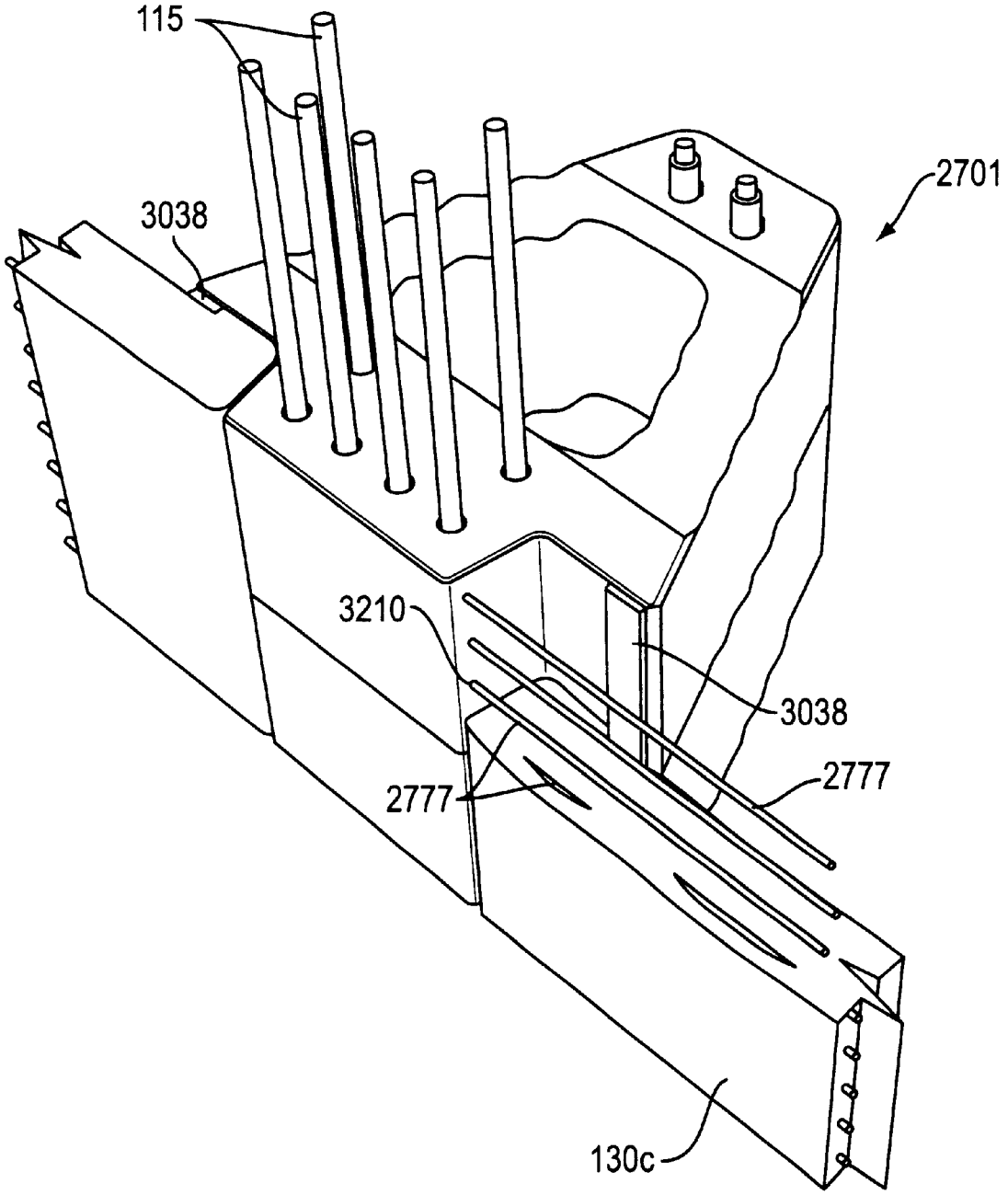
FIG. 32 is a perspective partial view of an alternative embodiment of a modular construction according to the present invention and employing the header of FIGS. 27*a* and 27*b* and depicting exemplary active reinforcement elements and passive reinforcement elements.

As with the header units 110 in the embodiment described previously, the header units 2700 depicted in FIGS. 27*a* and 27*b* can be produced with a variety of continuity and/or connection rebar configurations. This is, in general, true of all the header units of the present invention that are designed to work integrally with cast-in-place concrete 130*c* and/or where positive continuity and/or connection need to be provided for pre-cast panels 130*b* placed between header stacks 2701. One of the most common reasons for a "second" set of these bars is to provide for the immediate development of negative moment at the ends of these CIP panels 130*c*, where they butt the header stacks 2701 (as is indicated in FIG. 32). These continuity rebar sets, which provide for the development of these negative moments at the ends of the panels 130*c*, and/or 130*b*, may be the only sets provided in a header unit 2700. These continuity reinforcement elements preferably pass through the header units 2700 within transverse ducts 3210 (see FIG. 32), which transverse ducts are typically included within the header units 2700 during their manufacture.

As with the header units 110 in the embodiment described previously, the passive reinforcement element may also be configured to transfer transverse forces between the header stack 2701 and the secondary structural elements 130*c* and/or 130*b* abutting or adjacent one or both sides of the header stack 2701. In such circumstance, the passive reinforcement element 2777 may be bonded and/or mechanically connected to the header unit 2700, with such connection being established over a predetermined portion of the passive reinforcement element 2777, only, where such passive reinforcement element 2777 is continuous through the header unit 2700. As with the header units 110, where the reinforcement element 2777 is not a continuous element through the header unit 2700, such element 2777 may terminate within the header unit and protrude out one side of the header unit 2700. That is, suitable bond break is established over sufficient distance of the outer portion or portions of such passive reinforcement element 2777 which portion or portions of this element 2777 are adjacent the "outer" zones of the header unit 2700 so intersected in order to prevent deleterious effects to the concrete of the header unit

2700 within these "outer" zones common to both of the intersecting elements 2700 and 2777.

Header units 2700 may be relatively large or small in size and possess high load resistance capacities. Typically, their installation would be found in situations where very large retention capacity is demanded of the retaining structure. This large retaining capacity may be further extended and/or enhanced with the use of complementary structural elements 1100, which complementary structural elements themselves may, or may not, be augmented with such elements as ground anchors, which tie in, and/or frame in, to the structural system.

As a general note, the degree to which greater efficiencies are derived from the composite systems, where one of the composite systems are used, will depend on several factors. One factor is where the cast-in-place concrete panel 130*c* (or pre-cast concrete panels 130*b* where such panels are being made to act compositely with the header stacks 2701 associated) frames into the header stack 2701. This in turn depends on the geometry of the header unit 2700 being used, that is, it depends on the position, on the header unit 2700, where the CIP panel, or panels, 130*c*, or pre-cast panels 130*b*, is/are coupled. The header unit 2700 shown in FIGS. 27*a* and 27*b* places the panel 130*c* and/or 130*b* at the rear of the header stack 2701 while the header units 2700 shown in FIGS. 27*g* and 27*h*, for example, place the concrete panel 130*c*, or 130*b*, near the front of the header stacks 2701 so formed.

A second factor is the presence of complementary structural elements 1100 such as a tieback transfer beam. The presence of one or more of these complementary structural elements 1100, up the height of a wall, not only reduces the loading on the foundation elements 500, 1450, but also directly influences the moment distributions over the height of the wall structure and, in particular, the header stacks 2701 of the wall structure. The moment profile and magnitudes will have a direct influence on the choice of one header type and size over that of another.

The complementary structural elements 1100 acting in conjunction with other elements such as ground anchors 1115, are not the only way in which lateral restraint may be applied to the retaining wall(s) 3100 at one or more levels up the structure. Where, for example, a "cut-and-cover" is required, and the walls are to be constructed on one or both sides of the cut, beams frequently reach from one side of the "cut" to the other. These spanning beams may then be utilized to act as struts, and thereby provide horizontal restraint to the walls at levels above the foundations.

Figure 27F:
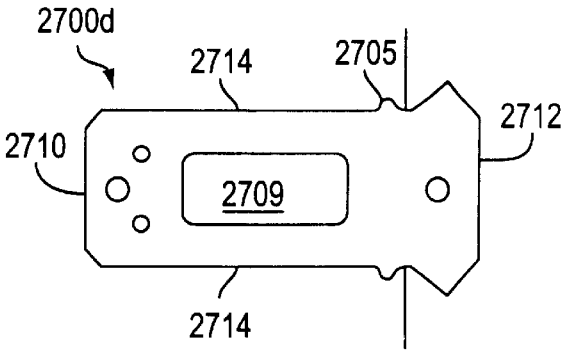
FIG. 27*f* is a top plan view of an exemplary header unit according to the present invention.
Figure 27D:
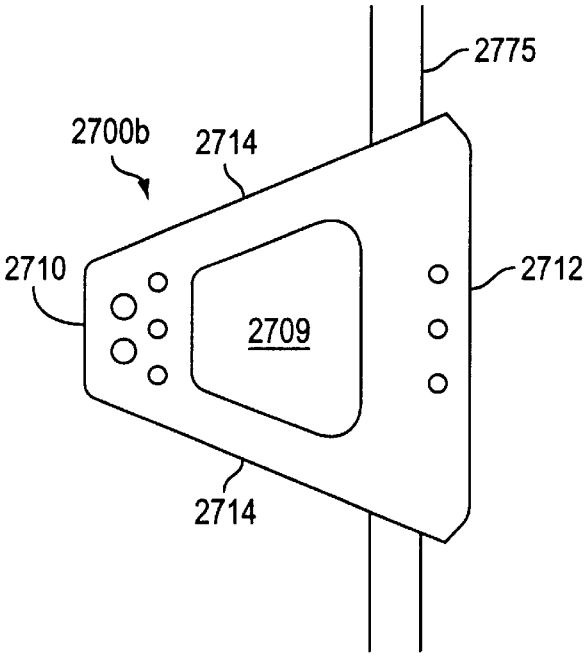
FIG. 27*d* is a top plan view of an exemplary header unit according to the present invention.
Figure 27G:
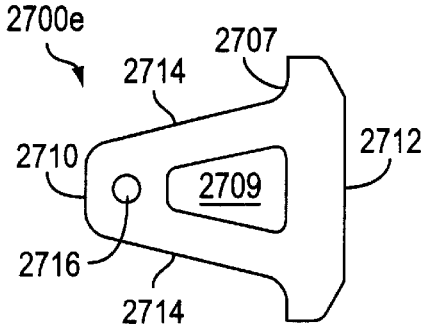
FIG. 27*g* is a top plan view of an exemplary header unit according to the present invention.
Figure 27E:
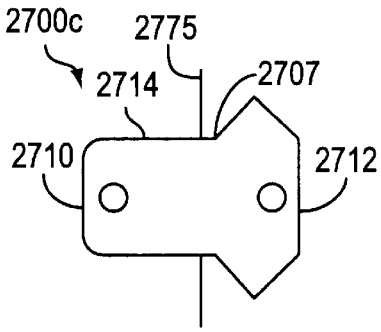
FIG. 27*e* is a top plan view of an exemplary header unit according to the present invention.
Figure 27H:
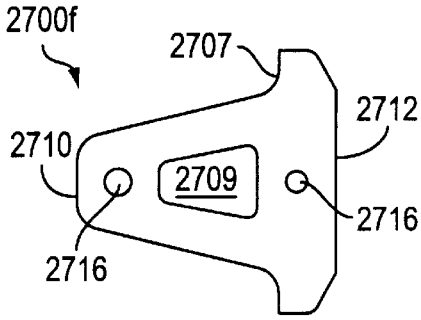
FIG. 27*h* is a top plan view of an exemplary header unit according to the present invention.
Figure 27I:
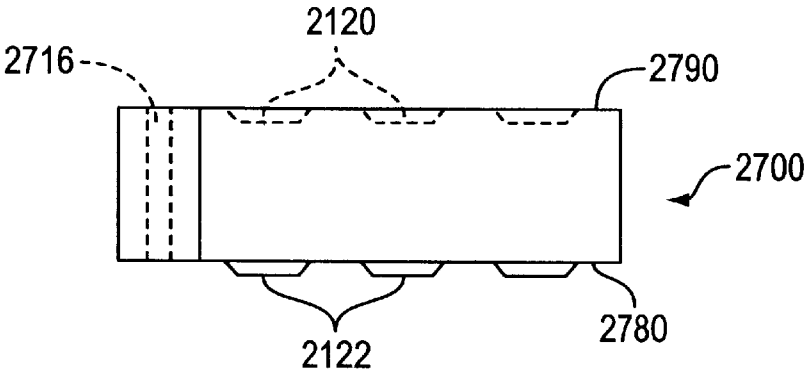
FIG. 27*i* is a side view of an exemplary embodiment of a header according to the present invention.

The header units 2700 depicted in FIGS. 27*g* and 27*h* are characterized by the divergence of the header webs, or side elements 2714 from the back or base element 2710 of each unit 2700 to their front or head element 2712. The header stacks 2701 formed with header units 2700 in FIGS. 27*g* and 27*h* are typically not directly tied together, except at the foundation element(s) 500, 1450, the capping beam(s), and any complementary structural element or elements 1100, that may be included. The retaining and/or support structure formed with the header units 2700 in FIGS. 27*g* and 27*h* may employ (1) pre-cast concrete panels 130*b*, (2) cast-in-place concrete panels 130*c*, (3) a secondary element formed from the use of shotcrete 130*d*, or (4) some other suitable material and/or suitable structural configuration for such secondary structural elements 130.

The header unit 2700 depicted in FIG. 27*g* with the single passthrough duct 2716 at the rear of the header unit 2700, is specifically designed to form header stacks 2701 that only behave as cantilevering structures. That is, they are constructed on the retaining wall's foundation, where all the restraint is provided by the moments and shear forces that develop at the interface between the header stacks and the foundation.

Note, however, where there exists the possibility of reverse moments occurring, as might be the case if the retaining wall and any attached appurtenances were to be subjected to earthquake loading, then a nominal and sufficient capacity to withstand such infrequent events would be required. In such a case, the use of the header unit depicted in FIG. 27*h* with an additional forward passthrough duct 2716 would be in order. Assuming the wall is a cantilevering structure without assistance from a complementary structural element 1100, for example, the header unit would be used without necessarily employing active reinforcement elements 115 through the forward duct 2716. This would be the case because the CIP concrete panels 130*c* on either side of the header stacks 2701 would be designed with sufficient vertical reinforcing steel to provide, in composite action with the header stacks 2701, the necessary reversed moment capacity.

The header units 2700 in 27*a*, 27*b*, 27*d*, 27*f*, and 28 through 33 are well suited to resisting very large loads. In particular, where the retaining wall 3100 (see, for example, FIG. 31) is cantilevering from the foundation element(s), because of the large moments that can be resisted with this system, the structure may competently retain very large soil loads. Additionally, the system can readily include structural elements that cantilever out from the face of the wall, or from the top of the wall as shown, for example, in FIGS. 34*a*, 34*b* and 34*f*, or may support other structural elements using other supporting mechanisms.

As seen in FIGS. 34*a*, 34*b* and 34*f*, the modular construction 800 may be configured to support a cantilever structure 3450 such as a roadway, sidewalk, etc. The modular construction 800 comprises a header stack 2701, 101 comprised of header units 2700, 110. One or more complementary structural elements 1100 may also be incorporated where desired.

The header units 2700 depicted in FIGS. 27*e* and 27*f* are characterized by their webs, or side elements 2714, being parallel. Note that the header units 2700 shown in FIG. 27*e* do not have a cell 2709, while the headers in FIGS. 27*a*, 27*b*, 27*c*, 27*d*, 27*f*, 27*g*, 27*h* and 28 do have a cell 2709. This is because the header unit depicted in FIG. 27*e* is the smallest in the range of such header units 2700 which header units possess parallel webs or side elements 2714.

The system having the various types of header units 2700 depicted in FIGS. 27*a*–h may use passive reinforcement elements 2775 and 2777, or other transverse passive reinforcement elements, that extend through passthrough ducts 3210 (as seen for example, in FIG. 32) in at least one of the header units 2700. The passive reinforcement element 2775, 2777 are configured such that it does not carry load distributed in the header stack 2701. The passive reinforcement elements 2775, 2777 may also be useful to provide shear-dowel action between pre-cast components and cast-in-place components to withstand loads (e.g., soil loads that would first be resisted by secondary structural members 130). The passive reinforcement element 2775, 2777 preferably extends transversely through a passthrough duct 3210 in the header unit 2700.

Other, longitudinally aligned passive reinforcement elements, which elements are disposed within passthrough ducts 2716, and which passive reinforcement elements are subsequently bonded to the ducts so formed in the header stacks 2701, may be configured to account for additional compressive capacity at the critical sections of the header stack 2701 and/or to improve performance of the critical sections under overload conditions.

The passive reinforcement elements 2775, 2777 may be placed within the header units 2700 depicted in FIGS. 27*c*, 27*d*, 27*e*, 27*f*, and FIG. 32 during casting, as would be the case if the transverse passive reinforcement element, for example element 2775, was expected to carry compressive forces, or after the header unit 2700 was in place. The ducts 3210 that would be included in the header unit 2700 in the latter case allow for several behavioral characteristics. First, from the standpoint of structural performance enhancement of the panel 130*c* and/or 130*b* between and/or abutting the header stacks 2701, where transverse ducts 3210 are located in the header units 2700 to align with the rear reinforcement of the panel 130*c* and/or 130*b*, the passive reinforcement elements 2775, or 2777 enable the development of negative moments at the ends of the panels 130*c* and/or 130*b*. Second, where these passive reinforcement elements 2775, 2777 are required to sustain tension forces, the presence of the ducts 3210 prevents the tensile strains generated within the passive reinforcement elements 2775, 2777 from attempting to transfer load, via bonding, to the header unit 2700 through which it is passing. Third, the structural interdependence, via force continuity through the header stacks 2701 that the presence of the transverse passive reinforcement elements 2775, 2777 provide ensures a greater lateral stability of the system.

In order to maintain an interlocking relationship between the header units 2700, shear keys may be provided on the header units depicted in FIGS. 27*a*–27*i*, and as shown, for example, in FIGS. 27–33. The shear keys comprise a plurality of indentations 2120 on one of the top 2790 and bottom 2780 faces of each header unit 2700 and a plurality of protrusions 2122 on the other of the top 2790 and bottom 2780 faces of the header unit 2700 corresponding to the plurality of indentations 2120. The protrusions 2122 on each header unit 2700 are configured to engage the corresponding indentations 2120 in an adjacent header unit 2700. The indentations 2120 and protrusions 2122 are preferably provided on the head element 2712, base element 2710 and side elements 2714. Preferably, the shear keys comprise first corrugations 2120*a* on one of the top 2790 and bottom 2780 faces of the header unit 2700, and second corrugations 2122*a* on the other of the top 2790 and bottom 2780 faces of the header unit 2700 corresponding to the first corrugations 2120*a*. The second corrugations 2122*a* on each header unit 2700 are configured to nest with the corresponding first corrugations 2120*a* in an adjacent header unit 2700. The first 2120*a* and second 2122*a* corrugations are preferably provided on the head element 2712, base element 2710, and side elements 2714. However, it is possible to have corrugations on only one of the elements provided there were corresponding corrugations on the same element of an adjacent header unit 2700. Where the shear keys, such as corrugations 2120*a*, 2122*a*, are provided they are preferably continuous and preferably geometrically consistent over those portions of the head element 2712, base element 2710, and side elements 2714 where such features are provided.

There may be a plurality of passthrough ducts 2716 provided in the headers 2700 that are configured to receive active reinforcement elements 115 and/or passive reinforcement elements 115*p*. The passthrough ducts 2716 can be any size or shape, but are preferably cylindrical in configuration. The head element 2712 and base element 2710 can each define a passthrough duct 2716. The side elements 2714 may or may not be provided with one or more passthrough ducts 2716 to receive active reinforcement elements 115 and/or passive reinforcement elements 115*p*. There are also a plurality of passthrough ducts 3210 that extend transversely through the header units 2700 to receive passive reinforcement elements 2775, 2777 as mentioned above. Where the transverse reinforcement elements 2775, 2777 are continuous through the header units 2700 and where such elements 2775, 2777 are not provided with a capability to transfer transverse forces to the header units 2700, passthrough ducts 3210 are preferably lined with a conduit that prevents the reinforcement element 2775, 2777 from bonding with each individual header unit 2700. As discussed previously, such elements 2775, 2777 may be connected via bonding and/or mechanical connection to the header units 2700, but, preferably, this connecting between these elements 2775, 2777 and 2700 is over specifically limited lengths of the incorporated passive reinforcement elements, which elements 2775, 2777 are prevented from bonding over their outer portion or portions of their intersection with the concrete of the header unit 2700.

The header units 2700 can be constructed to suit any particular need. They can be designed to accommodate changes in the features such as size, number and location of passthrough ducts 2716, 3210; size, shape, and location of the shear keys on the top and bottom surfaces, etc.

In one embodiment of the present invention, the active reinforcement elements 115 and/or passive reinforcement elements 115*p* are internally threaded in the headers 2700 depicted in FIGS. 27*a*–h through the passthrough ducts 2716. The active reinforcement elements 115 are able to be locked off at lock-off points 2810 in lock-off recessions 2812 in the header units 2700, where these lock-off points require such lock-off recessions. There are internal lock-off elements (not shown) to secure the active reinforcement elements 115 within the lock-off recessions 2812, where these lock-off recessions are/may be required. Such active reinforcement element 115 may also be locked off at, on, or in, such complementary structural elements 1100 as a tieback transfer beam and/or capping beam.

In an alternative embodiment of the invention, the active reinforcement elements 115 may be disposed external to the header unit 2700 either within the cell of, or external to, the header unit 2700.

The header stacks 2701 may include a plurality of active reinforcement elements 115. The active reinforcement elements 115 may be both internal (i.e., directed through the passthrough ducts in the header units) and external (i.e., directed through lock-off elements external to the header units). The header stacks 2701 may alternatively have only internal active reinforcement elements 115 or only external active reinforcement elements 115. Such external active reinforcement elements 115 may transfer their pre-stressing force or forces to the structural assembly via force transfer points that are included in, on, or at such structural components as foundation elements 500, 1450, tieback transfer beams 1100, capping beams, or other complementary structural elements. Also, the internal active reinforcement elements 115 may utilize similar force transfer points, in addition to, or alternatively to, transfer points that are included within the cross-section of the header stack 2701 header units 2700.

Coupled between each header stack 2701 are structural members 130 that may resist soil loading directly. The soil loads sustained by the secondary structural elements 130 are substantially transferred to the header stacks 2701. The header stacks 2701 transfer the accumulated loads to the foundations, and to any other elements such as the complementary structural elements 1100, that are designed to restrain header stacks 2701. The structural members 130 may take many forms.

Figure 30:
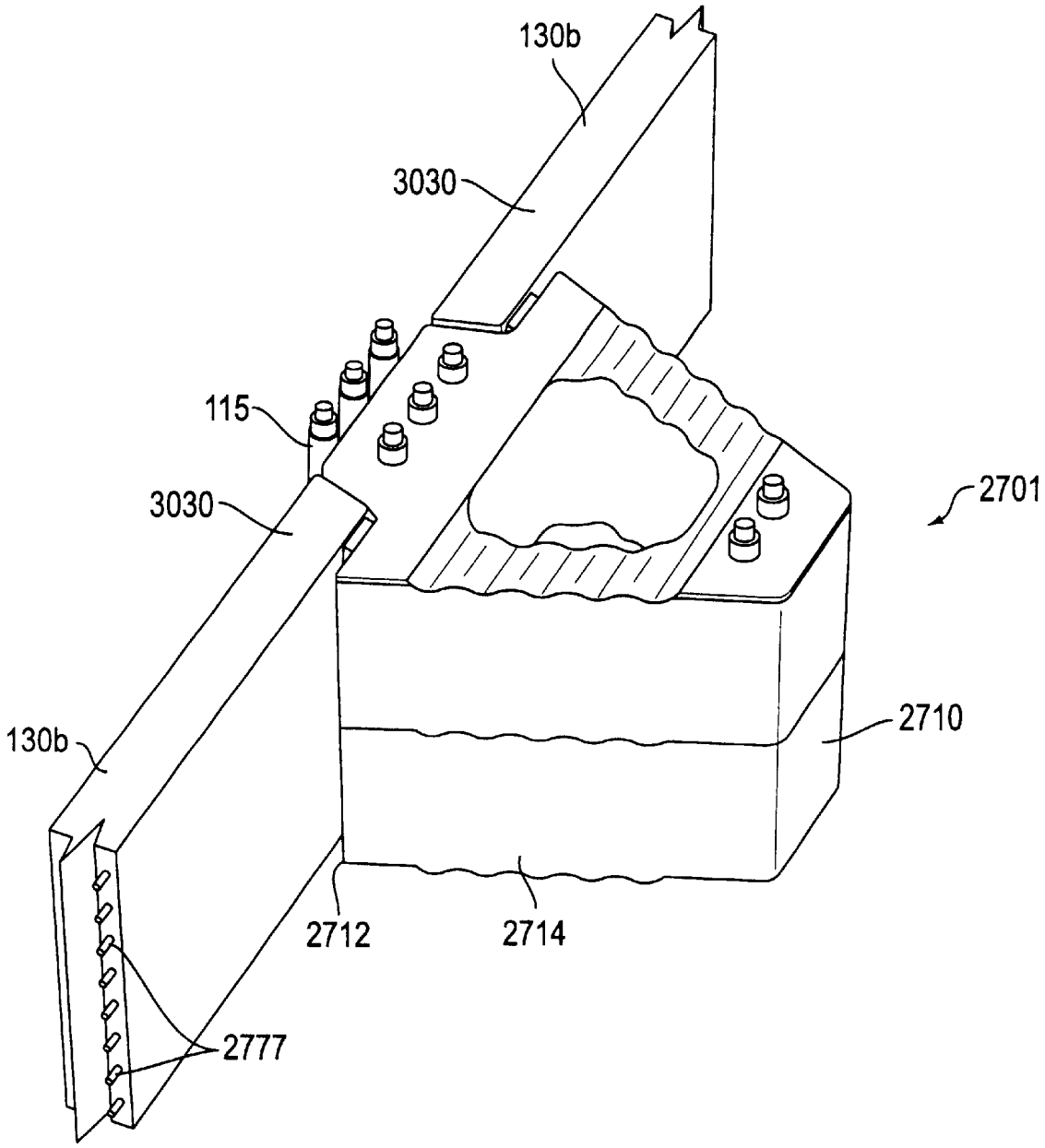
FIG. 30 is a perspective partial view of an alternative embodiment of a modular construction according to the present invention and employing the header of FIGS. 27*a* and 27*b* and depicting exemplary active reinforcement elements.
Figure 31:
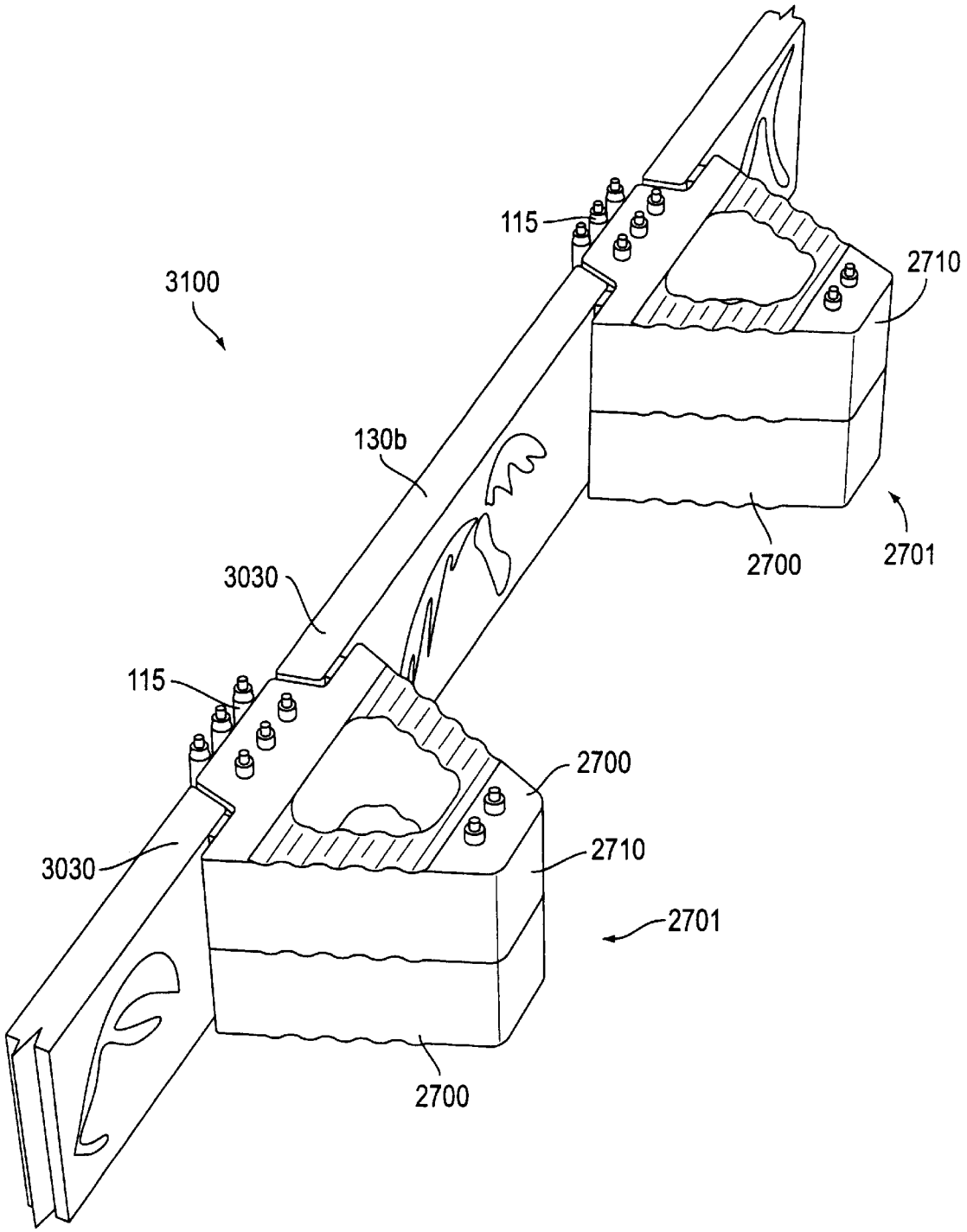
FIG. 31 is a perspective partial view of an alternative embodiment of a modular construction according to the present invention and employing the header of FIGS. 27*a* and 27*b* and depicting exemplary active reinforcement elements.

The preferred structural member for use with the header units 2700 of the present embodiment is a concrete panel 130*b* and/or 130*c* disposed between, adjacent, or abutting each header stack 2701. The structural members 130 are coupled to the header units 2700 at the indentation adjacent the base element 2710 or head element 2712. There may be passive reinforcement elements 2775, 2777 that are pre-positioned in the indentation 2707 to connect to, and/or maintain the position of, the reinforcement elements of the panels 130*b* and/or 130*c* associated with the header stack 2701. The structural element 130 may be a pre-cast concrete panel 130*b*, cast-in-place concrete panel 130*c*, or may be a shotcrete structural element 130*d*. There may also be a bearing strip 3030 (as indicated in FIGS. 30 and 31) or bearing element provided in the indentation 2707. This bearing element 3030 ensures correct seating of the panel 130*b* against the header stack 2701 without the development of detrimental stress concentrations in either the panels of header stack 2701. The bearing strip 3030 is preferably a fully competent and pliable material such as, for example, rubber, polyethylene, neoprene, and butylene, as appropriate to the structural role required of same 3030. Similarly, FIG. 32 includes a crush strip 3038 which is situated prior to "pouring" the concrete for a cast-in-place concrete panel against header stack 2701. The crush strip 3038 allows the CIP panel to deform under load without having a detrimental effect on the concrete of the header units 2700. Moreover, the crush strip 3038 ensures that the load from the panel 130*c* is imparted as far into the header stack 2701 as possible (i.e. as far from the extreme edges of the header stack as possible).

A complementary structural element 1100, such as a tieback transfer beam, may be incorporated within a structural system which is comprised partially or largely of header stacks 2701, wherein such structural element 1100 is preferably disposed between two header units 2700 and extends between two or more of the header stacks 2701. A ground anchor 1115 maybe coupled to the complementary structural element 1100, or tieback transfer beam, or capping beam, to provide additional resistance to an applied load. The complementary structural element 1100 is provided with passthrough ducts 1116 that are configured to receive an active reinforcement element 115, or passive reinforcement element 115*p*. The passthrough ducts 1116 in the complementary structural element 1100 must be in registry with the passthrough ducts 2716 in the header units 2700 where internal active reinforcement elements 115 and/or passive reinforcement elements 115*p* are provided in conjunction with header stacks 2701. Also, where external active reinforcement elements 115 are provided in conjunction with header stacks 2701 passthrough ducts 1116 in the complementary structural element 1100 must be in registry with such external active reinforcement elements 115.

The complementary structural elements 1100 are also provided with a passthrough channel 1130 extending through the complementary structural element 1100. A ground anchor 1115, or other suitable structural element capable of developing the necessary tension forces required at that location by the particular structural installation, is configured to extend through the passthrough channel 1130, and is coupled to the complementary structural element 1100. Depending upon the direction of force required from the ground anchor 1115, the passthrough channel 1130 can be provided in a variety of positions. There can be a raised portion 1120 extending from the complementary structural element 1100 that is in communication with the passthrough channel 1130 for receiving the ground anchor 1115. Although it is preferred to have the raised portion 1120 on the top of the complementary structural element 1100, it would be desirable in certain situations, such as when the ground anchor 1115, or other suitable structural element capable of developing the necessary tension forces required at that location by the particular structural installation, would need to extend in an upwardly direction, to have the raised portion 1120 on the bottom of the complementary structural element 1100. Further, it would be desirable in certain situations to have a raised portion 1120 on the top of the complementary structural element 1100 as well as having a raised potion 1120 on the bottom of the complementary structural element 1100 in close vertical proximity with the raised portion 1120 on the top of the complementary structural element 1100. The ground anchor 1115 can also extend from a front face 1112 of the complementary structural element 1100 through the passthrough channel 1130.

Figure 33:
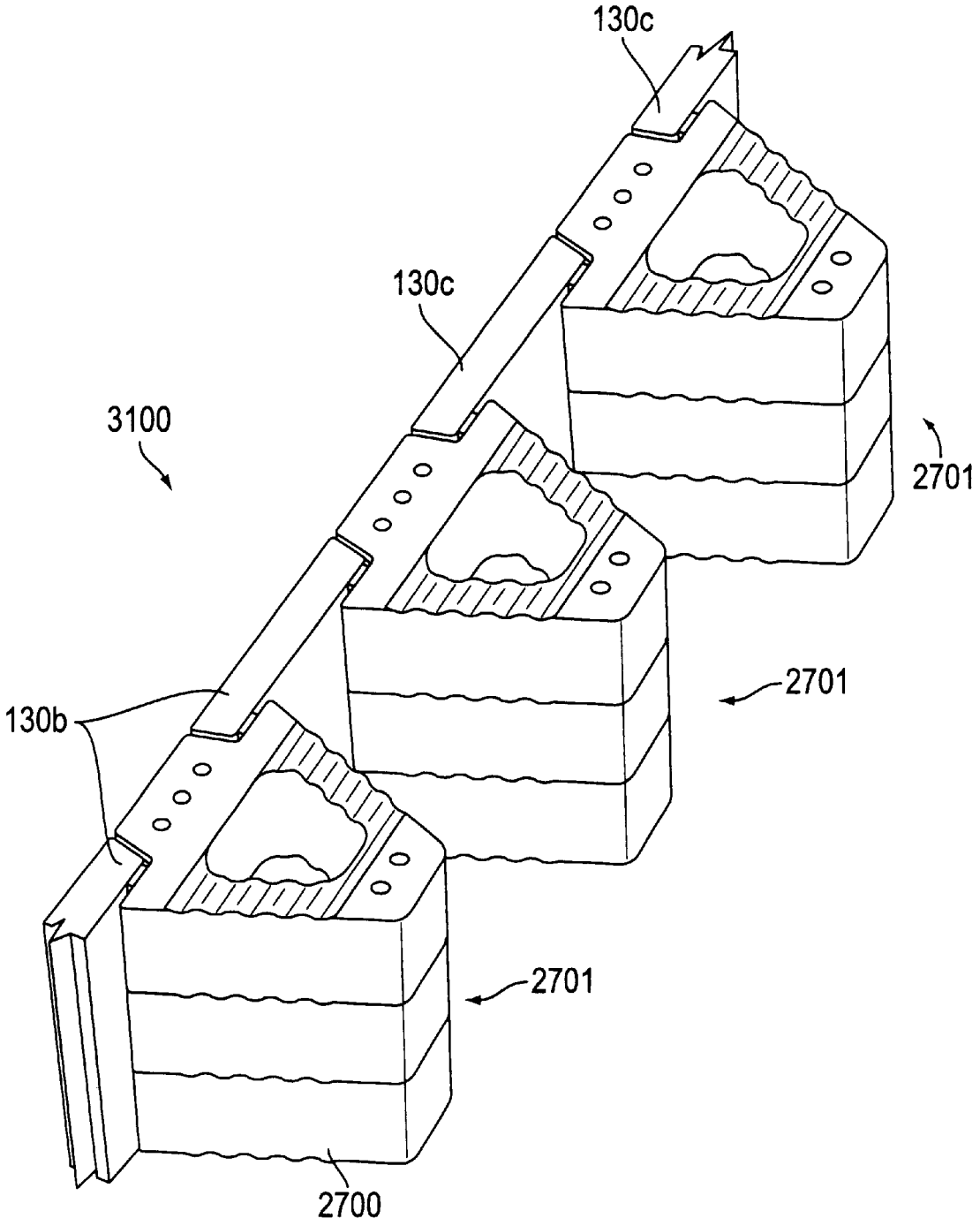
FIG. 33 is a perspective partial view of an alternative embodiment of a modular construction according to the present invention and employing the header of FIGS. 27*a* and 27*b*.

Referring to FIGS. 28–33, various configurations of a modular construction are depicted using header units 2700. The partial view of a modular construction shown in FIGS. 28–29 depicts header units 2700 using active reinforcement elements 115 both internally (i.e., within the passthrough ducts 2716) and external to the header unit 2700. There is a shotcrete panel 130*d* disposed between adjacent header stacks 2701. FIGS. 30 and 31, depict the use of pre-cast panels 130*b* in between the header stacks 2701 and the use of both internal and external active reinforcement elements 115. FIGS. 32 and 33 depicts the use of CIP panels 130*c* between header stacks 2701.

Referring now to FIGS. 24*a*–26*b*, the systems in the above embodiments can also be arranged with corner closure stacks 2401 for situations in which the retaining wall 800 must be constructed in other than a straight line. The corner closure stacks 2401 comprise a plurality of corner closure units 2400 and a second active reinforcement element 2115 configured to cooperate with the corner closure stack 2401 so that post-tensioning the second active reinforcement element 2115 imparts a corresponding prestressing force into the corner closure stack 2401. Each corner closure unit 2400 comprises a body element 2412 having a top face 2412*a* and a bottom face 2412*b* and a junction element 2414 having a top face 2414*a* and a bottom face 2414*b*. The junction element 2414 is preferably disposed at one end of the body element 2412 and may be integrally formed with the body element 2412. The body element 2412 is essentially identical for different embodiments of the corner closure units 2400. The junction element 2414, however, will vary in configuration depending upon the use of the corner closure stack 2401. For example, the junction element 2414 can be utilized with either an internal, or included angle 2422 as shown in detail in FIGS. 24*b* and 25*b* or an external, or excluded angle 2424 as shown in FIGS. 24*c* and 25*c*. The included angle 2422 and excluded angle 2424 can also be seen in FIGS. 24*d*, 25*d*, and 26*a*. The junction element 2414 extends from the body element 2412 in an angular configuration in order for it to receive the secondary structural members 130 from the header stacks 101, 2701 to which it is adjacent or between. The junction elements 2414 may extend outwardly at any angle, but are preferably configured to form angles of 90 degrees as in FIG. 24*b*, 270 degrees as in FIG. 24*c*, 135 degrees as in FIG.

Figure 25A:
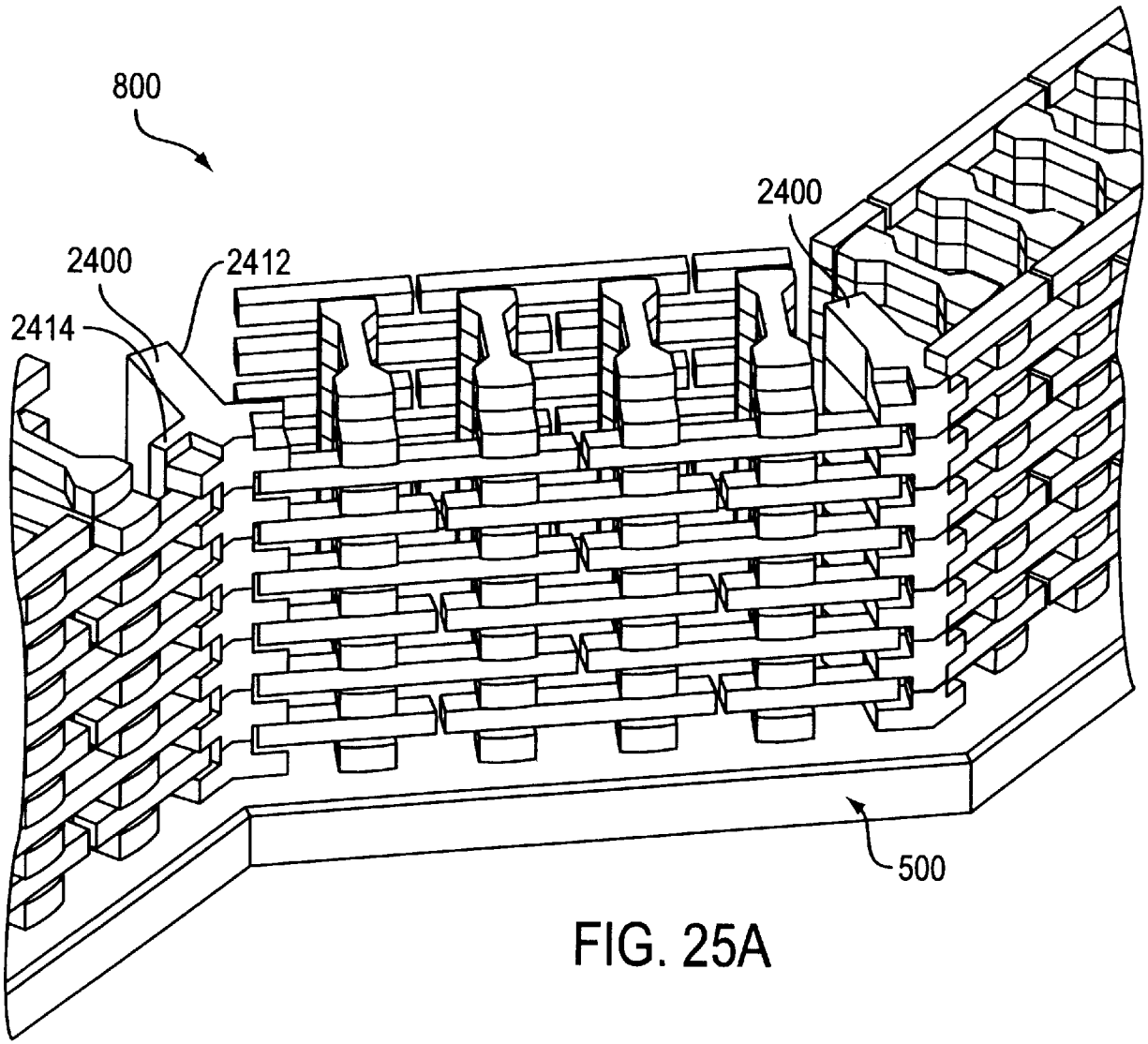
FIG. 25*a* is a perspective view of an exemplary modular construction according to the present invention depicting the use of an alternative embodiment of corner stacks.
Figure 25B:
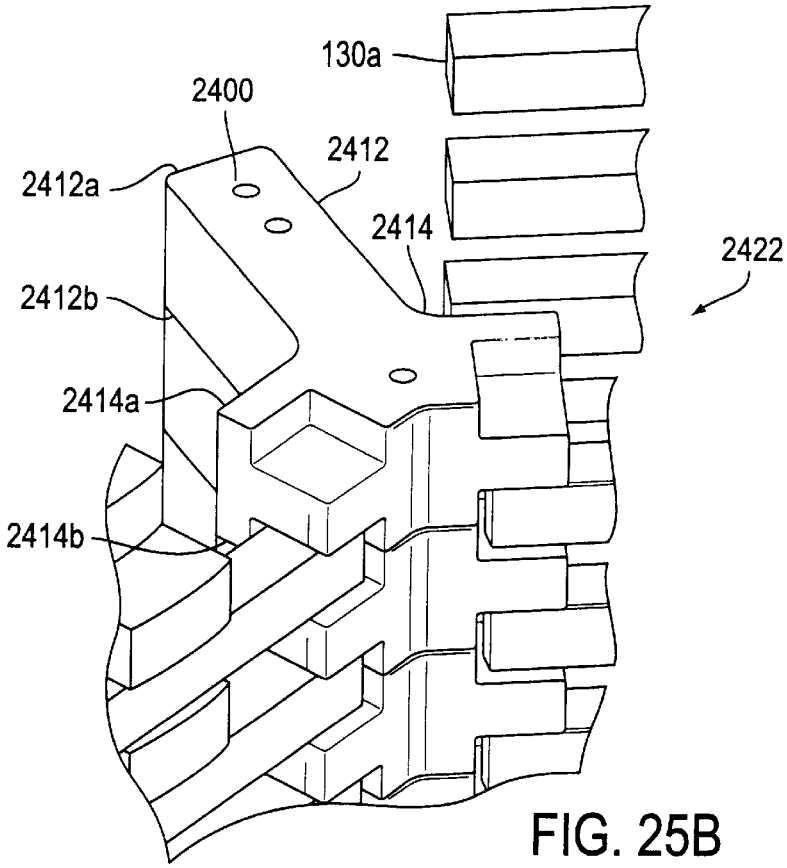
FIG. 25*b* is a detailed view of an alternative exemplary corner closure unit according to the present invention.
Figure 25C:
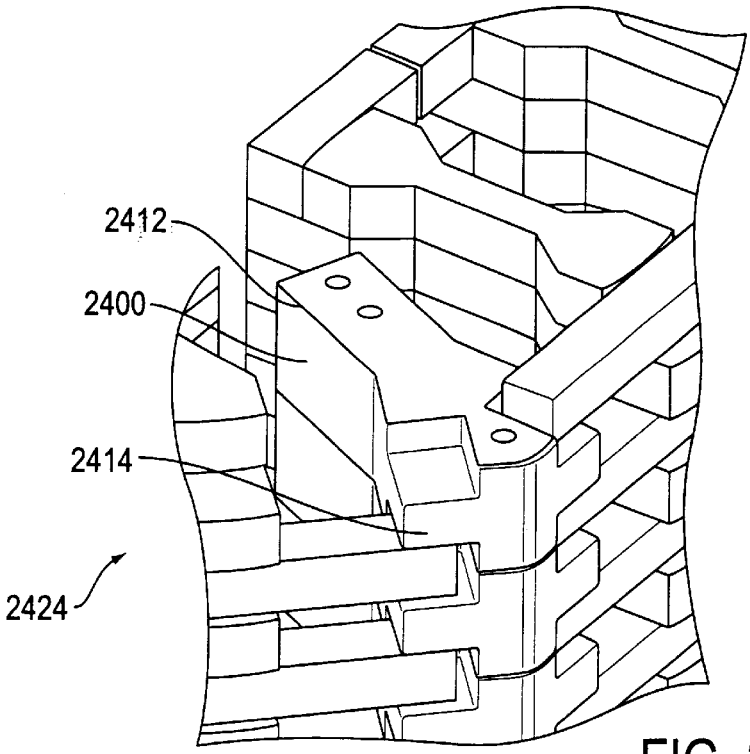
FIG. 25*c* is a detailed view of an alternative exemplary corner closure unit according to the present invention.
Figure 25D:
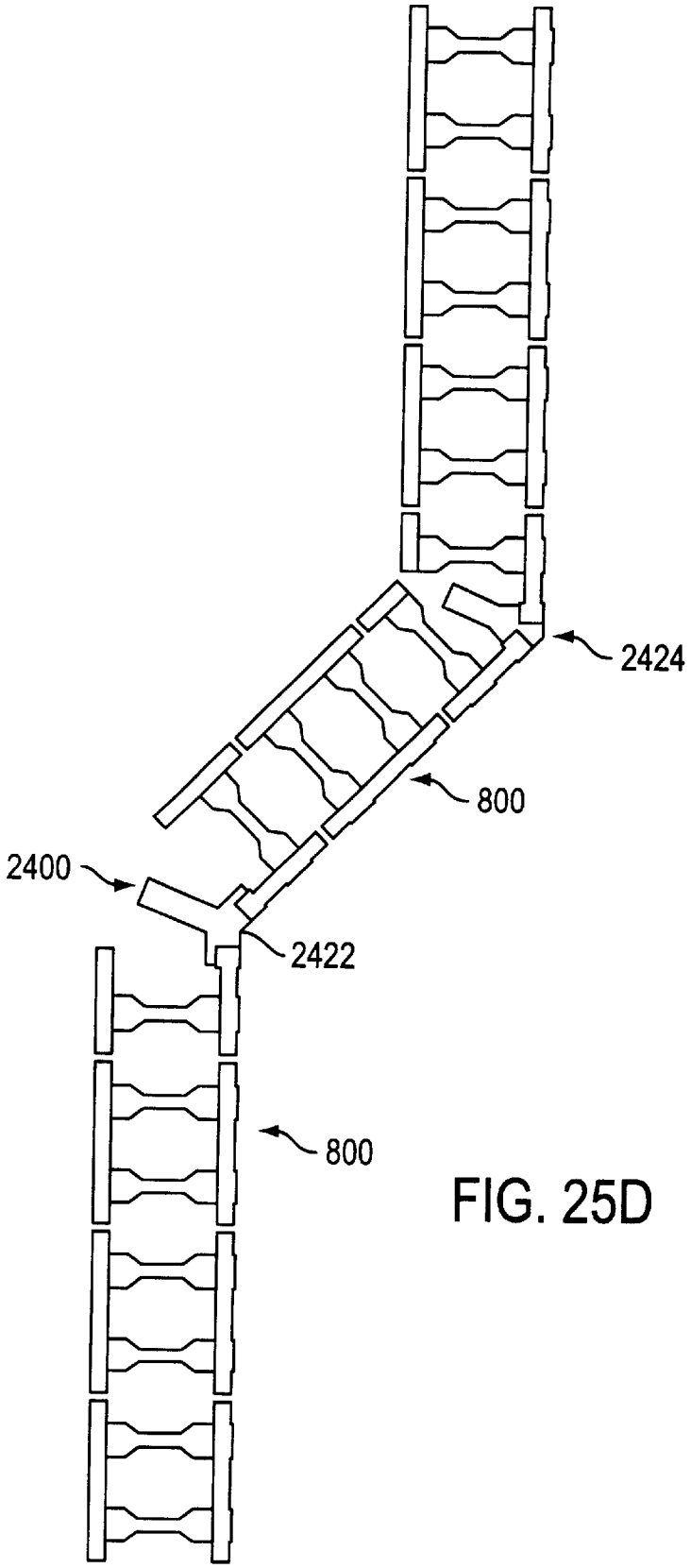
FIG. 25*d* is a top plan view of the modular construction in FIG. 25*a* and employing the corner closure units in FIGS. 25*b* and 25*c*.

25*b*, and 225 degrees as in FIG. 25*c*. The angle that is chosen will be dependent upon numerous design considerations including the spacing between the header stacks 101, 2701 and the corner closure stacks 2401 as well as the dimensions of the header units 110, 2700 and corner closure units 2400. The corner closure units 2400 are configured similar to the header units 110, 2700 in that they are similarly provided with shear keys (not shown) (e.g., protrusions and indentations or first and second corrugations) and passthrough ducts 2416. The corner closure stack 2401 may similarly be provided with external harping elements 1910 to receive external active reinforcement elements 115. Passthrough ducts 2416 may also be configured to receive longitudinal passive reinforcement elements 115*p*.

The corner closure stacks 2401 are coupled to the header stacks 101, 2701 by the structural members 130. Preferably, the structural member 130 is disposed between junction elements 2414 of adjacent corner closure units 2400. The corner closure units 2400 preferably comprise recessions 2402 in the junction element 2414 that are half the height of a typical stretcher 130*a* (see, for example, FIGS. 24*b*, 24*c*, 25*b* and 25*c*). In this regard, the stretcher 130*a* is enclosed within the adjacent junction elements 2414. The recession 2402 in the junction element 2414 could also be equal to the height of the secondary structural elements 130.

Figure 24A:
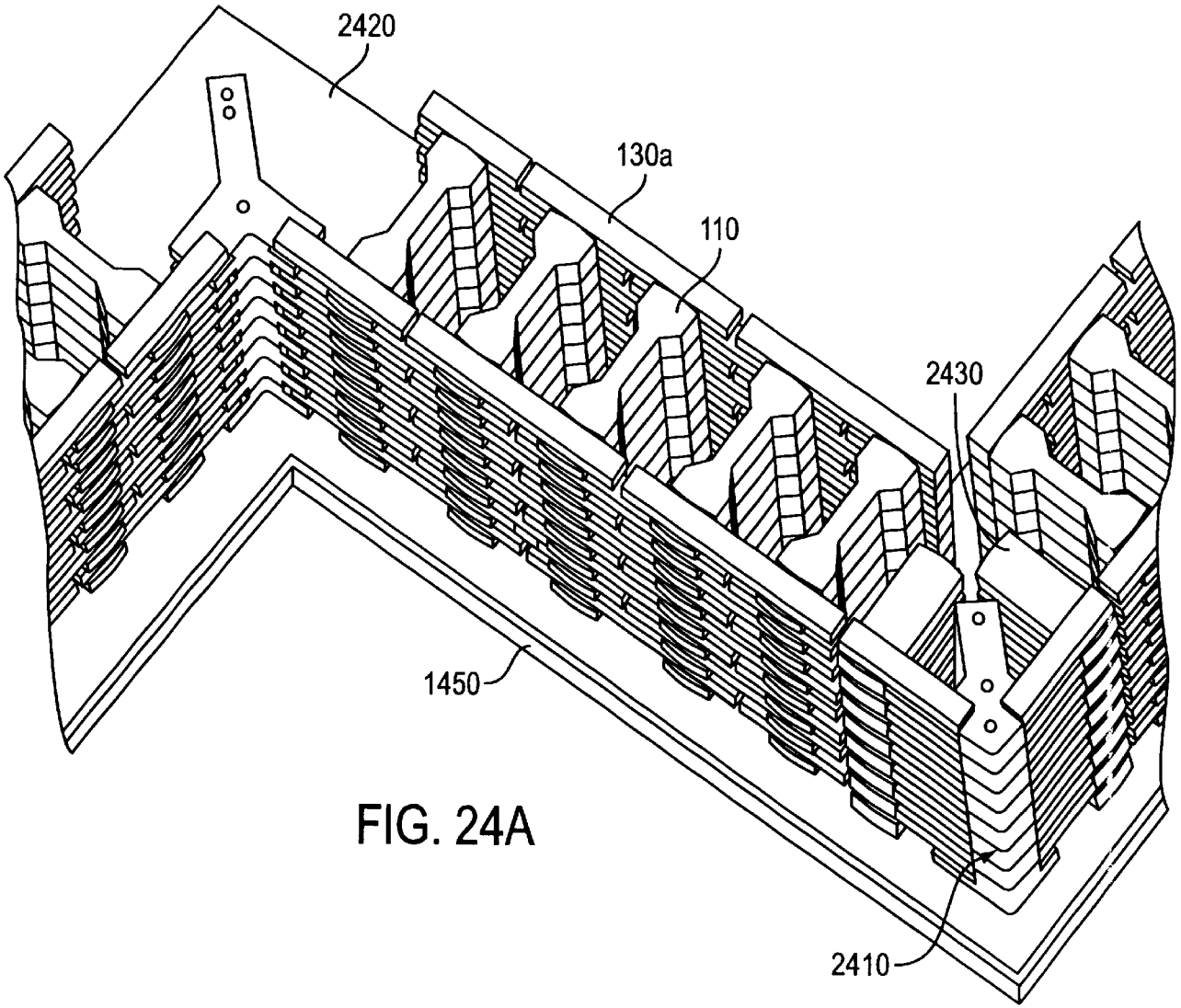
FIG. 24*a* is a perspective view of an exemplary modular construction according to the present invention depicting the use of corner stacks.
Figure 24B:
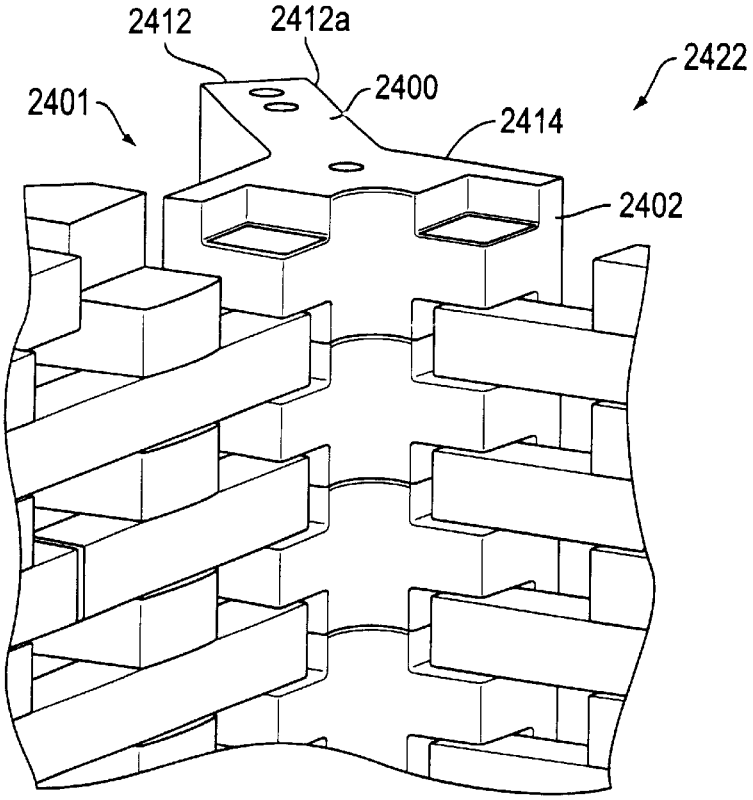
FIG. 24*b* is a detailed view of an exemplary corner closure unit according to the present invention.
Figure 24C:
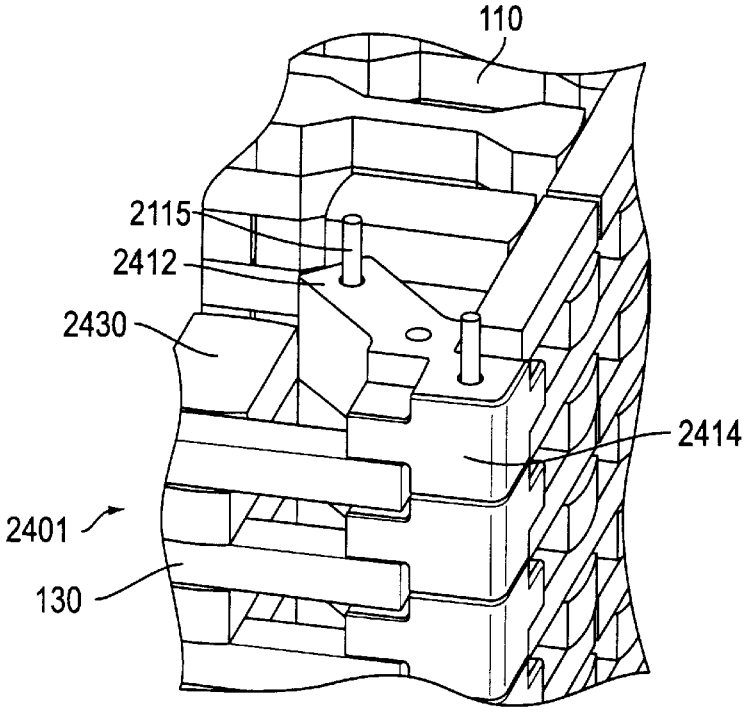
FIG. 24*c* is a detailed view of an alternative exemplary corner closure unit according to the present invention.
Figure 24D:
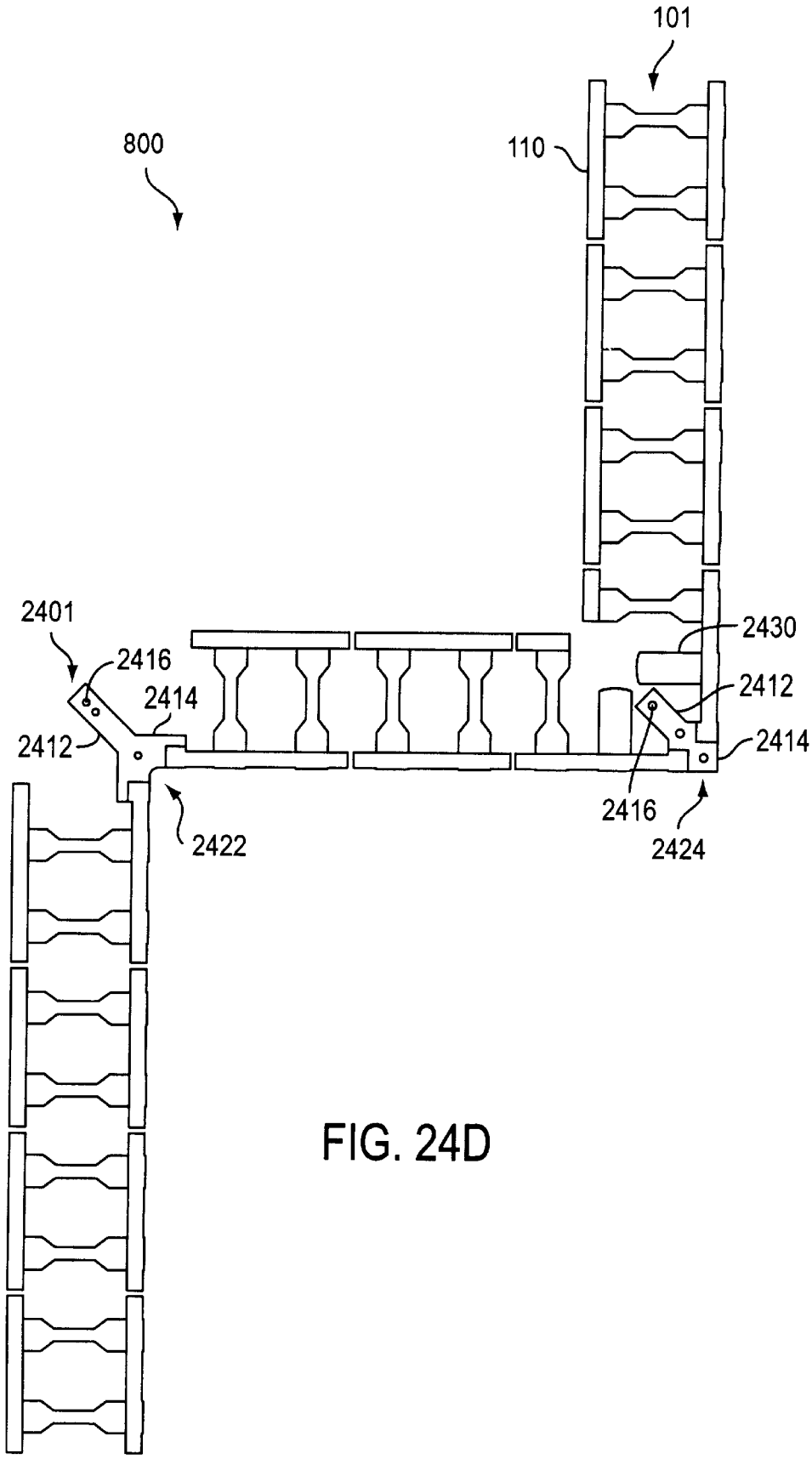
FIG. 24*d* is a top plan view of the modular construction in FIG. 24*a* and employing the corner closure units in FIGS. 24*b* and 24*c*.

In order to close any large gaps that may result in a construction as a result of using the corner closure stacks 2401, an augmenting stack 2430 can be provided such as shown in FIG. 24*a* and FIG. 24*d*. The augmenting stack 2430 is essentially provided to, as the name suggests, augment the modular construction. The augmenting stack 2430 can be comprised of a scaled down version of the header units 110 such that it is able to fit within the space constraints created by the corner closure stack 2401 and the adjacent header stack 101.

Figure 26A:
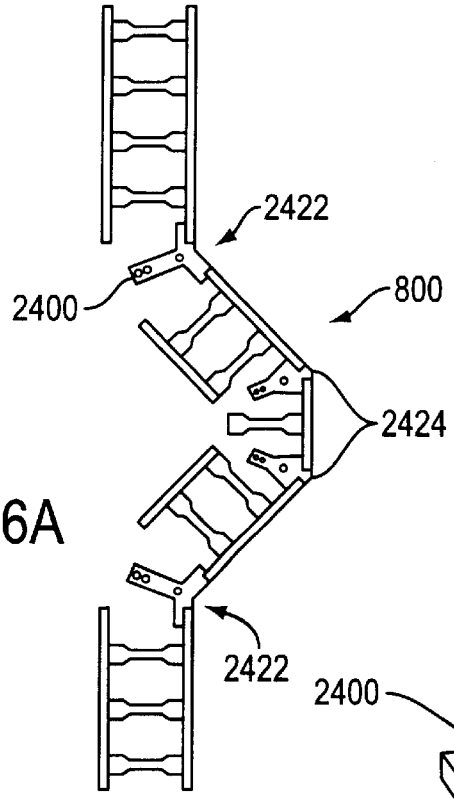
FIG. 26*a* is a top plan view of an alternative embodiment of a modular construction according to the present invention employing corner stacks.
Figure 26B:
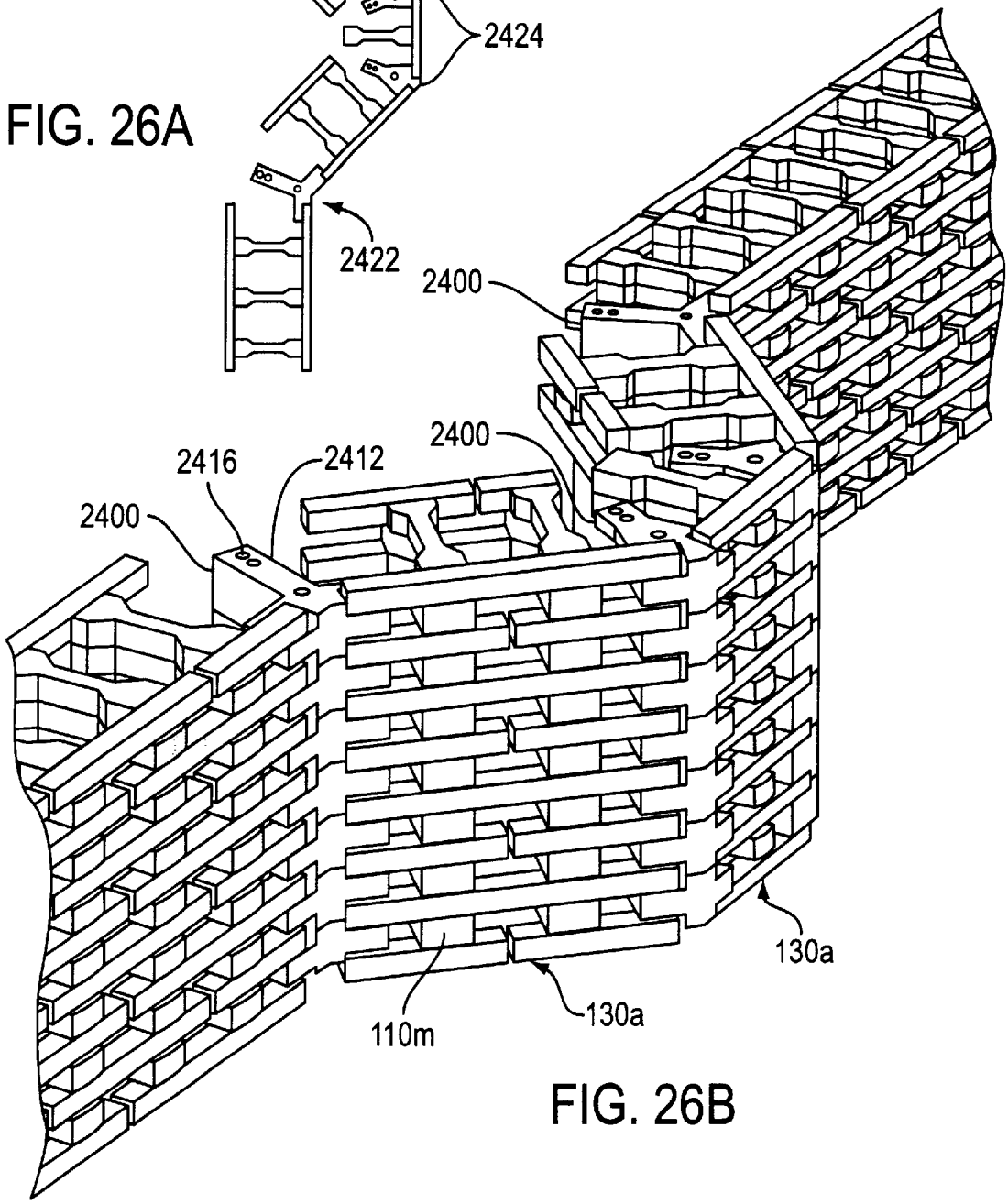
FIG. 26*b* is a perspective view of the modular construction of FIG. 26*a*.

FIGS. 24*a*, 25*a*, and 26*b* depict the use of the various corner closure stacks 2401 and augmenting stacks 2430. Each modular construction can make use of a variety of corner closure units 2400.

Referring now to FIGS. 8–10, an exemplary modular construction 800 of the present invention is depicted. The pre-stressed modular construction 800 comprises a plurality of header stacks 101 with a plurality of structural members 130 coupled to at least one of the header stacks 101. The header stacks 101 are comprised of a plurality of stacked header units 110. There is also preferably at least one active reinforcement element 115 for each of the header stacks 101 with each active reinforcement element 115 being configured to cooperate with its header stack 101 so that post-tensioning the pre-stressing tendon 115 prior to application of the applied load imparts a corresponding pre-stressing force into its header stack 101 at at least one lock-off point 111. In a possible alternative embodiment, the active reinforcement elements 115 are not post-tensioned, thereby providing a vertically disposed passive reinforcement element. The modular construction is formed on foundation 500.

Referring to FIG. 12, an alternative modular construction is shown. The modular construction of FIG. 12 uses cast-in-place concrete panels 130*c* between header stacks 101.

Figure 22:
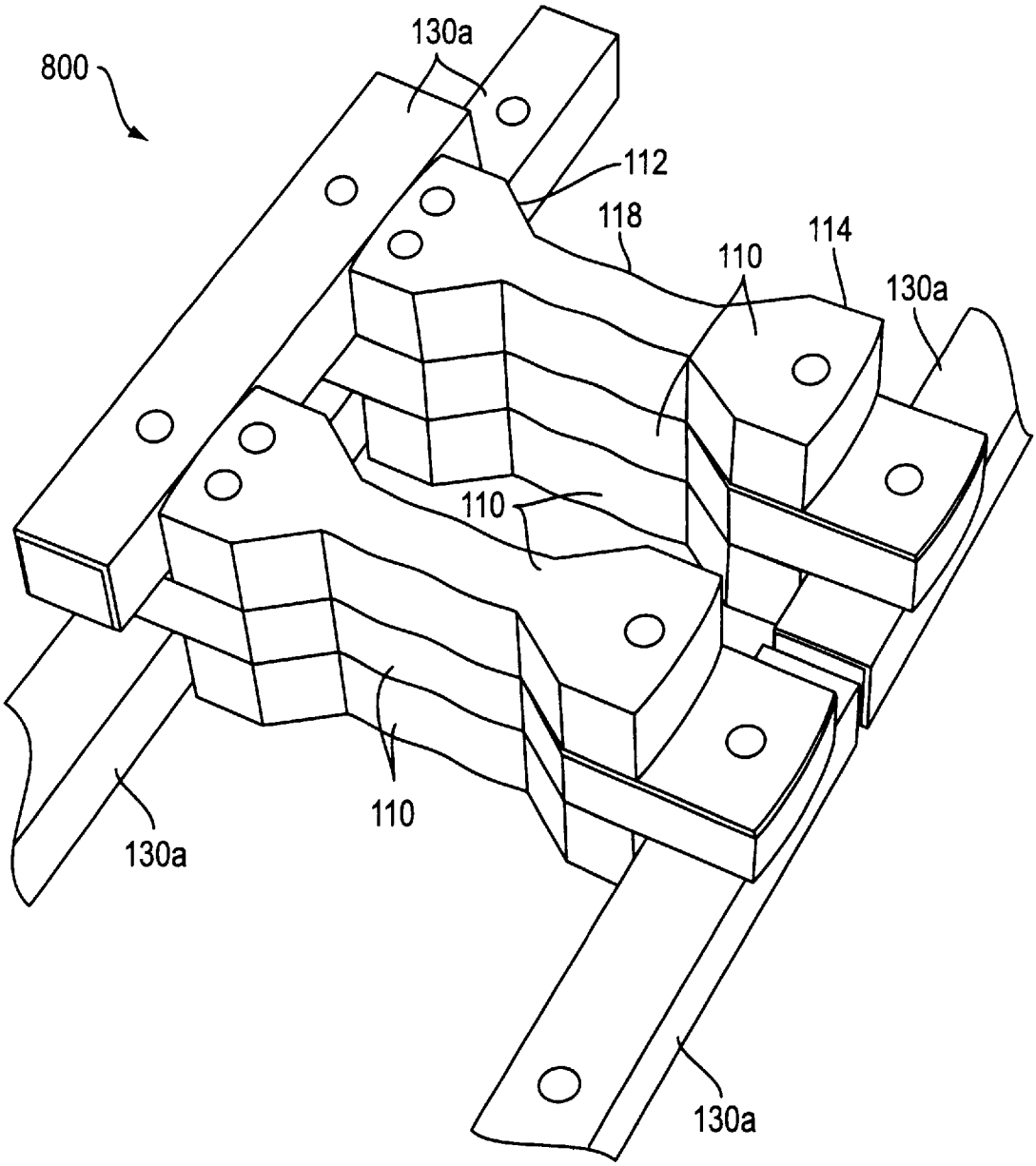
FIG. 22 is a perspective view of a partial modular construction employing the exemplary headers in FIGS. 21*a*, 21*b*, 21*c*, and 21*d*.
Figure 23:
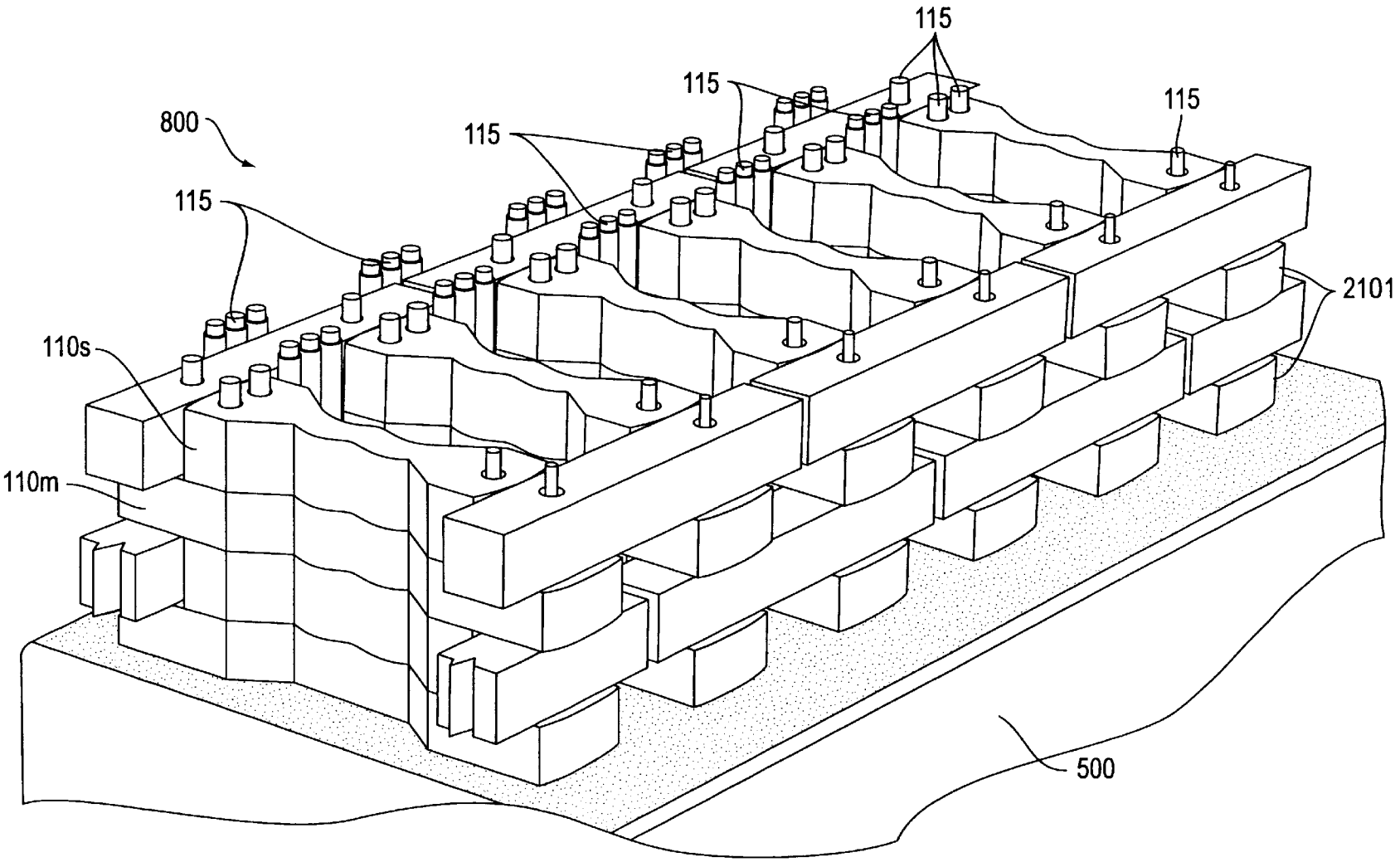
FIG. 23 is a perspective view of a modular construction employing the exemplary headers in FIGS. 21*a*, 21*b*, 21*c*, and 21*d*.

In another aspect of the invention, a pre-stressed modular construction 800 for retaining or supporting an applied load is provided. With reference now to FIGS. 22 and 23, the pre-stressed modular construction 800 comprises a plurality of header stacks 101 with a plurality of structural members 130 coupled to at least one of the header stacks 101. The header stacks 101 of the modular construction 800 are configured as described in the above embodiments. Either type of header unit 2700, 110 described previously may be utilized to form a modular construction 800 according to the present invention.

The pre-stressed modular construction 800 preferably comprises at least two header stacks 2701, 101, wherein each of the header stacks 2701, 101 being comprised of a plurality of stacked header units 2700, 110. There is also preferably at least one active reinforcement element 115 for each of the header stacks 2701, 101, with each active reinforcement element 115 being configured to cooperate with its header stack 2701, 101 so that post-tensioning the active reinforcement element 115 prior to application of the applied load imparts a corresponding pre-stressing force into its header stack 2701, 101 at at least one lock-off point 111. As noted above, a preferred active reinforcement element is a pre-stressing tendon such as the tendons shown in, for example, FIGS. 1–4, 23, and 28–32. There is also a structural member 130 coupled to the at least two header stacks 2701, 101. The pre-stressed modular construction 800 further preferably comprises a tieback transfer beam 1100 disposed between two of the header units 2700, 110 and extends between the at least two header stacks 2701, 101. There is also a ground anchor 1115 coupled to the tieback transfer beam 1100. The structural member 130 can be a concrete stretcher 130*a*, a pre-cast concrete panel 130*b*, a cast-in-place concrete panel 130*c*, or a shotcrete panel 130*d*.

Figure 14A:
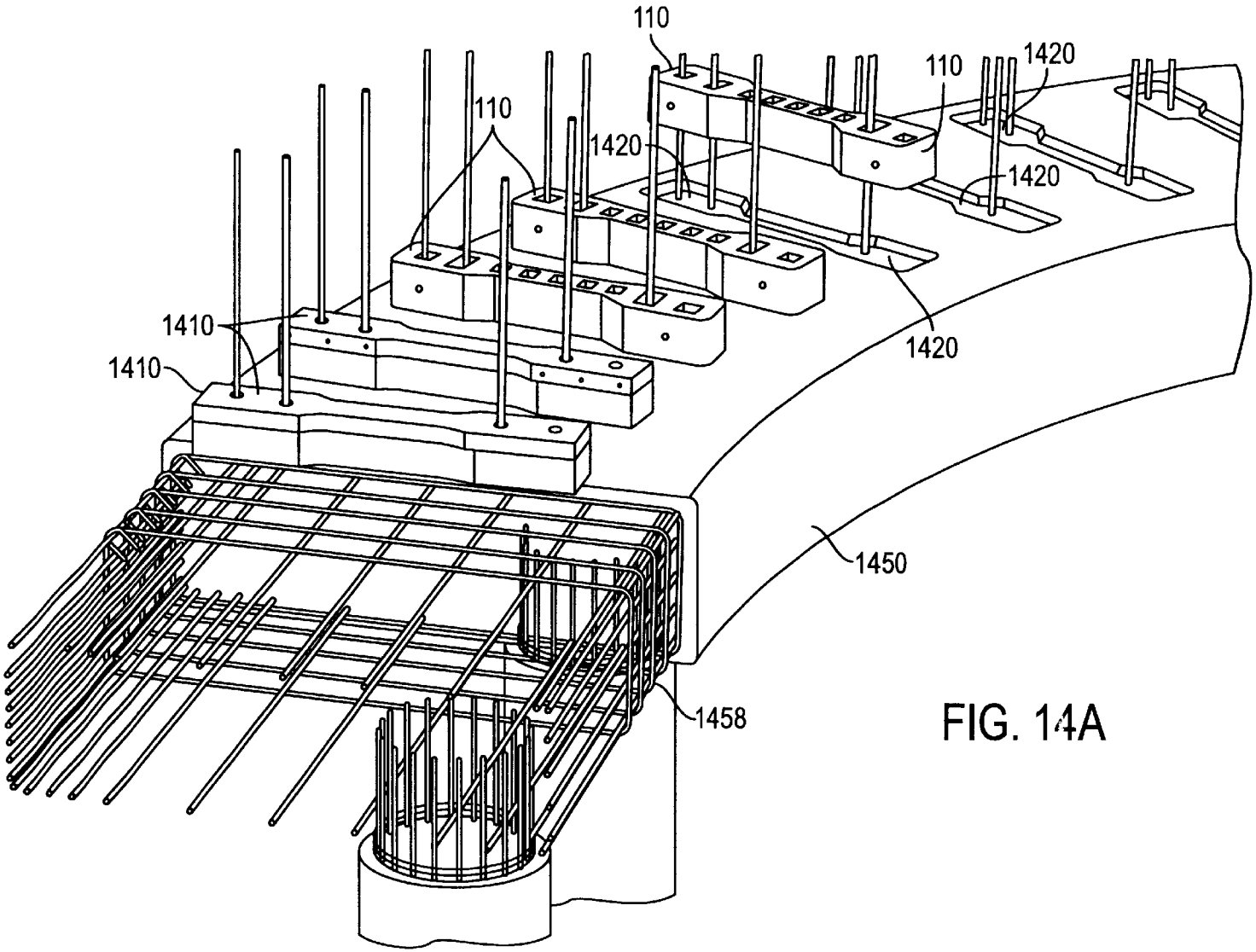
FIG. 14*a* is a perspective view of a partial modular construction according to the present invention.
Figure 14B:
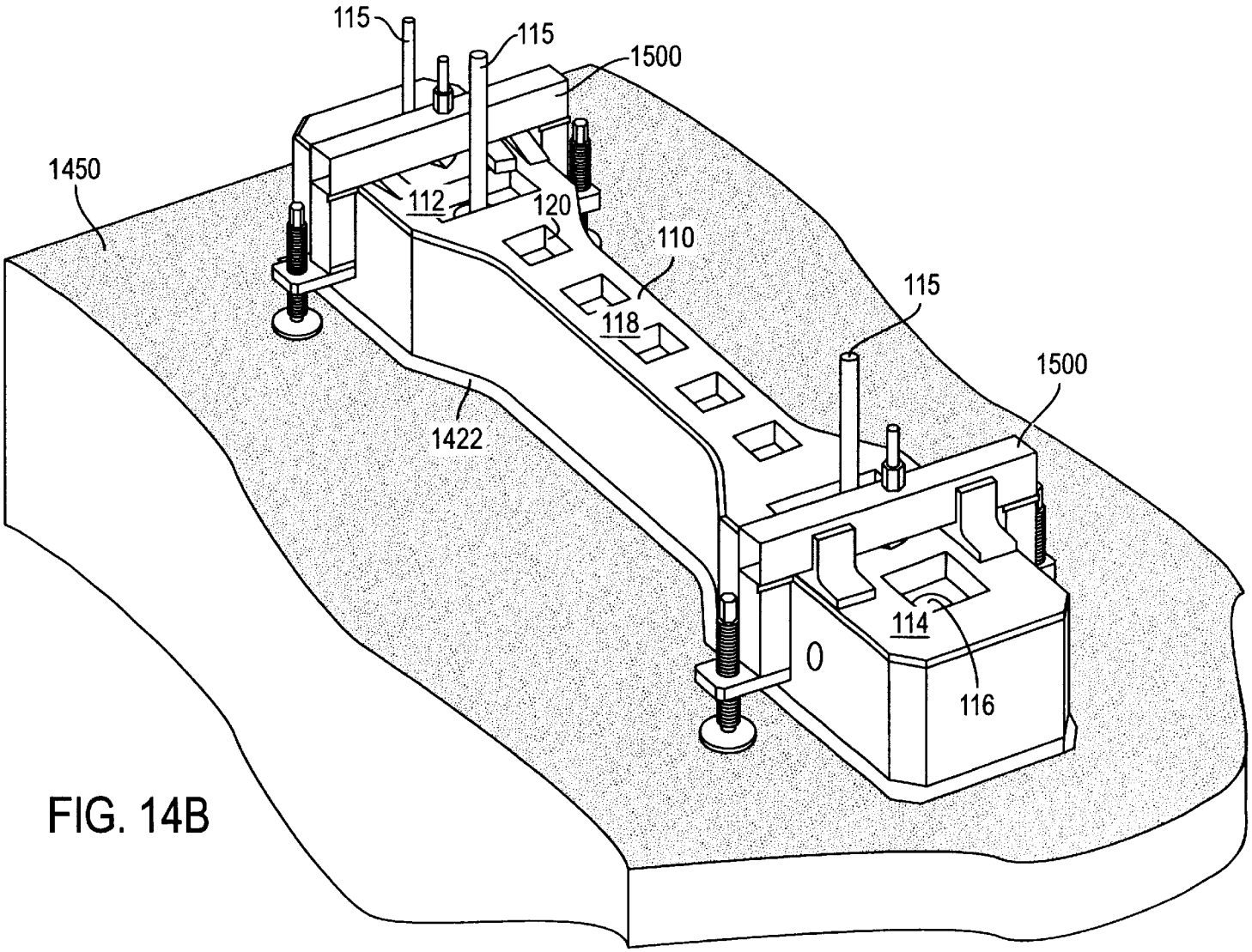
FIG. 14*b* is a perspective view of an exemplary header in a partial modular construction according to the present invention.

In another aspect of the invention, a method of fabricating a pre-stressed modular construction 800 for retaining or supporting an applied load is provided. A foundation element 1450, 500 is first provided for the construction. On a site-by-site basis, the foundation element 1450, 500 may be augmented by other structural elements, such as ground anchors, piles, or other supporting/restraining elements, that assist the foundation element 1450, 500 in resisting the forces that are transmitted to it by the retaining and support structural system of the present invention. Referring to FIGS. 14*a* and 14*b*, one possible manner in which the "first", or "base", header unit (a header unit 110, in the case of these illustrative Figures) is provided for, positioned, and connected to the foundation element is shown. Particularly, the foundation element 1450, 500 is cast under and around a suspended header form 1410 which is shaped such that it is compliant with the base header unit 110, which is the first unit in the assembly of the header stack 101, but is dimensioned slightly larger, sufficient to facilitate the correct flow and placement of the adhesive/filler grout forming and facilitating the correct connection between header unit 110 and foundation element 1450, 500. The header forms 1410 are preferably constructed from a high strength material, resilient and abrasion resistant, such as polypropylene, which material may be augmented internally with a strengthening and/or stiffening frame. The header forms 1410 also serve to situate the passthrough tendons, or active reinforcement elements 115 in place for formation of the foundation element 1450, 500. Where longitudinal passive reinforcement elements 115*p* are being installed in conjunction with the header stack 101, the header forms 1410 also will situate such reinforcement elements 115*p*. The foundation element 1450, 500 is cast under and around the forms 1410 and when the foundation element 1450 cures sufficiently, the header forms 1410 are removed, leaving a recess pattern 1420 in which to place/suspend the header units 110. The header units 110 are placed in the recess pattern 1420, leaving an annular space 1422 around and beneath the header unit 110. The annular space is best seen in FIG. 14*b*. The annular space 1422 is then filled with a grout or epoxy (not shown) which holds the header unit 110 in place, and provides the appropriate connection between the header unit 110 and the foundation element 1450, 500. The header units 110 must be situated on the foundation element 1450, 500, such that they are as close to perfectly horizontal as possible as they are the header units on which the header stacks and, hence, the entire construction 800 is built. In particular, the parallel top and bottom flat surfaces of this "base" header unit 110 must be horizontal as defined by and with respect to the direction which is both perpendicular to the front-to-back axis of the header unit 110 and perpendicular to the longitudinal axis of the header stack being constructed. Alternatively, the normal to the parallel top and bottom flat surfaces of the "base" header unit 110 must be parallel to the axis of the header stack being assembled, whose axis must be in a vertical plane and which vertical plane is perpendicular to the plan curve of construction of the retaining wall, which curve may be a straight line. A very small deviation from this particular requirement would be unacceptable because the deviation would be grossly amplified in a header stack 101 of any significant height. Specifically designed and manufactured construction temporary support equipment 1500 is used to position and then secure the header unit 110 in place while the grout, or other connecting agent, cures. Where header stack construction is being continued on and above a complementary structural element 1100, an identical or similar procedure may be followed for the preparation for and positioning of the "first" or "base" header unit on and the connection to such complementary element 1100. Further, such header forms may be used to locate the passthrough ducts that are employed in conjunction with any active reinforcement elements 115 and/or passive reinforcement elements 115*p* as are structurally associated with the header stack 101. This process, specifically employing a header form, which is aimed at the correct and rapid set-up of the first or base header unit on a foundation element 1450, 500, or complementary structural element 1100, comprises an essentially identical alternative for each of the various header types 110, 2700 which comprise the collection of header units of the present invention.

The placing of the "first" or "base" header units 110 on the foundation element 1450, 500 may also be accomplished without the header forms 1410. In such a situation, construction equipment 1480 (see, for example, FIGS. 15*a* and 15*b*) would be utilized to hold a header unit 110 in a correct location, possessing correct spatial orientation, suspended above the reinforcement 1458 of the foundation element 1450, 500 and the foundation 1450 concrete would be cast beneath and around it. That is, as determined by the project design, the cast-in-place concrete of the foundation element 1450, 500, may encroach up the walls of the first, or base, header unit 110 for various job-specific reasons. Again, little tolerance for error is allowed, the header unit 110 must be horizontal. In particular, the parallel top and bottom flat surfaces of this "base" header unit 110 must be horizontal as defined by and with respect to the direction which is both perpendicular to the front-to-back axis of the header unit 110 and perpendicular to the longitudinal axis of the header stack being constructed. Alternatively, the normal to the parallel top and bottom flat surfaces of the "base" header unit 110 must be parallel to the axis of the header stack being assembled, whose axis must be in a vertical plane and which vertical plane is perpendicular to the plan curve of construction of the retaining wall, which curve may be a straight line. Because of these positioning requirements the construction equipment 1480, 1500 is sufficiently robust and both capable of fine adjustment and of maintaining such positional settings during the full process and activities of construction to which such equipment will be subjected. Either method for positioning the first or base header unit 110 on the foundation element 1450, 500 can also be used in positioning the first or base header units 110 on the tieback transfer beams 1100, or other type of complementary structural element 1100. This process, specifically suspending a header unit 110, which is aimed at the correct and rapid set-up of the first or base header unit on a foundation element 1450, 500, or complementary structural element 1100, comprises an essentially identical alternative for each of the various header types 110, 2700 which comprise the collection of header units of the present invention. A plurality of header stacks 101 are constructed on the foundation element 1450, 500 with each header stack 101, 2701 comprising a plurality of header units 110, 2700. The header units 110, 2700 are those previously described. An active reinforcement element 115 is coupled to each header stack 2701, 101 and is post-tensioned such that it imparts a corresponding prestressing force into the header stack 2701, 101. A passive reinforcement element 115*p* may be provided within and through the passthrough ducts of the header units to structurally work in conjunction with the active reinforcement elements 115, which passive reinforcement elements 115*p* augment the structural performance contribution of active reinforcement elements 115. Such passive reinforcement element 115*p*, where included within the header stack construction, is made to work in conjunction with the header stack via bond, which bond is provided via the grouting of the space about the passive reinforcement element 115*p* and within the passthrough duct housing such element 115*p*.

The construction of the header stacks 2701, 101 comprises stacking a plurality of header units 2700, 110 on the foundation element 1450, 500. It is desired to pre-position the active reinforcement element 115 in the foundation element 1450, 500. In such a configuration, the header units 2700, 110 are then fed over the active reinforcement elements 115, the active reinforcement element 115 passing through a passthrough duct 116, 2716. The active reinforcement element 115 is then secured to the header stack 2701, 101 as previously described. In an embodiment of the invention, a harping element 1910 is coupled to the header stack at a harping point 1905 such that the active reinforcement element 115 is disposed external to the header stack 101 and is redirected at the harping point 1905 such that the active reinforcement element 115 forms a series of substantially straight segments 1901, 1902, 1903.

Note that any of the header units 2700, 110 described above can be utilized with the method of construction of the present invention.

To describe some possible applications and to express the flexibility of the system of the present invention, the following examples are given. It is to be understood that the details in the examples are simplified to describe the primary factors involved in such modular constructions as described. As would be apparent to one of ordinary skill in the art, other factors may affect the design considerations. These examples should not represent any limitation on the present invention. Corresponding reference numerals will be used where appropriate.

Referring to FIGS. 34*c*, 34*d*, and 34*e*, the flexibility of the systems of the present invention is depicted. FIG. 34*c* depicts a structure 3490 being support by a retaining wall 800 which incorporates header stacks 2701, and a complementary structural element 1100. The structure 3490 in FIG. 34*c* is configured to protect the roadway 3500 below from falling debris. There is a shield 3495 which protects the primary shield or structure 3490. Note that the roadway is supported by a structure such as those described with reference to FIG. 34*b*. The structure 3490 in FIG. 34*e* is an elevated roadway that could be constructed in highly congested areas. Element 3495' in FIG. 34*e* is a support structure for the elevated roadway 3490.

The structure 3510 depicted in FIG. 34*d* is suspended primarily through the use of complementary structural elements 1100. Such a structure illustrates the vast range of uses of the system of the present invention.

Referring to FIGS. 34*g* and 34*h*, and FIGS. 34*m* and 34*n*, another application of the systems of the present invention is shown. The need to simultaneously provide support for the ends of a bridge and to retain the soil mass at those locations is a common problem in highway engineering. The structure that provides for these requirements is commonly known as a bridge abutment 3401. Specifically, the abutment 3401 transmits the reactions from the bridge superstructure (e.g., girders) 3402 to the foundation system 3410 and, secondly, retains the soils comprising the earth embankment of the approach roadway.

The different restrictions and requirements that can occur at these abutment locations are numerous. However, the systems of the present invention provide a wide array of options, from which the design engineer may choose, in developing a competent solution meeting the demands of any given bridge site.

The situation that is addressed in FIGS. 34*g*, 34*h*, 34*m* and 34*n* is one where a new freeway system is being pushed through an area that also demands overpass bridges to serve local transportation needs. It has been determined, because of the local peculiarities of the area, that the freeway may be constructed at reduced elevation, with a series of simple overpass bridges. Further, because of restricted right-of-way, the design calls for vertical retaining walls on either side of the freeway. This example demonstrates the use of the embodiment of the header units 110 described above and depicted in FIGS. 1–5 and FIGS. 22 and 23 in the construction of the necessary retention and support structure.

What is further demonstrated, is the ready inclusion of the overpass bridge abutment. The construction of the bottom slab and the end return walls of the abutment is aided by the use of the same equipment used for the construction of Tieback Transfer Beams (TTBs) and capping beams, which also are used on either side of this abutment.

Figure 34G:
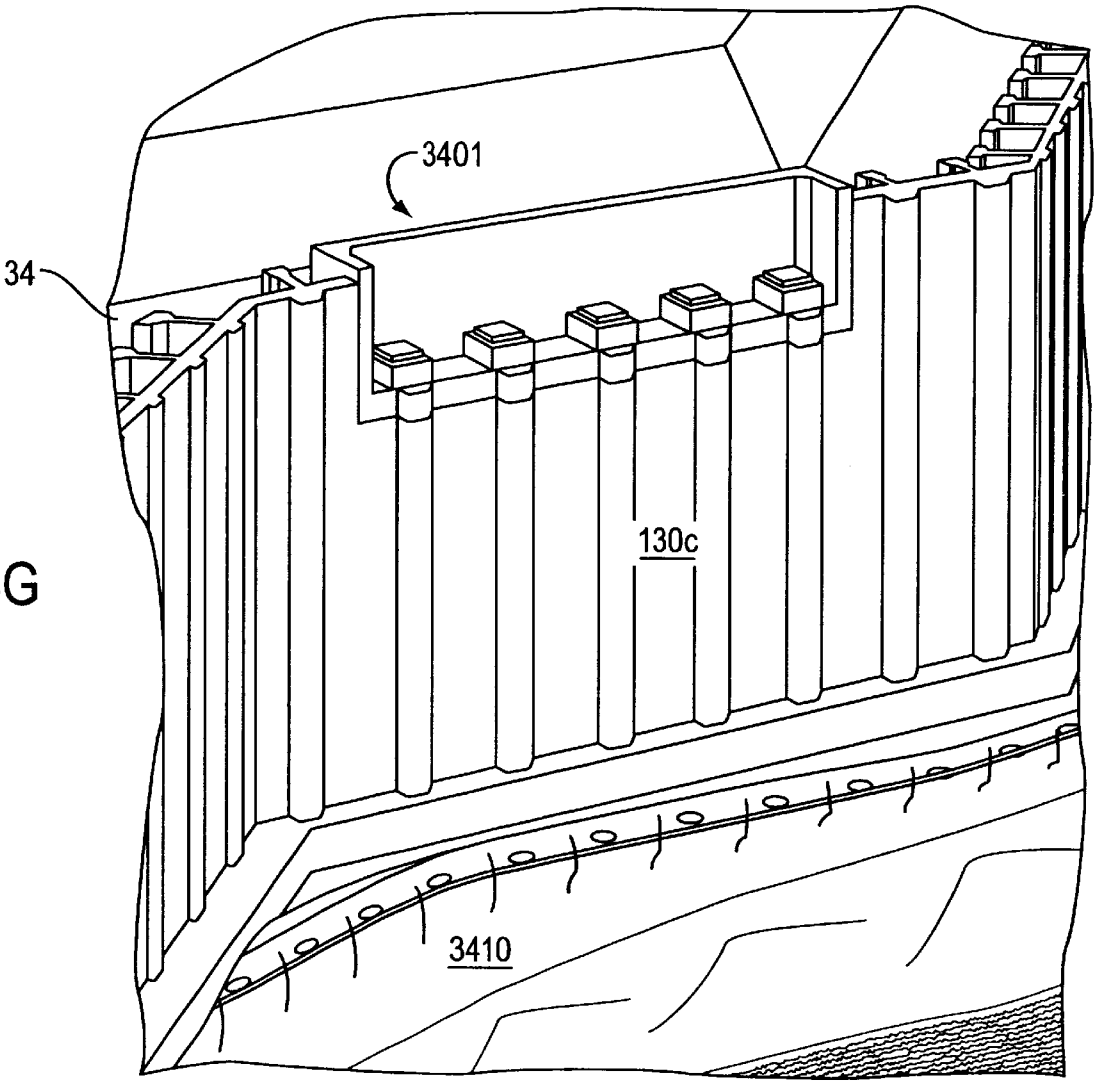
FIG. 34*g* is a perspective view of an exemplary application of the system of the present invention.
Figure 34H:
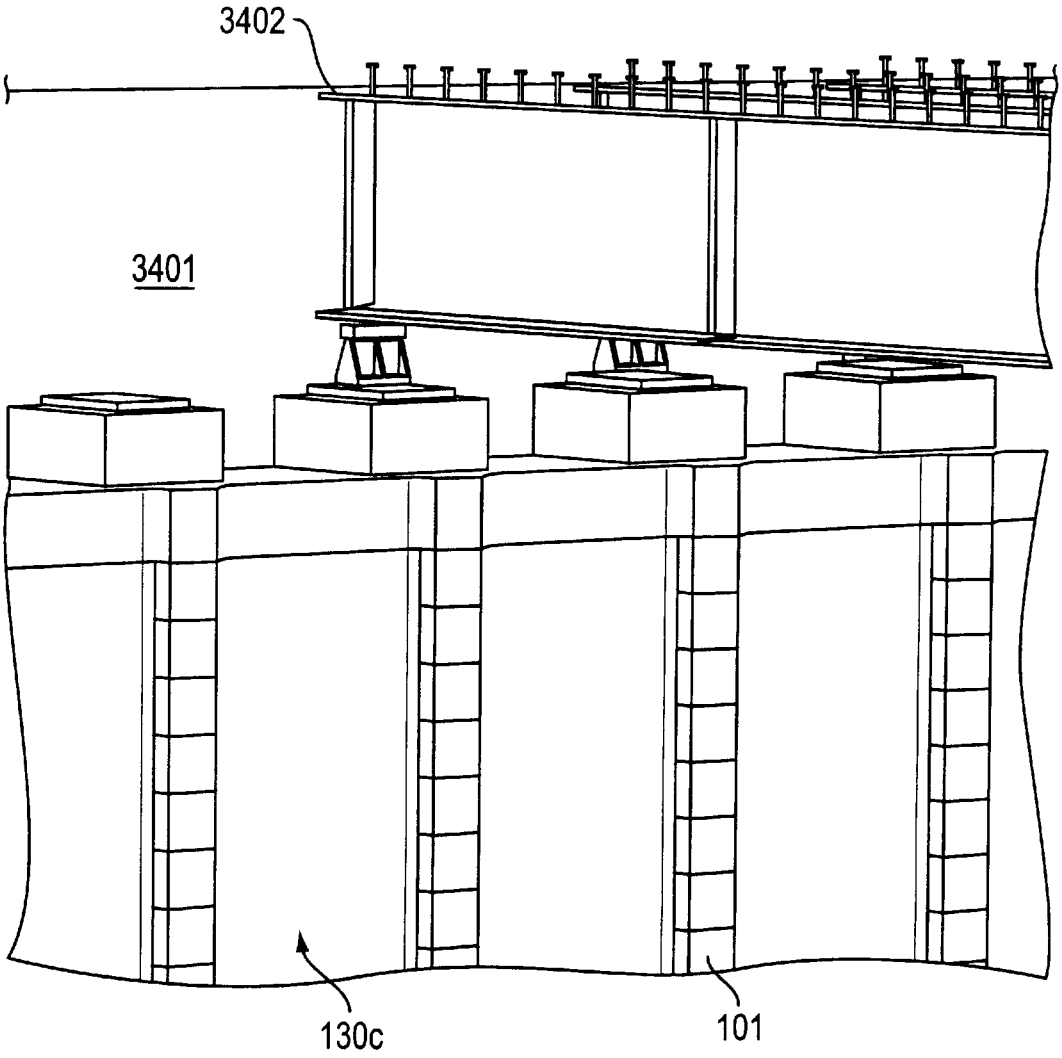
FIG. 34*h* is an enlarged perspective view of a portion of the system of FIG. 34*g*.

FIG. 34*g* shows a general overview of an included abutment 3401. FIG. 34*h* shows a close-up of the abutment 3401 structure seated on the modular construction of the present invention, with some of the overpass steel-plate girders 3402 being lifted into position. FIGS. 34*m* and 34*n* show a construction similar to that in FIGS. 34*g* and 34*h*, but include an alternative embodiment of the header stacks of the present invention.

FIG. 34*a* depicts the potential use of the systems of the present invention to support large cantilever structures 3450. The modular construction 800 is constructed using header units 2700 to form a header stack 2701 to retain a soil load 34. The system also incorporates a complementary structural element 1100 and a ground anchor 1115 to provide additional capability and stability to the system.

Turning now to FIGS. 34*b* and 34*f*, the use of the systems to combat cliff erosion is depicted in another application of the system of the present invention. Thousands of communities worldwide, both large and small, are located on a shoreline. Frequently, having been established over long periods, these communities now find themselves being severely encroached upon by the action of the eroding environmental elements.

As is common along part of the California coastline near Santa Cruz, which comprises the general location of the bluff face considered in this example, the base of the cliff is composed of a reasonably competent sedimentary rock. In this location, purisima is the geological name given this sedimentary rock. The soils overlaying the purisima rock, the terrace deposits, are more or less consistent and comprise generally weak, unconsolidated conglomerates. Because of the soil characteristics and the particle grading of these conglomerates, they frequently stand at very steep angles, sometimes forming over-vertical faces. However, these terrace deposits continuously erode, often in a series of non-rotational slip failures, with most erosion activity occurring towards the end of the winter period.

A second and independent form of cliff erosion occurs when failure is induced in the purisima sedimentary rock. This type of failure is caused by the undermining of the relatively soft rock. The natural attrition of this soft rock at the base is caused principally by the frittering of the purisima, which in turn is caused by the general eroding action of the elements, including wave action. Eventually the undermining progresses to such an extent it causes the sedimentary rock to fall out in slabs and/or blocks, depending on preexisting fracture planes. Ultimately, though sometimes directly, this leaves the conglomerates above unsupported and triggers a consequent failure in the terrace deposits.

In this location, as in many others, there is a public roadway that, when originally constructed, was some distance from the cliff edge. Because of the erosion over the years, the roadway was reduced from two lanes to a single lane. In several places the guard rails were hanging in mid-air. In many other places the roadways are cut completely. It should be noted that the loss of some of the roads and, in many locations, the loss of private property, was caused by earthquake induced rock/soil-mass failures.

There are several ways to combat these types of soil retention and protection problems. The systems of the present invention offer numerous possible solutions.

The design depicted in FIG. 34*b* addresses several issues. Ultimately, these issues amount to dealing with the time and cost of construction while providing the solution functionality and performance required.

In particular, the solution employs pre-cast cantilever units that these systems naturally incorporate into the structure. The system of the present invention can include large cantilever units (for example, as depicted in FIG. 34*a*) at very low additional expense (especially when compared to the added functionality acquired), that can regain "property" lost to the effects of erosion. In this situation, this added area can be utilized as vehicular parking, wider pedestrian pathways, bike and roller-blading lanes, and/or lookouts.

What is also significant with the use of cantilever units in general, as attached to the top of the retaining wall, is the freedom of position it affords with regard to the location of the foundation elements. These and other pre-cast concrete elements (as well as structural components made from steel), may be included and/or attached to the retaining wall structure at levels other than the top of the header stacks. In the particular situation depicted in FIG. 34*b*, the pre-cast concrete cantilever units allow the construction of the foundation element to be located at the interface of the purisima sedimentary rock and the terrace deposits.

Locating the foundation construction at this interface provides several advantages:

The construction contractor does not need to commence work at the base of the cliff where there is much greater exposure to the whims of the ocean. The typical issue of foundations being inundated with seawater, and the associated problems, are immediately eliminated.

The depth from the top of finished construction to the foundation beam/pile cap is significantly less than the height of the cliff, and access may be readily established from the roadway above.

Because of the competency of the sedimentary rock, the piles may be installed most rapidly, typically not requiring any shoring, and thus allowing for the optimized use of the drilling rigs. In the few locations where the rock cover is insufficient to contain the bursting pressures generated by the compaction of the wet concrete, the upper few feet of the pile may be sleeved.

Ground anchors are installed under optimum conditions.

The foundation beam/pile cap is then readily placed to the accuracy required by the system for the first layer of header units, and the placing of remaining pre-cast modules may proceed with rapidity.

The pre-cast cantilever units are installed and, having already developed ample strength, may immediately carry the loads of the forms, rebar and concrete necessary to complete the structure.

One of the most significant savings established by the approach that can be taken with these systems is the elimination of wall construction over the height of the exposed purisima sedimentary rock.

Figure 34I:
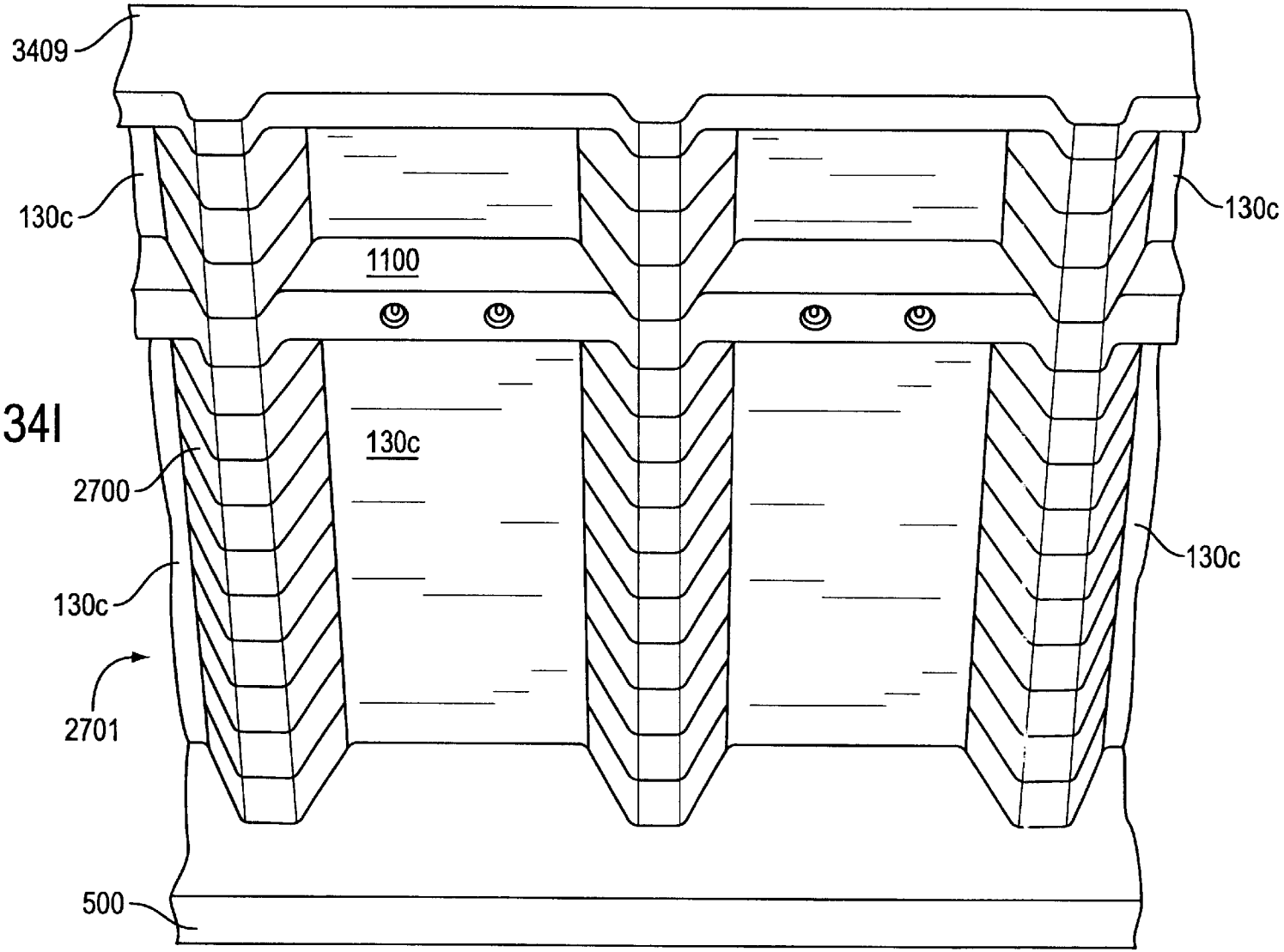
FIG. 34*i* is a perspective view of an exemplary application of the system of the present invention.
Figure 34J:
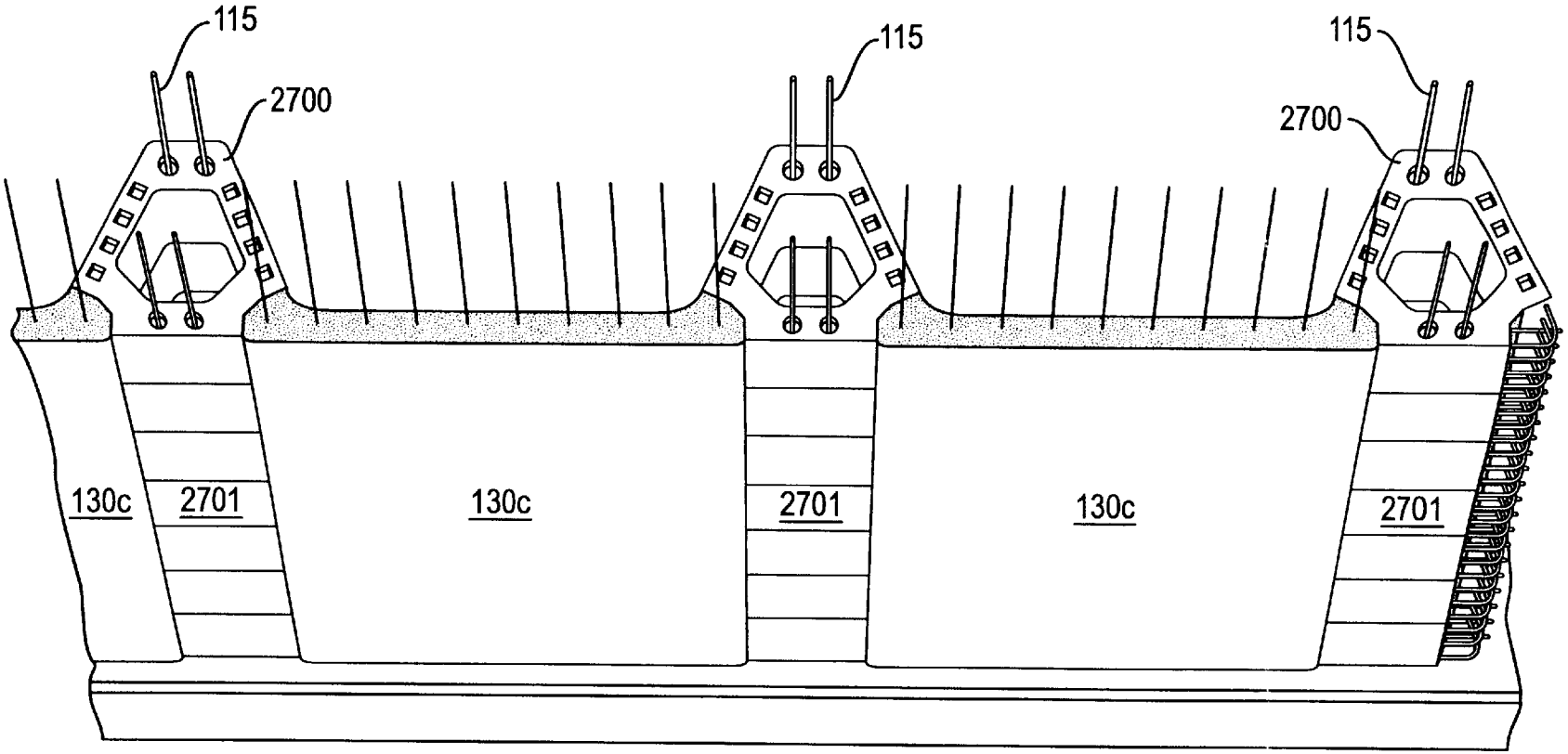
FIG. 34*j* is a perspective view of an exemplary application of the system of the present invention.

FIGS. 34*i* and 34*j* illustrate the use of headers 2700 in conjunction with cast-in-place (CIP) concrete panels 130*c*. The CIP panels 130*c* in the illustration are formed with simple patterned front faces. The faces of the panels 130*c* can be patterned in various ways to meet the requirements of the owner. The use of complementary structural element 1100 along with the restraining ground anchor 1115 forces which apply at the complementary structural elements 1100, provide for efficient use of the header stacks 2701 in conjunction with the CIP panels 130*c* because of the composite action which may develop between these components. FIG. 34*j* depicts the rear face of the wall shown in FIG. 34*i*.

Figure 34L:
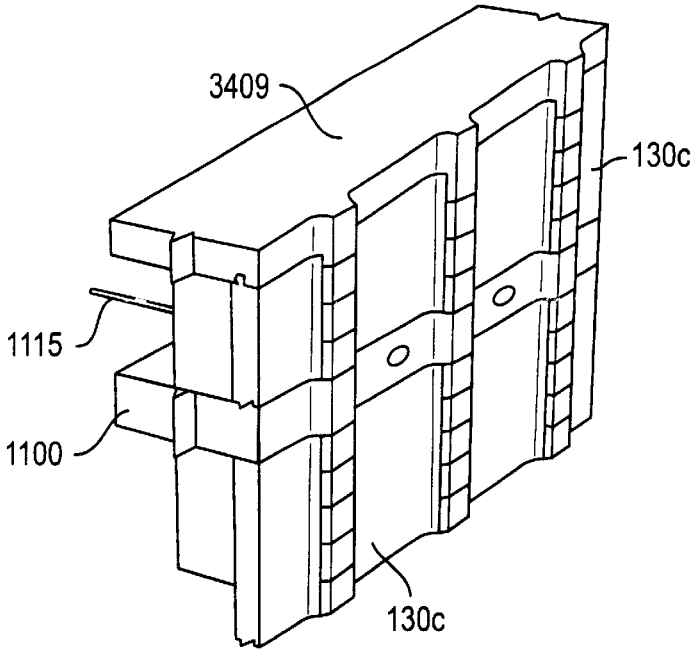
FIG. 34*l* is a perspective view of the application in FIG. 34*k*.
Figure 34K:
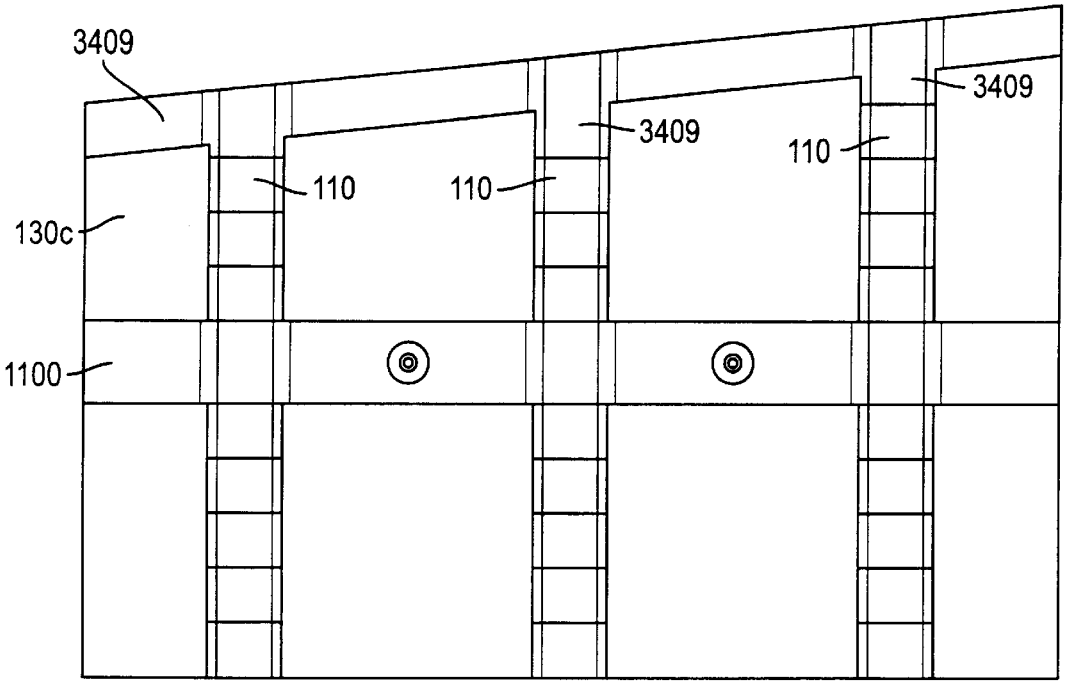
FIG. 34*k* is a front elevation of an exemplary application of the system of the present invention.
Figure 34M:
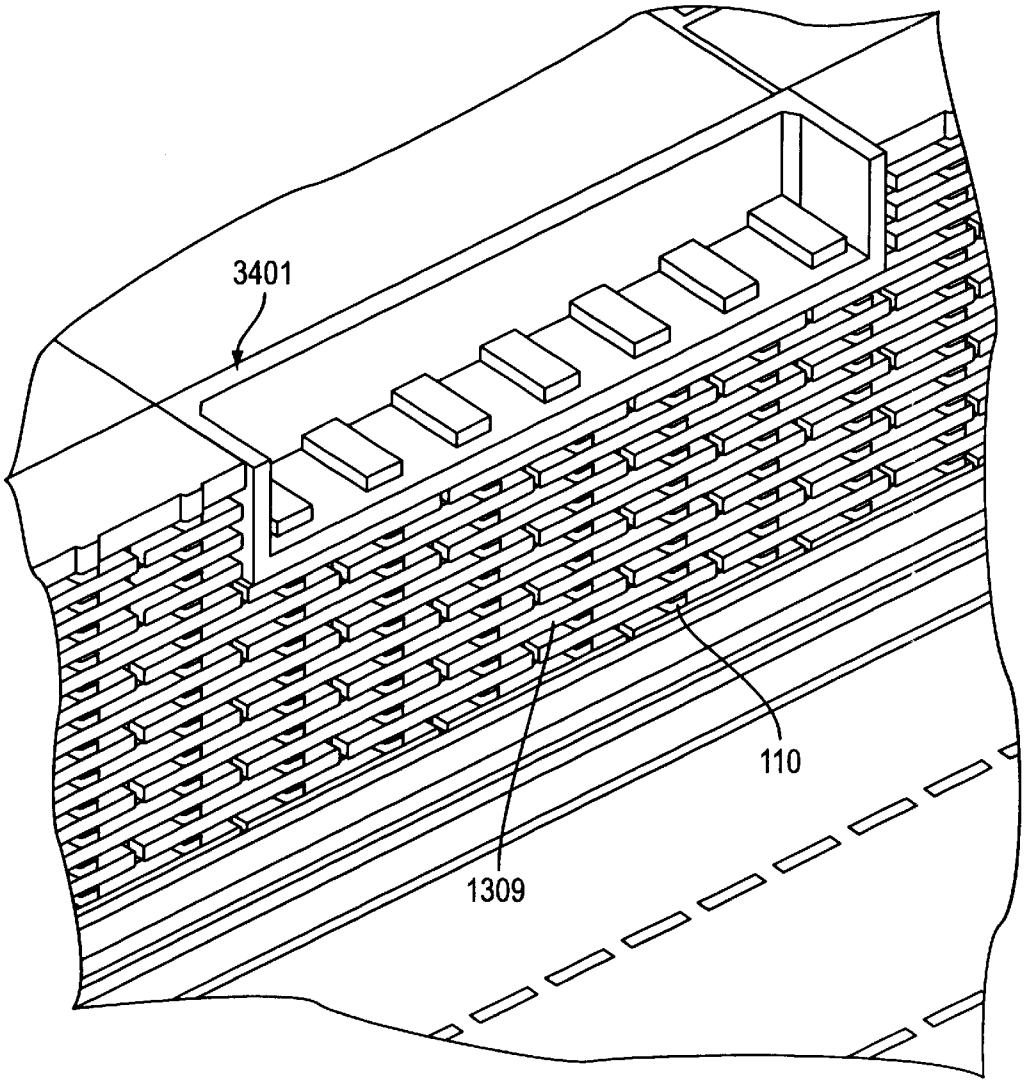
FIG. 34*m* is a perspective view of an exemplary application of the system of the present invention.
Figure 34N:
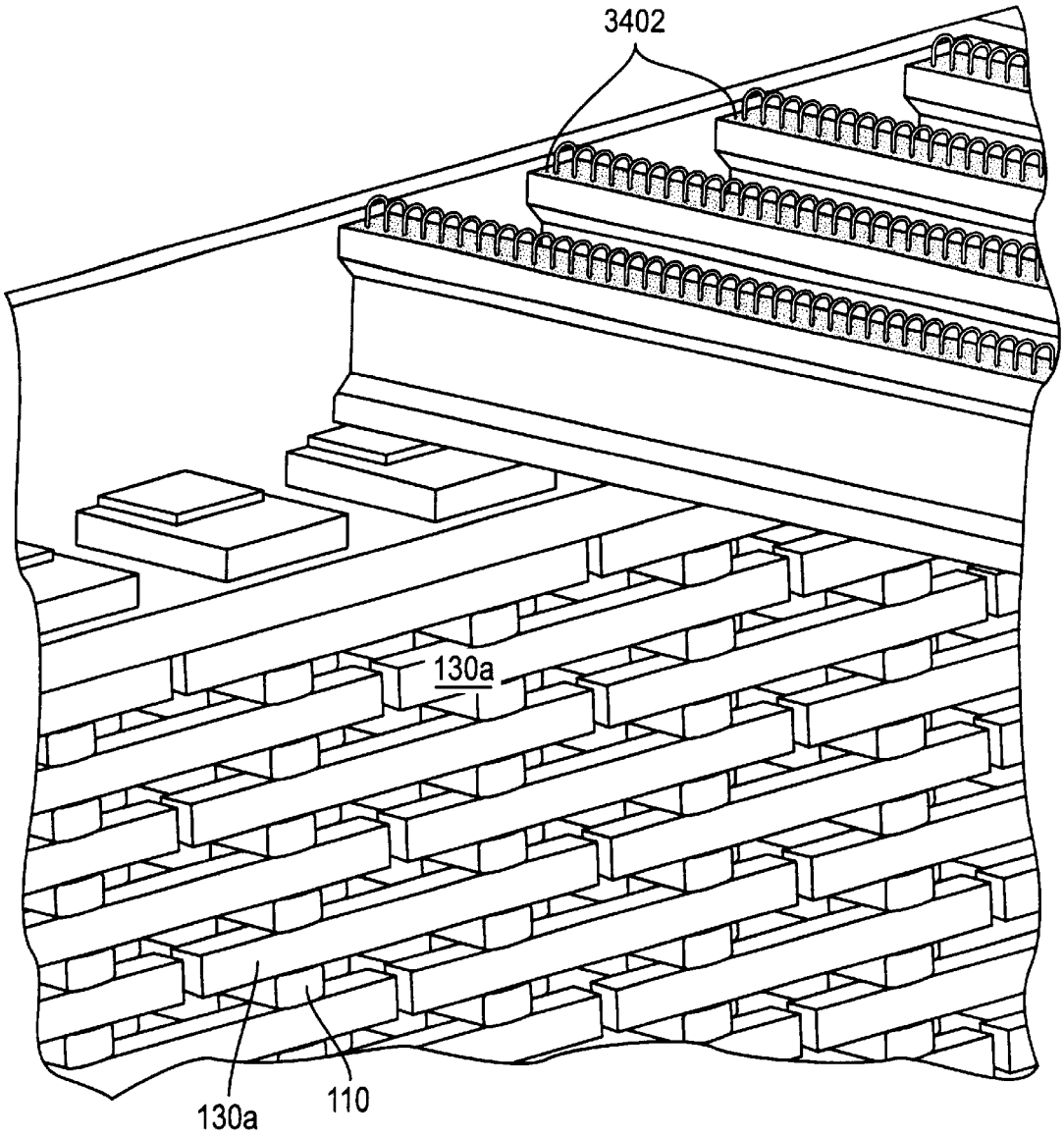
FIG. 34*n* is an enlarged perspective view of a portion of the system of FIG. 34*m*.

FIGS. 34*k* and 34*l* further illustrate the flexibility of the systems of the present invention. In a situation where a sloped construction is required, the header stacks 101 are stepped and the capping beam 3409 is formed to abut the adjacent header unit 110. The cast-in-place concrete panels 130*c* are formed to substantially fill the area between the header stacks 101. The complementary structural element 1100 depicted in the figure is physically close to the capping beam 3409 due to the steep slope of the capping beam 3409. Note that the complementary structural elements 1100 for any construction may step at various intervals without having to be continuous across the entire length of the wall 800.

Figure 34O:
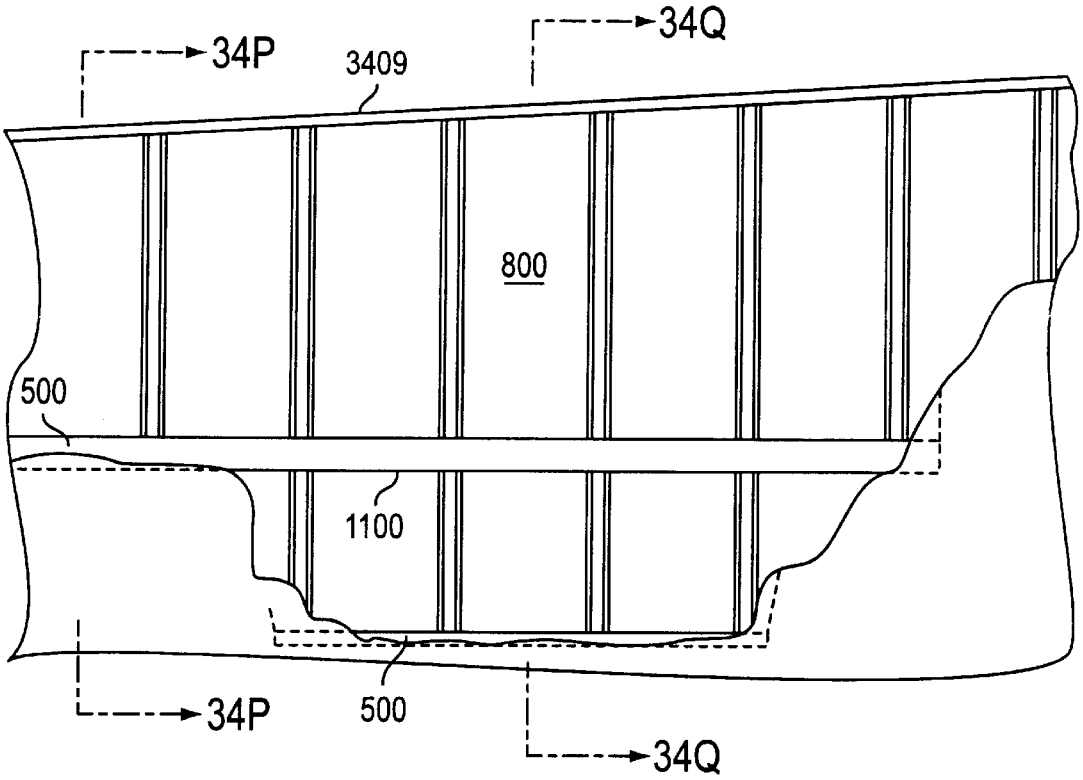
FIG. 34*o* is a front elevation of an exemplary application of the system of the present invention.
Figure 34P:
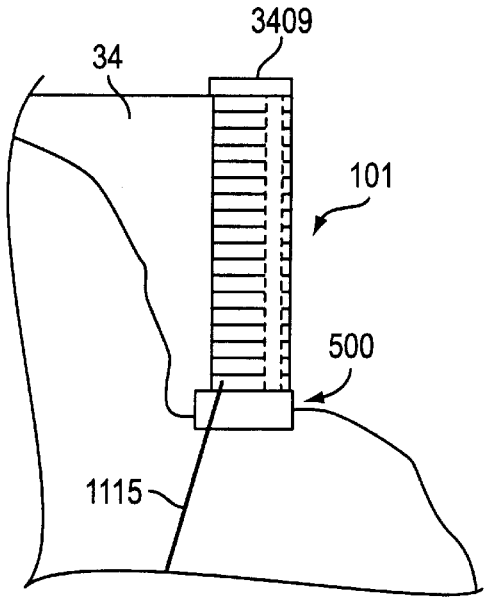
FIG. 34*p* is a cross section of the application of FIG. 34*o* along the line p—p.
Figure 34Q:
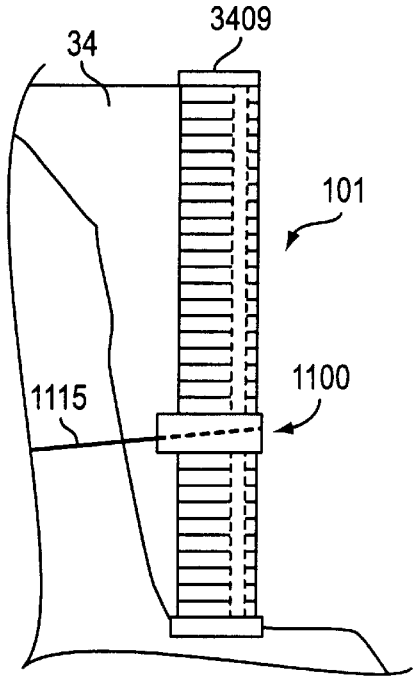
FIG. 34*q* is a cross section of the application of FIG. 34*o* along the line q—q.

FIGS. 34*o*, 34*p*, 34*q* illustrate a situation where there is significant rock formation obstructing the path of where a construction is desired. The rock formation may be too costly to remove or may need to be left in place for various other reasons. In such a situation, the modular constructions of the present invention may be configured to provide a superior solution, readily overcoming such obstacles. Note that the element that serves as a complementary structural element 1100 at the section of the wall depicted in FIG. 34*q* serves as the foundation element 500 for the section of the wall depicted in FIG. 34*p*. Together with complementary structural elements 1100, the appropriate location, spacing, capacity, and declination of ground anchors 1115 provides a great scope of application and flexibility of the systems of the present invention.

Figure 34R:
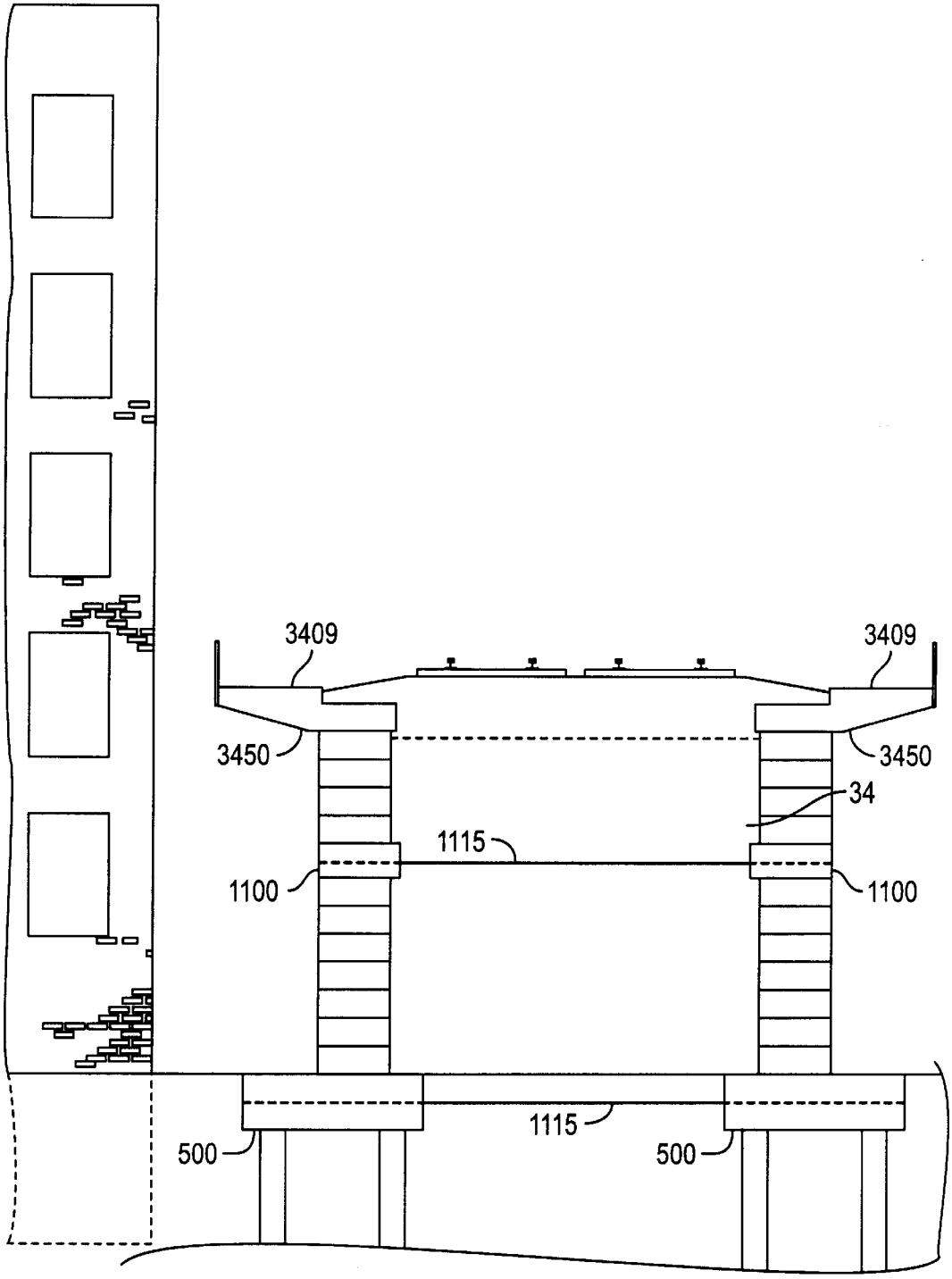
FIG. 34*r* is a perspective view of an exemplary application of the system of the present invention.

The potential use of ground anchors 1115 is further illustrated in FIG. 34*r*. In this example an elevated railroad line built on a level crossing is depicted. The system incorporates cantilever units at the top of opposing retaining walls. Very large lateral forces may develop during and after construction, which forces will act on the retaining wall structure 800. A system from the present invention maybe chosen with the capacity to withstand these lateral forces (and the resultant moments and shears, etc.) in a strictly cantilever action. Another option that significantly reduces, or may eliminate, the moments and the shear forces "seen" by the foundation element 500 at the base of such wall construction, is afforded via the use of incorporated complementary structural element 1100, which elements 1100 may then be "tied together" via horizontal ground anchors 1115, or similar ties 1115. Note that such ties 1115 are also employed as shown between the foundation elements 500 themselves.

Conclusion

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

I claim:

1. A system for constructing a pre-stressed modular construction for retaining or supporting an applied load, comprising:

a header stack, wherein said header stack is comprised of a plurality of main header units and a plurality of sub-header units, said main header units and said sub-header units being stacked to form said header stack, wherein each of said main header units and said sub-header units comprises a center element having a top face, and a bottom face, a first end element disposed at one end of said center element, and a second end element disposed at another end of said center element;

an active reinforcement element configured to cooperate with said header stack so that post-tensioning said active reinforcement element imparts a corresponding pre-stressing force into said header stack, wherein the corresponding pre-stressing force is transferred to said header stack at at least one predetermined lock-off point; and a passive reinforcement element extending longitudinally through a passthrough duct in at least one of said header units, said passive reinforcement element configured such that it carries an applied load.

2. The system of claim 1, further comprising:

a passive reinforcement element extending through a passthrough duct in at least one of said header units, said passive reinforcement element configured such that it does not carry load distributed in said header stack.

3. The system of claim 1, wherein said main header units and said sub-header units further comprise a curved portion at one of said first end element and said second end element.

4. The system of claim 1, wherein said main header units and said sub-header units further comprise a curved portion at said first end element and said second end element.

5. The system of claim 1, wherein said first end element has a top face and a bottom face and said second end element has a top face and a bottom face, said top face and said bottom face of said first end element and said second end element being coplanar with said top face and said bottom face of said center element, respectively.

6. The system of claim 1, wherein said first end element and said second end element are integrally formed with said center element.

7. The system of claim 1, further comprising:

a plurality of indentations on one of the top and bottom faces of said center element; and a plurality of protrusions on the other of the top and bottom faces of said center element corresponding to said plurality of indentations, wherein said protrusions on each said sub-header unit and said main header unit are configured to engage said corresponding indentations in an adjacent header unit.

8. The system of claim 7, further comprising a structural member for coupling two or more header stacks.

9. The system of claim 8, wherein said structural member defines a secondary passthrough duct that extends through said structural member.

10. The system of claim 9, wherein said structural member is coupled between two of said main header units and is abutting one of said sub-header units such that said secondary passthrough duct in said structural member is in registry with at least one of said passthrough ducts in said two main header units.

11. The system of claim 10, wherein said structural member is positioned between one of said first end element and said second end element of each of said main header units.

12. The system of claim 10, wherein said structural member is positioned between each of said first end element and said second end element of each said main header unit.

13. The system of claim 9, further comprising:

a complementary structural element disposed between two of said header units and extending between two or more of said header stacks.

14. The system of claim 1, further comprising:

first corrugations on one of the top and bottom faces of said center element; and second corrugations on the other of the top and bottom faces of said center element corresponding to said first corrugations, wherein said second corrugations on each said sub-header unit and said main header unit are configured to nest with said corresponding first corrugations in an adjacent header unit.

15. The system of claim 14, further comprising:

first corrugations on one of the top and bottom faces of at least one of said first end element and said second end element; and second corrugations on the other of the top and bottom faces of said first end element and said second end element corresponding to said first corrugations, wherein said second corrugations on each said sub-header unit and said main header unit are configured to nest with said corresponding first corrugations in an adjacent header unit.

16. The system of claim 1, wherein said first end element defines a first passthrough duct extending through said first end element and said second end element defines a second passthrough duct extending through said second end element, wherein said passthrough ducts are configured to receive said active reinforcement element.

17. The system of claim 1, wherein said first end element and said second end element of said header unit define said lock-off points and said active reinforcement element is disposed in said header stack.

18. The system of claim 1, wherein said main header units and said sub-header units are symmetrical about a line perpendicular to a longitudinal axis of said main header units and said sub-header units.

19. The system of claim 1, wherein said main header units are symmetrical about a line perpendicular to a longitudinal axis of said main header units and said sub-header units are asymmetrical about a line perpendicular to a longitudinal axis of said sub-header units.

20. The system of claim 1, wherein said main header units are asymmetrical about a line perpendicular to a longitudinal axis of said main header units and said sub-header units are symmetrical about a line perpendicular to a longitudinal axis of said sub-header units.

21. The system of claim 1, wherein said main header units are asymmetrical about a line perpendicular to a longitudinal axis of said main header units and said sub-header units are asymmetrical about a line perpendicular to a longitudinal axis of said sub-header units.

22. The system of claim 1, further comprising a structural member for coupling two or more header stacks.

23. A system for constructing a pre-stressed modular construction for retaining or supporting an applied load, comprising:

a header stack, wherein said header stack is comprised of a plurality of header units;

an active reinforcement element configured to cooperate with said header stack so that post-tensioning said active reinforcement element imparts a corresponding pre-stressing force into said header stack, wherein the corresponding pre-stressing force is transferred to said header stack at at least one predetermined lock-off point; and a harping element coupled to said header stack at a harping point such that said active reinforcement element is disposed external to said header stack and is deformed at said harping point such that said active reinforcement element forms a series of substantially straight segments.

24. The system of claim 23, further comprising a second active reinforcement element disposed in said header stack.

25. A system for constructing a pre-stressed modular construction for retaining or supporting an applied load, comprising:

a header stack, wherein said header stack is comprised of a plurality of header units;

an active reinforcement element configured to cooperate with said header stack so that post-tensioning said active reinforcement element imparts a corresponding pre-stressing force into said header stack; and a tieback transfer beam disposed between two of said header units and extending between two or more of said header stacks.

26. The system of claim 25, further comprising:

a ground anchor coupled to said tieback transfer beam.

27. A system for constructing a pre-stressed modular construction for retaining or supporting an applied load, comprising:

a header stack, wherein said header stack is comprised of a plurality of main header units;

an active reinforcement element configured to cooperate with said header stack so that post-tensioning said active reinforcement element imparts a corresponding pre-stressing force into said header stack, wherein the corresponding pre-stressing force is transferred to said header stack at at least one predetermined lock-off point;

a complementary structural element disposed between two of said main header units and extending between two or more of said header stacks; and a passive reinforcement element extending longitudinally through a passthrough duct in at least one of said main header units, said passive reinforcement element configured such that it carries an applied load.

28. The system of claim 27, wherein said complementary structural element comprises:

a passthrough duct in registry with one of said passthrough ducts in said header units; and a passthrough channel extending through said complementary structural element.

29. The system of claim 28, further comprising:

a ground anchor coupled to said complementary structural element and configured to extend through said passthrough channel.

30. The system of claim 29, further comprising:

a raised portion extending from said complementary structural element and defining an opening in communication with said passthrough channel for receiving said ground anchor.

31. A system for constructing a pre-stressed modular construction for retaining or supporting an applied load, comprising:

a header stack, wherein said header stack is comprised of a plurality of header units, wherein each of said header units comprises a top face and a bottom face, a base element having a first end and a second end, a head element having a first end and a second end, and a pair of side elements extending between each of said first end and said second end of said base element and said head element; and an active reinforcement element configured to cooperate with said header stack so that post-tensioning said active reinforcement element imparts a corresponding pre-stressing force into said header stack, wherein the corresponding pre-stressing force is transferred to said header stack at at least one predetermined lock-off point.

32. The system of claim 31, further comprising:

a passive reinforcement element extending through a passthrough duct in at least one of said header units, said passive reinforcement element configured such that it does not carry load distributed in said header stack.

33. The system of claim 32, wherein each of said header units further comprises:

at least one passthrough duct in one of said base element and said head element.

34. The system of claim 33, further comprising:

a complementary structural element disposed between two header units and extending between two or more of said header stacks.

35. The system of claim 34, wherein said complementary structural element comprises:

a passthrough duct in registry with one of said passthrough ducts in said header units; and a passthrough channel extending through said complementary structural element.

36. The system of claim 35, further comprising:

a ground anchor coupled to said complementary structural element and extending through said passthrough channel.

37. The system of claim 36, further comprising:

a raised portion extending from said complementary structural element and defining an opening in communication with said passthrough channel for receiving said ground anchor.

38. The system of claim 31, further comprising:

a passive reinforcement element extending longitudinally through a passthrough duct in at least one of said header units, said passive reinforcement element configured such that it carries an applied load.

39. The system of claim 31, wherein each of said header units defines a plurality of passthrough ducts.

40. The system of claim 31, further comprising:

a plurality of indentations in one of the top and bottom faces of each said header unit; and a plurality of protrusions on the other of the top and bottom faces of each said header unit corresponding to said indentations, such that said protrusions on each said header unit are configured to engage said corresponding indentations in an adjacent header unit.

41. The system of claim 31, further comprising:

first corrugations in one of the top and bottom faces of each said header unit; and second corrugations on the other of the top and bottom faces of each said header unit corresponding to first corrugations, such that said second corrugations on each said header unit are configured to nest with said corresponding first corrugations in an adjacent header unit.

42. The system of claim 31, wherein one of said base element and said head element extends past said side elements such that a flange is formed adjacent each said side element.

43. The system of claim 42, further comprising:

a structural member disposed between two header stacks and coupled to said flange.

44. The system of claim 31, wherein said side elements couple with said base element such that an indentation is formed adjacent said base element.

45. The system of claim 44, further comprising:

a passive reinforcement element disposed in said indentation.

46. The system of claim 45, further comprising:

a structural member disposed between two header stacks and coupled to said indentation.

47. A pre-stressed modular construction for retaining or supporting an applied load, comprising:

a plurality of header stacks, wherein each of said header stacks is comprised of a plurality of header units, and wherein at least one header stack comprises a plurality of main header units and sub-header units, said main header units and said sub-header units being stacked to form said at least one header stack, wherein each of said main header units and said sub-header units comprises a center element having a top face, and a bottom face, a first end element disposed at one end of said center element, and a second end element disposed at another end of said center element;

a plurality of active reinforcement elements, wherein each said active reinforcement element is configured to cooperate with at least one of said header stacks so that post-tensioning said active reinforcement element imparts a corresponding pre-stressing force into said header stack, wherein the corresponding pre-stressing force is transferred to said header stack at at least one predetermined lock-off point;

a plurality of structural members, wherein each of said structural members is coupled to at least one of said header stacks; and a passive reinforcement element extending longitudinally through a passthrough duct in at least one of said header units, said passive reinforcement element configured such that it carries an applied load.

48. The pre-stressed modular construction of claim 47, wherein said main header units and said sub-header units further comprise a curved portion at one of said first end element and said second end element.

49. The pre-stressed modular construction of claim 47, wherein said main header units and said sub-header units further comprise a curved portion at said first end element and said second end element.

50. The pre-stressed modular construction of claim 47, wherein said first end element has a top face and a bottom face and said second end element has a top face and a bottom face, said top face and said bottom face of said first end element and said second end element being coplanar with said top face and said bottom face of said center element, respectively.

51. The pre-stressed modular construction of claim 50, wherein said first end element and said second end element are integrally formed with said center element.

52. The pre-stressed modular construction of claim 50, further comprising:

a plurality of indentations on one of the top and bottom faces of said center element; and a plurality of protrusions on the other of the top and bottom faces of said center element corresponding to said plurality of indentations, wherein said protrusions on each said sub-header unit and said main header unit are configured to engage said corresponding indentations in an adjacent header unit.

53. The pre-stressed modular construction of claim 50, further comprising:

first corrugations on one of the top and bottom faces of said center element; and second corrugations on the other of the top and bottom faces of said center element corresponding to said first corrugations, wherein said second corrugations on each said sub-header unit and said main header unit are configured to nest with said corresponding first corrugations in an adjacent header unit.

54. The pre-stressed modular construction of claim 53, further comprising:

first corrugations on one of the top and bottom faces of at least one of said first end element and said second end element; and second corrugations on the other of the top and bottom faces of said first end element and said second end element corresponding to said first corrugations, wherein said second corrugations on each said sub-header unit and said main header unit are configured to nest with said corresponding first corrugations in an adjacent header unit.

55. The pre-stressed modular construction of claim 50, wherein said first end element defines a first passthrough duct extending through said first end element and said second end element defines a second passthrough duct extending through said second end element, wherein said passthrough ducts are configured to receive said active reinforcement element.

56. The pre-stressed modular construction of claim 50, wherein said active reinforcement element is disposed in said header stack.

57. The pre-stressed modular construction of claim 50, wherein said main header units and said sub-header units are symmetrical about a line perpendicular to a longitudinal axis of said main header units and said sub-header units.

58. The pre-stressed modular construction of claim 50, wherein said main header units are symmetrical about a line perpendicular to a longitudinal axis of said main header units and said sub-header units are asymmetrical about a line perpendicular to a longitudinal axis of said sub-header units.

59. The pre-stressed modular construction of claim 50, wherein said main header units are asymmetrical about a line perpendicular to a longitudinal axis of said main header units and said sub-header units are symmetrical about a line perpendicular to a longitudinal axis of said sub-header units.

60. The pre-stressed modular construction of claim 50, wherein said main header units are asymmetrical about a line perpendicular to a longitudinal axis of said main header units and said sub-header units are asymmetrical about a line perpendicular to a longitudinal axis of said sub-header units.

61. The pre-stressed modular construction of claim 50, wherein each of said structural members defines a secondary passthrough duct that extends through said structural member.

62. The pre-stressed modular construction of claim 61, wherein said structural members are coupled between two of said main header units and are abutting one of said sub-header units such that said secondary passthrough duct in each said structural member is in registry with at least one of said passthrough ducts in said two main header units.

63. The pre-stressed modular construction of claim 62, wherein said structural member is positioned between one of said first end element and said second end element of each of said two main header units.

64. The pre-stressed modular construction of claim 62, wherein said structural member is between each of said first end element and said second end element of each said header unit.

65. The pre-stressed modular construction of claim 61, further comprising:

a complementary structural element disposed between two main header units and extending between two or more of said header stacks.

66. The pre-stressed modular construction of claim 65, wherein said complementary structural element comprises:

a passthrough duct in registry with one of said passthrough ducts in said header units; and a passthrough channel extending through said complementary structural element.

67. The pre-stressed modular construction of claim 66, further comprising:

a ground anchor coupled to said complementary structural element and extending through said passthrough channel.

68. The pre-stressed modular construction of claim 67, further comprising:

a raised portion extending from said complementary structural element and defining an opening in communication with said passthrough channel for receiving said ground anchor.

69. The pre-stressed modular construction of claim 47, further comprising:

a complementary structural element disposed between two main header units and extending between two or more of said header stacks.

70. A pre-stressed modular construction for retaining or supporting an applied load, comprising:

a plurality of header stacks, wherein each of said header stacks is comprised of a plurality of header units, and wherein at least one header stack comprises a plurality of main header units and sub-header units, said main header units and said sub-header units being stacked to form said at least one header stack;

a plurality of active reinforcement elements, wherein each said active reinforcement element is configured to cooperate with at least one of said header stacks so that post-tensioning said active reinforcement element imparts a corresponding pre-stressing force into said header stack, wherein the corresponding pre-stressing force is transferred to said header stack at at least one predetermined lock-off point; and a plurality of structural members, wherein each of said structural members is coupled to at least one of said header stacks; and a harping element coupled to at least one of said header stacks at a harping point such that one of said active reinforcement elements is disposed external to said at least one header stack and is deformed at said harping point such that said one active reinforcement element forms a series of substantially straight segments.

71. The pre-stressed modular construction of claim 70, further comprising:

an active reinforcement element disposed in said header stack.

72. A pre-stressed modular construction for retaining or supporting an applied load, comprising:

a plurality of header stacks, wherein each of said header stacks is comprised of a plurality of header units, and wherein at least one header stack comprises a plurality of main header units and sub-header units, said main header units and said sub-header units being stacked to form said at least one header stack;

a plurality of active reinforcement elements, wherein each said active reinforcement element is configured to cooperate with at least one of said header stacks so that post-tensioning said active reinforcement element imparts a corresponding pre-stressing force into said header stack, wherein the corresponding pre-stressing force is transferred to said header stack at at least one predetermined lock-off point;

a plurality of structural members, wherein each of said structural members is coupled to at least one of said header stacks; and a tieback transfer beam disposed between two of said header units and extending between two or more of said header stacks.

73. The pre-stressed modular construction of claim 72, further comprising:

a ground anchor coupled to said tieback transfer beam.

74. The pre-stressed modular construction of claim 72, wherein at least one of said structural members is a concrete stretcher.

75. The pre-stressed modular construction of claim 72, wherein at least one of said structural members is a pre-cast concrete panel.

76. The pre-stressed modular construction of claim 72, wherein at least one of said structural members is a cast-in-place concrete panel.

77. The pre-stressed modular construction of claim 72, wherein at least one of said structural members comprises shotcrete.

78. The pre-stressed modular construction of claim 72, further comprising:

a corner closure stack, wherein said corner closure stack is comprised of a plurality of corner closure units; and a second active reinforcement element configured to cooperate with said header stack so that post-tensioning said second active reinforcement element imparts a corresponding pre-stressing force into said corner closure stack.

79. A pre-stressed modular construction for retaining or supporting an applied load, comprising:

a plurality of header stacks, wherein each of said header stacks is comprised of a plurality of header units, and wherein at least one header stack comprises a plurality of main header units and sub-header units, said main header units and said sub-header units being stacked to form said at least one header stack, wherein each of said header units comprises a top face and a bottom face, a base element having a first end and a second end, a head element having a first end and a second end, and a pair of side elements extending between each of said first end and said second end of said base element and said head element;

a plurality of active reinforcement elements, wherein each said active reinforcement element is configured to cooperate with at least one of said header stacks so that post-tensioning said active reinforcement element imparts a corresponding pre-stressing force into said header stack, wherein the corresponding pre-stressing force is transferred to said header stack at at least one predetermined lock-off point; and a plurality of structural members, wherein each of said structural members is coupled to at least one of said header stacks.

80. The pre-stressed modular construction of claim 79, wherein each of said header units further comprises:

at least one passthrough duct in one of said base element and said head element, said passthrough duct extending between said top face and said bottom face.

81. The pre-stressed modular construction of claim 79, wherein each of said header units defines a plurality of passthrough ducts extending between said top face and said bottom face.

82. The pre-stressed modular construction of claim 79, further comprising:

a plurality of indentations in one of the top and bottom faces of each said header unit; and a plurality of protrusions on the other of the top and bottom faces of each said header unit corresponding to said indentations, such that said protrusions on each said header unit are configured to engage said corresponding indentations in an adjacent header unit.

83. The pre-stressed modular construction of claim 82, further comprising:

a complementary structural element disposed between two header units and extending between two or more of said header stacks.

84. The pre-stressed modular construction of claim 83, wherein said complementary structural element comprises:

a passthrough duct in registry with one of said passthrough ducts in said header units; and a passthrough channel extending through said complementary structural element.

85. The pre-stressed modular construction of claim 84, further comprising:

a ground anchor coupled to said complementary structural element and extending through said passthrough channel.

86. The pre-stressed modular construction of claim 79, further comprising:

first corrugations in one of the top and bottom faces of each said header unit; and second corrugations on the other of the top and bottom faces of each said header unit corresponding to said first corrugations, such that said second corrugations on each said header unit are configured to nest with said corresponding first corrugations in an adjacent header unit.

87. The pre-stressed modular construction of claim 86, further comprising:

first corrugations on one of the top and bottom faces of at least one of said head element and said base element; and second corrugations on the other of the top and bottom faces of said head element and said base element corresponding to said first corrugations, wherein said second corrugations on each said sub-header unit and said main header unit are configured to nest with said corresponding first corrugations in an adjacent header unit.

88. The pre-stressed modular construction of claim 79, wherein one of said base element and said head element extends past said side elements such that a flange is formed.

89. The pre-stressed modular construction of claim 88, wherein said structural members are disposed between two header stacks and coupled to said flange.

90. The pre-stressed modular construction of claim 89, further comprising:

a raised portion extending from said complementary structural element and defining an opening in communication with said passthrough channel for receiving said ground anchor.

91. The pre-stressed modular construction of claim 79, wherein said side elements couple with said base element such that an indentation is formed adjacent said base element.

92. The pre-stressed modular construction of claim 91, further comprising:

a passive reinforcement element disposed in said indentation.

93. The pre-stressed modular construction of claim 92, wherein said structural members are disposed between two header stacks and coupled to said reinforcement member.

94. A pre-stressed modular construction for retaining or supporting an applied load, comprising:

at least two header stacks, wherein each of said header stacks is comprised of a plurality of stacked header units;

at least one pre-stressing tendon for each of said header stacks, wherein each pre-stressing tendon is configured to cooperate with its header stack so that post-tensioning said pre-stressing tendon prior to application of the applied load imparts a corresponding pre-stressing force into its header stack at at least one lock-off point;

a structural member coupled to said at least two header stacks; and a tieback transfer beam disposed between two of said header units and extending between said at least two header stacks.

95. The pre-stressed modular construction of claim 94, further comprising:

a ground anchor coupled to said tieback transfer beam.

96. The pre-stressed modular construction of claim 94, wherein said structural member is a concrete stretcher.

97. The pre-stressed modular construction of claim 94, wherein said structural member is a pre-cast concrete panel.

98. The pre-stressed modular construction of claim 94, wherein said structural member is a cast-in-place concrete panel.

99. The pre-stressed modular construction of claim 94, wherein said structural member comprises shotcrete.

100. A method of fabricating a pre-stressed modular construction for retaining or supporting an applied load, comprising:

providing a foundation for said construction;

constructing a plurality of header stacks on the foundation, wherein each said header stack is comprised of a plurality of header units, wherein the step of constructing comprises stacking a plurality of main header units and a plurality of sub-header units, said main header units and said sub-header units having a center element having a top face, and a bottom face; a plurality of indentations in one of the top and bottom faces; a plurality of protrusions on the other of the top and bottom faces of said center element corresponding to said plurality of indentations, wherein said protrusions on each said sub-header unit and said main header unit are configured to engage said corresponding indentations in an adjacent header unit, a first end element disposed at one end of said center element, a second end element disposed at another end of said center element, wherein said first end element defines a first passthrough duct extending through said first end element and said second end element defines a second passthrough duct extending through said second end element, wherein said passthrough ducts are configured to receive said active reinforcement element, and a lock-off element coupled to said header stack coupling an active reinforcement element to each said header stack, and post-tensioning said active reinforcement element such that it imparts a corresponding pre-stressing force into said header stack.

101. The method of claim 100, wherein said step of coupling comprises:

pre-positioning said active reinforcement element in the foundation;

feeding said header units over said active reinforcement element, said active reinforcement element passing through said passthrough ducts;

securing said active reinforcement element to the header stack.

102. The method of claim 100, wherein said step of coupling comprises:

coupling a harping element to said header stack at a harping point such that said active reinforcement element is disposed external to said header stack and is deformed at said harping point such that said active reinforcement element forms a series of substantially straight segments.

103. The method of claim 100, wherein said step of constructing the header stacks comprises:

providing main header units and said sub-header units which are symmetrical about a line perpendicular to a longitudinal axis of said main header units and said sub-header units.

104. The method of claim 100, wherein said step of constructing the header stacks comprises:

providing main header units which are symmetrical about a line perpendicular to a longitudinal axis of said main header units and sub-header units which are asymmetrical about a line perpendicular to a longitudinal axis of said sub-header units.

105. The method of claim 100, wherein said step of constructing the header stacks comprises:

providing main header units which are asymmetrical about a line perpendicular to a longitudinal axis of said main header units and sub-header units which are symmetrical about a line perpendicular to a longitudinal axis of said sub-header units.

106. The method of claim 100, wherein said step of constructing the header stacks comprises:

providing main header units and sub-header units which are asymmetrical about a line perpendicular to a longitudinal axis of said main header units and said sub-header units.

107. The method of claim 100, further comprising:

adding structural elements between header stacks.

108. The method of claim 107, wherein said adding step is performed so that said structural members are between two of said main header units such that they engage one of said sub-header units such that a passthrough duct in each said structural member is in registry with at least one of said passthrough ducts in each of said main header units.

109. The method of claim 107, wherein said adding step is performed so that said structural members are adjacent one of said first end element and said second end element of each said header unit.

110. The method of claim 107, wherein said adding step is performed so that said structural members are adjacent each of said first end element and said second end element of each said header unit.

111. The method of claim 107, wherein said adding step comprises:

forming a cast-in-place concrete structure between said header stacks.

112. The method of claim 107, wherein said adding step comprises:

securing a pre-existing concrete panel between said header stacks.

113. The method of claim 100, further comprising:

adding a complementary structural element between two main header units such that it extends between two or more of said header stacks, such that passthrough ducts in said complementary structural element are in registry with said passthrough ducts in said header units.

114. The method of claim 113, further comprising:

securing at least one ground anchor in said complementary structural element at one of a plurality of passthrough channels extending through said complementary structural element configured to receive said ground anchor.

115. A method of fabricating a pre-stressed modular construction for retaining or supporting an applied load, comprising:

suspending a plurality of header units;

casting a foundation beneath said plurality of suspended header units;

constructing a plurality of header stacks on the cast foundation, wherein each said header stack is adjacent one of said plurality of suspended header units;

coupling an active reinforcement element to said header stack; and post-tensioning said active reinforcement element such that it imparts a corresponding pre-stressing force into said header stack.

116. The method of claim 115, wherein the step of constructing the header stacks comprises:

stacking a plurality of main header units and a plurality of sub-header units, said main header units and said sub-header units having a center element having a top face, and a bottom face; a plurality of indentations in one of the top and bottom faces; a plurality of protrusions on the other of the top and bottom faces of said center element corresponding to said plurality of indentations, wherein said protrusions on each said sub-header unit and said main header unit are configured to engage said corresponding indentations in an adjacent header unit;

a first end element disposed at one end of said center element;

a second end element disposed at another end of said center element;

wherein said first end element defines a first passthrough duct extending through said first end element and said second end element defines a second passthrough duct extending through said second end element, wherein said passthrough ducts are configured to receive said active reinforcement element; and a lock-off element coupled to said header stack at one of said lock-off points.

117. A system for constructing a pre-stressed modular construction for retaining or supporting an applied load, comprising:

a header stack, wherein said header stack is comprised of a plurality of main header units and a plurality of sub-header units, said main header units and said sub-header units being stacked to form said header stack;

an active reinforcement element configured to cooperate with said header stack so that post-tensioning said active reinforcement element imparts a corresponding pre-stressing force into said header stack, wherein the corresponding pre-stressing force is transferred to said header stack at at least one predetermined lock-off point;

a corner closure stack, wherein said corner closure stack is comprised of a plurality of corner closure units; and a second active reinforcement element configured to cooperate with said corner closure stack so that post-tensioning said second active reinforcement element imparts a corresponding pre-stressing force into said corner closure stack.

118. The system of claim 117, wherein each of said corner closure units comprises:

a body element having a top face and a bottom face; and a junction element having a top and bottom face disposed at one end of said body element.

119. The system of claim 118, wherein said junction element is integrally formed with said body element.

120. The system of claim 119, wherein said junction element extends from said body element in an angular configuration.

121. The system of claim 120, further comprising:

a plurality of indentations on one of the top and bottom faces of said body element; and a plurality of protrusions on the other of the top and bottom faces of said body element corresponding to said plurality of indentations, where said protrusions on each said corner closure unit are configured to engage said corresponding indentations in an adjacent corner closure unit.

122. The system of claim 120, further comprising:

first corrugations on one of the top and bottom faces of said body element; and second corrugations on the other of the top and bottom faces of said body element corresponding to said first corrugations, wherein said second corrugations on each said corner closure unit are configured to nest with said corresponding first corrugations in an adjacent corner closure unit.

123. The system of claim 122, further comprising:

first corrugations on one of the top and bottom faces of said junction element; and second corrugations on the other of the top and bottom faces of said junction element corresponding to said first corrugations, wherein said second corrugations on each said corner closure unit are configured to nest with said corresponding first corrugations in an adjacent corner closure unit.

124. The system of claim 120, wherein said junction element defines a first passthrough duct extending through said junction element and said body element defines a second passthrough duct extending through said body element, wherein said passthrough ducts are configured to receive said second active reinforcement element.

125. The system of claim 124, wherein said second active reinforcement element is disposed in said corner closure stack.

126. The system of claim 120, further comprising:

a harping element coupled to said corner closure stack at a harping point such that said second active reinforcement element is disposed external to said corner closure stack and is deformed at said harping point such that said second active reinforcement element forms a series of substantially straight segments.

127. The system of claim 126, further comprising a third active reinforcement element disposed in said header stack.

128. The system of claim 120, further comprising a structural member for coupling a corner closure stack to a header stack.

129. The system of claim 128, wherein said structural member defines a secondary passthrough duct that extends through said structural member.

130. The system of claim 129, wherein said structural member is coupled between two of said corner closure units such that said secondary passthrough duct in said structural member is in registry with at least one of said passthrough ducts in said two corner closure units.

131. The system of claim 130, wherein said structural member is positioned between said junction elements of each of said corner closure units.

132. The system of claim 117, further comprising:

a complementary structural element disposed between two of said corner closure units and extending between said corner closure stack and two or more of said header stacks.

133. The system of claim 132, wherein said complementary structural element comprises:

a passthrough duct in registry with one of said passthrough ducts in said corner closure units; and a passthrough channel extending through said complementary structural element.

134. The system of claim 133, further comprising:

a ground anchor coupled to said complementary structural element and configured to extend through said passthrough channel.

135. The system of claim 134, further comprising:

a raised portion extending from said complementary structural element and defining an opening in communication with said passthrough channel for receiving said ground anchor.

136. A method of fabricating a pre-stressed modular construction for retaining or supporting an applied load, comprising:

providing a foundation for said construction;

constructing a plurality of header stacks on the foundation, wherein each said header stack is comprised of a plurality of header units;

coupling an active reinforcement element to each said header stack;

post-tensioning said active reinforcement element such that it imparts a corresponding pre-stressing force into said header stack;

constructing a plurality of corner closure stacks on the foundation, wherein each said corner closure stack is comprised of a plurality of corner closure units;

coupling a second active reinforcement element to each said corner closure stack; and post-tensioning said second active reinforcement element such that it imparts a corresponding pre-stressing force into said corner closure stack.

137. The method of claim 136, wherein the step of constructing the corner closure stacks comprises:

stacking a plurality of corner closure units, said corner closure units having a body element having a top face and a bottom face; and a plurality of indentations in one of the top and bottom faces; a plurality of protrusions on the other of the top and bottom faces of said body element corresponding to said plurality of indentations, wherein said protrusions on each said corner closure unit are configured to engage said corresponding indentations in an adjacent corner closure unit;

a junction element having a top and bottom face disposed at one end of said body element wherein said junction element defines a passthrough duct extending through said junction element, wherein said passthrough duct is configured to receive said active reinforcement element; and a lock-off element coupled to said header stack.

138. The method of claim 137, wherein said step of coupling comprises:

pre-positioning said active reinforcement element in the foundation;

feeding said corner closure units over said active reinforcement element, said active reinforcement element passing through said passthrough duct;

securing said active reinforcement element to the corner closure stack.

* * * * *